US008011565B2

(12) United States Patent
Quaintance et al.

(10) Patent No.: US 8,011,565 B2
(45) **Date of Patent: *Sep. 6, 2011**

(54) MULTI-SIDED TRAY BLISS CONTAINER

(75) Inventors: Benjamin W Quaintance, Germantown, TN (US); Michael A Churvis, Germantown, TN (US)

(73) Assignee: International Paper Co., Memphis, TN (US)

( * ) Notice: Subject to any disclaimer, the term of this patent is extended or adjusted under 35 U.S.C. 154(b) by 51 days.

This patent is subject to a terminal disclaimer.

(21) Appl. No.: 12/229,078

(22) Filed: Aug. 20, 2008

(65) Prior Publication Data

US 2009/0057385 A1 Mar. 5, 2009

Related U.S. Application Data

(63) Continuation-in-part of application No. 11/897,527, filed on Aug. 30, 2007.

(60) Provisional application No. 61/011,975, filed on Jan. 23, 2008, provisional application No. 61/072,233, filed on Mar. 28, 2008.

(51) Int. Cl.
*B65D 25/04* (2006.01)
*B65D 5/02* (2006.01)

(52) U.S. Cl. ..... 229/120.26; 229/185.1

(58) Field of Classification Search ..... 229/108, 229/120.26, 185.1, 920, 126, 109
See application file for complete search history.

(56) References Cited

U.S. PATENT DOCUMENTS

| | | | | |
|---|---|---|---|---|
| 1,892,715 | A | 1/1933 | Wellman | |
| 1,960,635 | A * | 5/1934 | Kinkenon | 229/155 |
| 1,974,527 | A | 9/1934 | Bliss | |
| 2,295,478 | A * | 9/1942 | Jason, Jr. | 426/124 |
| 2,819,833 | A * | 1/1958 | Sauer | 229/109 |
| 3,512,697 | A | 5/1970 | Robinson | |
| 3,841,476 | A | 10/1974 | Elford | |
| 3,921,893 | A | 11/1975 | Randle, Jr. | |
| 4,319,710 | A * | 3/1982 | Osborne | 229/238 |
| 4,362,265 | A | 12/1982 | Williams | |
| 4,363,265 | A * | 12/1982 | Tanioka et al. | 99/510 |
| 4,417,686 | A | 11/1983 | Wozniacki | |
| 4,765,534 | A * | 8/1988 | Zion et al. | 229/109 |
| 4,828,929 | A * | 5/1989 | Pierson | 229/109 |
| 5,263,634 | A | 11/1993 | Korine | |
| 5,358,173 | A | 10/1994 | Mertz | |
| 5,361,974 | A * | 11/1994 | Earl et al. | 229/122.32 |
| 5,752,648 | A | 5/1998 | Quaintance | |
| 5,860,590 | A | 1/1999 | Blomfield et al. | |
| 6,309,335 | B1 | 10/2001 | Holton | |
| 6,598,785 | B2 | 7/2003 | Quaintance | |
| 6,651,873 | B2 * | 11/2003 | Quaintance | 229/109 |
| 6,749,107 | B2 | 6/2004 | Quaintance | |

* cited by examiner

*Primary Examiner* — Nathan J Newhouse
*Assistant Examiner* — Christopher Demeree
(74) *Attorney, Agent, or Firm* — Matthew M. Eslami

(57) ABSTRACT

A multi-sided container comprising a bottom wall, a top wall, opposite side walls, opposite end walls, a longitudinal axis and a plurality of diagonal corner walls all are cooperating with one another to form an interior space. At least one of the plurality of diagonal corner walls defined by at least one diagonal corner panel and at least one reinforcement flap overlapping one another and wherein a portion of the bottom wall projects under and beyond a bottom edge of the at least one diagonal corner wall. The at least one reinforcement flap extends from longitudinal ends of the respective opposite side walls. At least one end flap extends from long side of the reinforcement flap and the at least one end flap projects beyond an entire surface of the at least one diagonal corner wall terminating its edge at the end wall.

12 Claims, 37 Drawing Sheets

MULTI-SIDED TRAY BLISS CONTAINER

This application is a continuation-in-part of U.S. Non-Provisional patent application having Ser. No. 11/897,527, filed Aug. 30, 2007; and claims the benefit of U.S. provisional application Ser. No. 61/011,975, filed on Jan. 23, 2008; and claims the benefit of U.S. provisional patent application Ser. No. 61/072,233, filed on Mar. 28, 2008, all of which are hereby incorporated hereinto by reference as if fully restated herein.

FIELD OF THE INVENTION

This invention relates generally to packaging and in particular to a Tray-Bliss style shipping container of simplified construction and enhanced stiffness and rigidity.

BACKGROUND OF THE INVENTION

Various styles of shipping containers are known in the prior art, including the so-called Bliss-style container in which a wrapper is folded around and stapled or glued to a pair of end pieces to form an enclosed container. The end pieces normally comprise flat panels that form the end walls in the container, and the wrapper forms the bottom wall, sidewalls and top wall. Flanges on opposite edges of the wrapper are folded and glued or otherwise fastened to the end wall panels to secure the wrapper and end pieces together. The flanges fastened against the end wall panels in the corners of the container serve to strengthen the container in comparison to a typical box that is folded from a single blank and has single panel thickness in the end walls and sidewalls. Compression or stacking strength of the container normally is enhanced by orienting the corrugations of the wrapper so that they extend vertically, but this sometimes results in an inefficient utilization of corrugator width during manufacture of the container.

Another common style of shipping container is the so-called Defor™ container made by International Paper Company. The Defor™ container typically is formed from a single blank that is folded to form double thickness end walls and/or sidewalls and therefore normally has greater strength than a Bliss-style container, although it requires more material in its manufacture. Stacking tabs normally project from the upper edges of the end walls or sidewalls and notches in the lower edges receive the stacking tabs when two or more containers are stacked on top of one another. One of the panels forming a part of the end walls or sidewalls can be folded to form a diagonal panel in each corner to lend greater stacking strength to the container. Other examples of prior art are disclosed in Assignee's prior patents U.S. Pat. Nos. 6,598,785; 5,752,648; 4,417,686.

Some Bliss-style containers have modified corners wherein a diagonal corner panel extends across each corner to increase the stacking strength, but in these conventional modified corner Bliss-style containers there is nothing behind the angled panel except the edge of the wrapper and the wrapper flange that is secured to the end panel. Moreover, these modified corner design of the flanges on the wrapper must be relatively wide to reach past where the diagonal corner panel joins the end panel. This results in weak areas in the bottom of the container at each corner.

Accordingly, there is need to for a container that has superior stacking strength and resistance to distortion when transverse forces are applied to the ends or sides of the container.

SUMMARY OF THE INVENTION

The shipping container of the present invention has features of both the Bliss-style container and the Defor™ container, but has advantages possessed by neither of them. In one embodiment of the invention, the container is formed from three pieces, including a wrapper blank secured onto two end pieces. The end pieces are uniquely constructed so that a double wall lamination is created in each end wall and partial side panels are used in each sidewall of the assembled container, allowing very high compression levels to be achieved from the use of relatively lightweight materials. The design of the container in the present invention enables the corrugations in the wrapper blank to be oriented horizontally since compression strength is obtained primarily from the end structures, allowing efficient and optimized utilization of corrugator width during manufacture of the container.

Accordingly, a multi-sided container comprising a bottom wall, a top wall, opposite side walls, opposite end walls, a longitudinal axis and a plurality of diagonal corner walls all are cooperating with one another to form an interior space. At least one of the plurality of diagonal corner walls defined by at least one diagonal corner panel and at least one reinforcement flap overlapping one another and wherein a portion of the bottom wall projects under and beyond a bottom edge of the at least one diagonal corner wall. It should be noted that the reinforcement flap extends from longitudinal ends of the respective opposite side walls. There are four end flaps wherein each of the end flaps extends from long side of the each respective reinforcement flap and each of the end flaps project beyond an entire surface of the respective at least one diagonal corner walls terminating their edges at the respective end walls. It should also be noted that the multi-sided container is characterized by bottom wall, the side walls, and top wall are integrally attached to one another to define a wrapper and the respective end walls panels, respective diagonal corner panels, and respective partial side wall panels are integrally attached to one another to define respective end pieces. Alternatively, the wrapper and the end pieces may be a unitary blank. The wrapper & end pieces can be made from different materials. Typically the wrap is lighter weight with a focus on containment. Typically the end pieces are heavier materials focused toward stacking strength.

Another aspect of the present invention relates to a multi-sided container comprising a wrapper formed by a bottom wall having at least two side walls and a pair of flaps. Each of the two side walls extends integrally from opposite long sides of the bottom wall and the pair of flaps extends integrally from opposite short sides of the bottom wall. Each of the side walls has a reinforcement flap and an end flap. A pair of end pieces where each of which formed by incorporating one end wall panel, one diagonal corner panel, and one partial side wall panel to define respective end walls and respective diagonal corner walls. The pair of end pieces and the wrapper is attached to one another by the respective end flaps to construct the multi-sided container. The respective diagonal corner walls and the respective reinforcement flaps are overlapping one another and a portion of the bottom wall projects under and beyond a bottom edge of the respective pair of end pieces.

One further aspect of the present invention relates to a blank for making a multi-sided container having a bottom wall, a top wall, opposite side walls, opposite end walls, a longitudinal axis and a plurality of diagonal corner walls. The blank is comprising a unitary piece of generally rectangularly shaped material having a plurality of first, approximately parallel, spaced apart fold lines delimiting a bottom wall panel, side wall panels, and top wall panels. A plurality of approximately parallel spaced apart second fold lines is extending perpendicular to the first fold lines and defining a transversal edge of the bottom panel, side wall panels, and top wall panels. A plurality of reinforcement flaps and end flaps joined to the opposite transversal edges of the side wall panels, two flaps each of which are joined to the opposite transversal edges of the bottom wall panel and respective top wall panels. A pair of end pieces each of which is formed to be attached to the respective transversal edges of the bottom wall panel and side wall panels. Each of the end pieces having a plurality of third, parallel, spaced apart fold lines delimiting end wall panels, diagonal corner panels, partial side wall panels.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DESCRIPTION OF THE INVENTION

Figure 1:
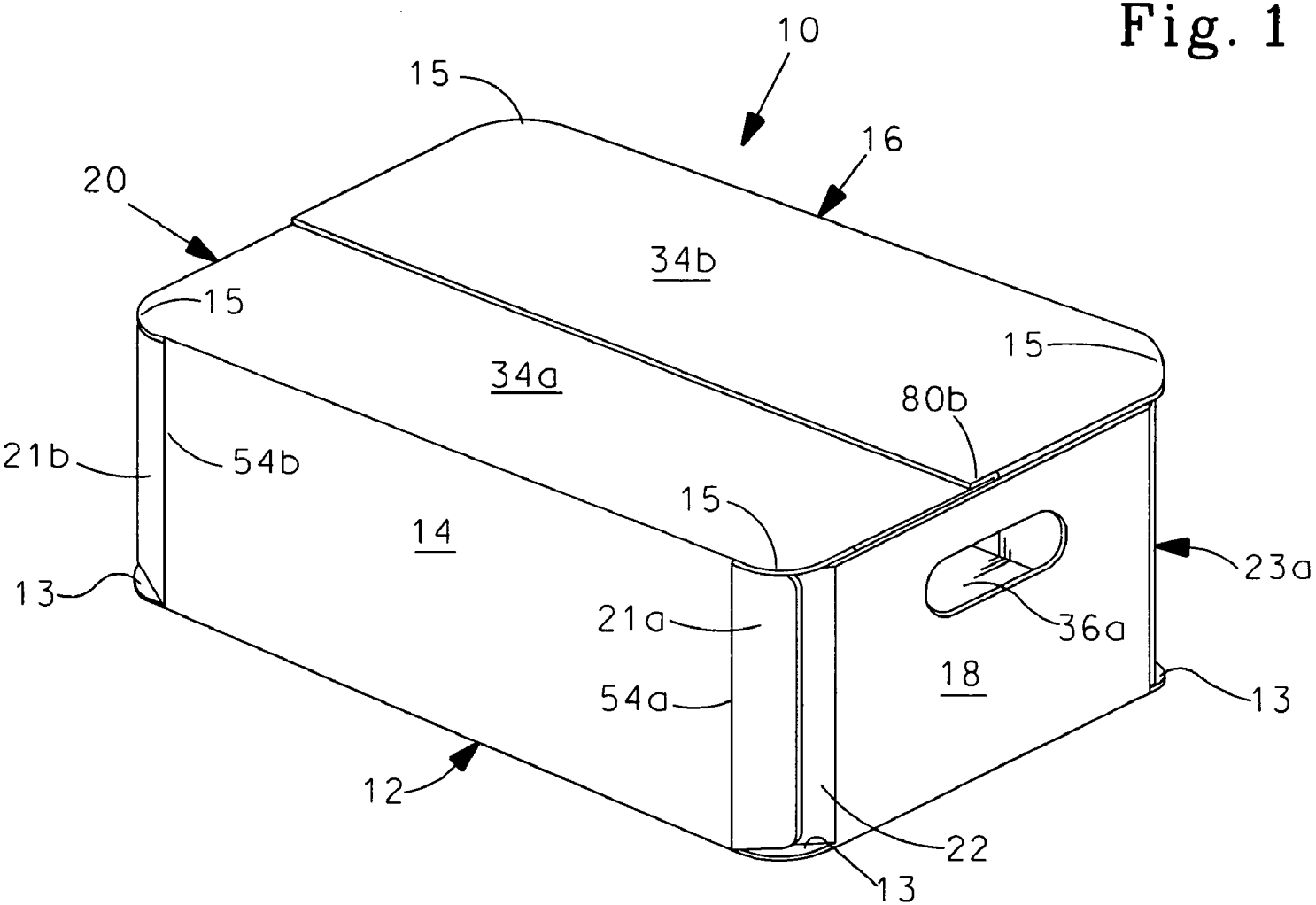
FIG. 1 is a top perspective view of a multi-sided container in accordance with a first embodiment of the invention.
Figure 2:
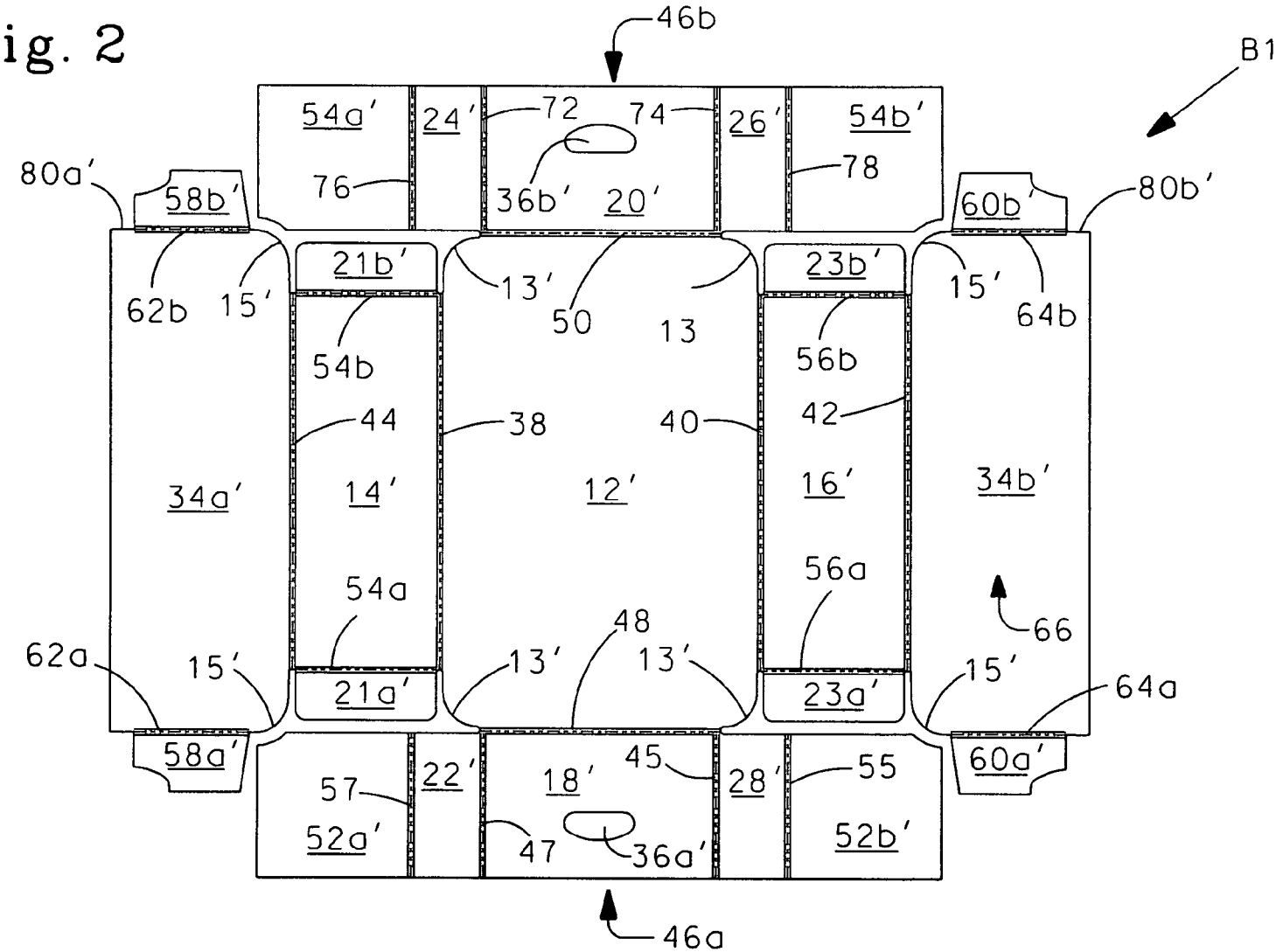
FIG. 2 is a plan view of a unitary blank B 1 used to form the multi-sided container shown in FIG. 1 in accordance with a first embodiment of the invention.

FIG. 1 is a top perspective view of a container 10 in accordance with a first embodiment of the invention. The container 10 comprises a bottom wall 12, opposite parallel side walls 14, 16, opposite parallel end walls 18, 20 and diagonal corner panels 22, 24, 26 and 28 (FIG. 3) connecting the respective side walls 14, 16 and respective end walls 18, 20 at adjacent ends. The bottom 12 has an advantage of having four identical rounded corners 13 which enhances the integrity of the container 10 as will be described in greater detail hereinafter. The diagonal corner walls 22, 24, 26 and 28 extend at an angle generally ranges from about 33 to 38 degrees with respect to the longitudinal axis of the container 10. As one of ordinary skill in the art would appreciate, it is within the scope of the present invention to use other angles such as 45° to meet the requirement of the intended design of the container 10. Each of the side walls 14, 16 includes a respective pair of reinforcement flaps 21*a*, 21*b* and 23*a*, 23*b* that are defined by respective fold lines 54*a*, 54*b*, 56*a*', 56*b*' (FIG. 2). The opposite width of the respective side walls 14 and 16 is such that the reinforcement flaps 21*a*, 21*b* and 23*a*, 23*b* project at their opposite side edges over the diagonal corner walls 22, 24, 26 and 28, terminating the flaps at their edges proximately in the middle of the respective diagonal corner walls 22, 24, 26 and 28. Alternatively, the flaps 21*a*, 21*b* and 23*a*, 23*b* may project at their opposite side edges beyond the width of the diagonal corner walls 22, 24, 26 and 28, terminating the flaps at their edges on the end walls 78 and 80. Two top wall panels 34*a*, 34*b* generally defined a top wall that encloses the container 10. The top wall panel 34*a* is integrally attached to the side wall 14 and the top wall panel 34*b* is integrally attached to the side wall 16, but one of ordinary skill in the art would appreciate that it is within the scope of the present invention to use a single cover integrally attached to one of the side walls or end walls of the container. Alternatively, the top wall panels 34*a*, 34*b* may detachably cover the container 10. Two hand hole openings 36*a*, 36*b* (FIG. 3) are formed on the respective end walls 18, 20 to facilitate handling of the container 10.

FIG. 2 is a plan view of a unitary blank B1 used to form the container 10 shown in FIG. 1 in accordance with a first embodiment of the invention. The blank B1 comprises a centrally located rectangular panel 12' that forms the bottom wall 12. The rectangular panel 12' has an advantage of having four identical rounded corners 13' which enhances the integrity of the container 10 when the blank B1 is formed into container 10. Side wall forming panels 14' and 16' are foldably joined to opposite side edges of the panel 12' by respective fold lines 38, 40. Each of the side wall panels 14', 16' includes two respective identical reinforcement flaps 21*a*', 21*b*' and 23*a*', 23*b*' defined by respective fold lines 54*a*', 54*b*', and 56*a*', 56*b*'. Top wall panels 34*a*' and 34*b*' are foldably joined to respective longitudinal edges of the sidewall panels 14' and 16', opposite of their folded connection to the panel 12', by fold lines 42, 44. Each of the top wall panels 34*a*', 34*b*' includes two respective identical flaps 58*a*', 58*b*' and 60*a*', 60*b*' defined by respective fold lines 62*a*, 62*b*, and 64*a*', 64*b*'. An Arrow mark 66 indicates the direction of corrugation of the blank B1. Similarly, each of the top wall panels 34*a*', 34*b*', as noted with respect to the rectangular panel 12', has an advantage of having two identical rounded corners 15' which enhances the integrity of the container 10 when the blank B1 is formed into container 10. In addition, it should be noted that flaps 58*a*', 58*b*' and 60*a*', 60*b*' do not extend the full width of the top wall panels 34*a*', 34*b*', but terminate short of the outer free edge thereof, defining projecting tabs 80*a*' and 80*b*'. A pair of end pieces 46*a*, 46*b* is foldably joined to respective transverse edges of the panel 12' by fold lines 48, 50. The end pieces 46*a*, 46*b* are essentially identical to one another and they are mirror images of one another. The end piece 46*a* includes an end wall panel 18', two relatively reinforcing corner panels 22' and 28' foldably joined to opposite ends of the panel 18' by fold lines 45', 47', and second partial sidewall panels 52*a*', 52*b*' are foldably joined to outer edges of respective narrow reinforcing corner panels 22', 28' by fold lines 55' and 57'. Similarly, The end piece 46*b* includes an end wall panel 20', two relatively reinforcing corner panels 24' and 26' foldably joined to opposite ends of the panel 20' by fold lines 72', 74', and second partial sidewall panels 54*a*', 54*b*' are foldably joined to outer edges of respective corner panels 24', 26' by fold lines 76' and 78'. Openings 36*a*', 36*b*' are formed on the respective end wall panels 18', 20' so that when the blank B1 is folded, these openings 36*a*', 36*b*' forms the hand hole openings 36*a*, 36*b* in the container 10 as described with reference to FIG. 1.

Figure 3:
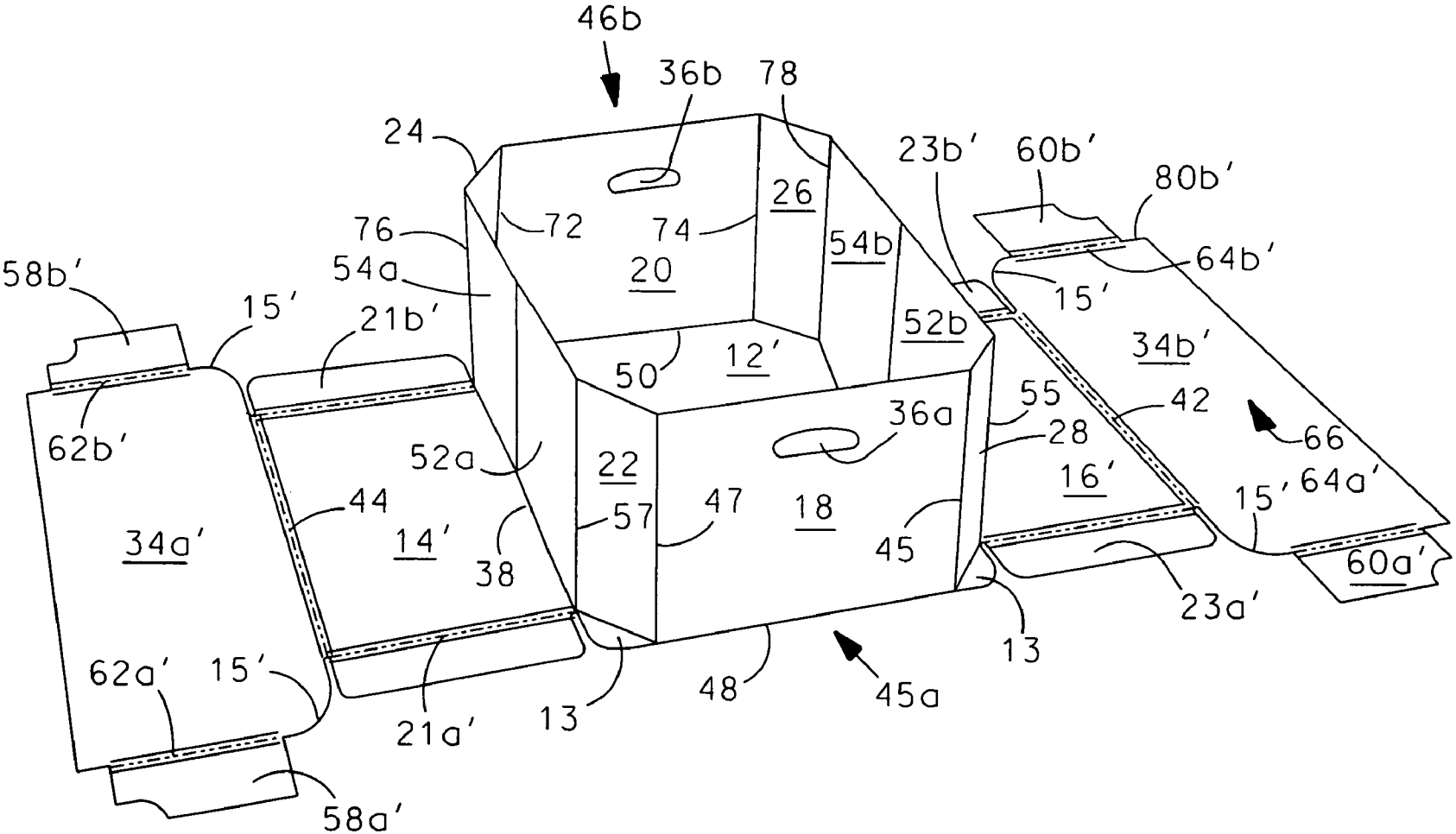
FIG. 3 is similar to FIG. 2, showing the unitary blank in a partially folded position by illustrating a portion of the unitary blank formed into the end walls of the container depicted in FIG. 1.

FIG. 3 is similar to FIG. 2, showing the unitary blank B1 in a partially folded position by illustrating a portion of the unitary blank B1 formed into the end walls 18, 20 of the container 10 depicted in FIG. 1. Each of the end pieces 46*a*' and 46*b*' is folded 90 degrees with respect to their fold lines 48 and 50. Then, the respective relatively diagonal corner panels 22', 24' and 26', 28' are folded inwardly toward the bottom panel 12' to form the diagonal corner panels 22', 24' and 26', 28' at an angle generally 38 degrees with respect to the longitudinal axis of the container 10 so that each of the rounded corners 13 provides a greater base by increasing surface area for the diagonal corner panels 22', 24' and 26', 28' to transmit pressure applied at the contact area of the diagonal corner panels and the bottom wall. Then, partial sidewall panels 52*a*', 52*b*', 54*a*', 54*b*' are folded with respect to fold lines 55', 57', 76', and 78' in a manner such that the bottom edges of the partial sidewall panels 52*a*', 52*b*', 54*a*', 54*b*' are respectively coincided with the fold line 38 and 40.

Figure 4:
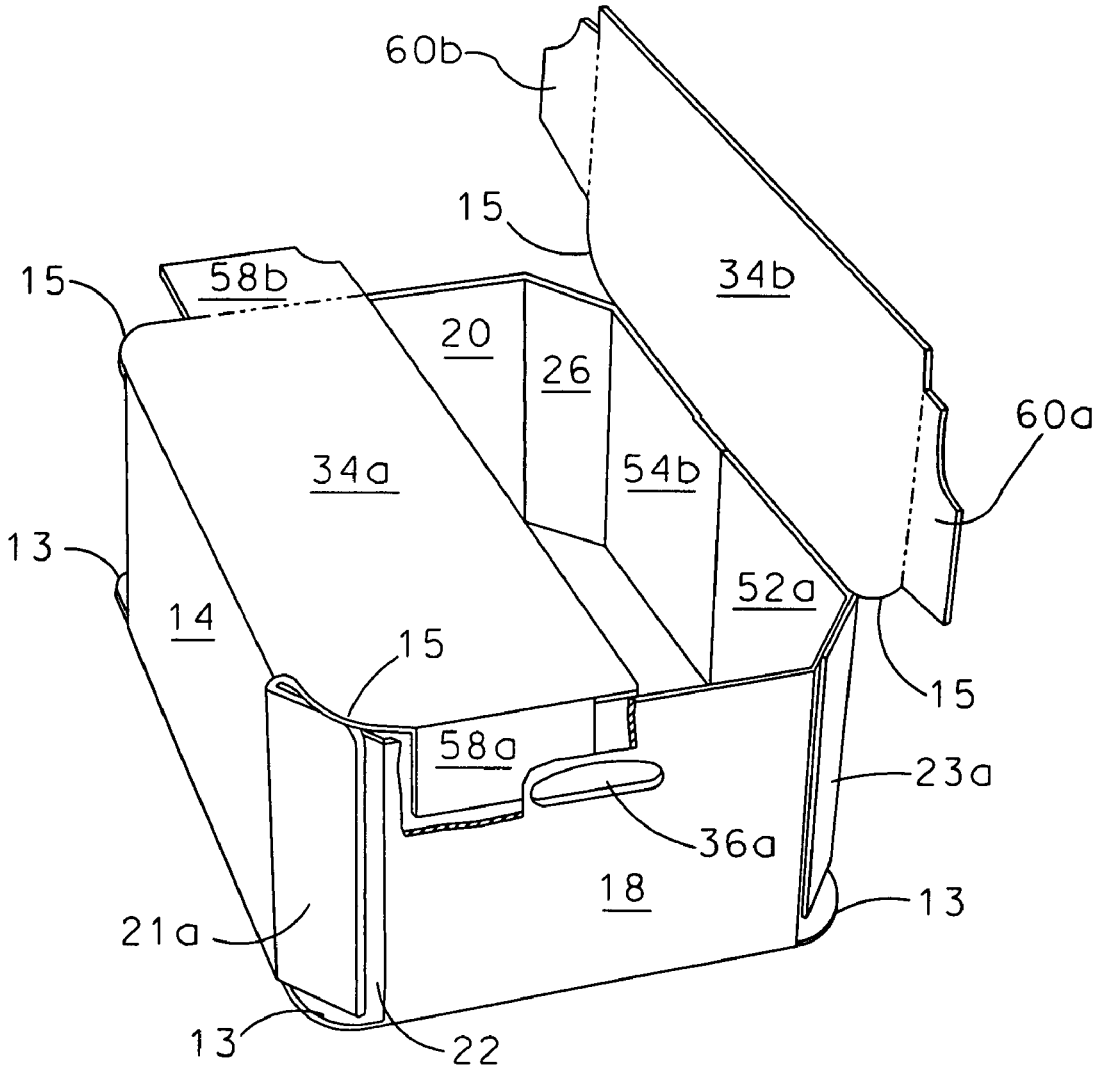
FIG. 4 is a perspective view of the fully constructed multi-sided container formed from the unitary blank shown in FIG. 2 and illustrating the container in FIG. 1 in a partially open position.

FIG. 4 is a perspective view of the fully constructed multi-sided container 10 formed from the blank shown in FIG. 2 and illustrating the container 10 in FIG. 1 in a partially opened position. The respective side wall forming panels 14' and 16' are folded at 90 degrees with respect to the panel 12' along the fold lines 38, 40 and configured to be attached with the respective partial sidewall panels 52*a*, 52*b* and 54*a*, 54*b* so that the respective side wall forming panels 14' and 16' and the respective partial sidewall panel 52*a*, 52*b* and 54*a*, 54*b* are glued to one another. Next, the respective top wall panels 34*a*', 34*b*' are folded along respective fold lines 42, 44 to form top wall 34*a*, 34*b* as depicted in FIG. 4. The respective flaps 58*a*, 58*b*, 60*a*, 60*b* are folded along the respective fold lines 62'*a*, 62*b*', 64*a*', 64*b*' and tucked inside the container 10.

Figure 5:
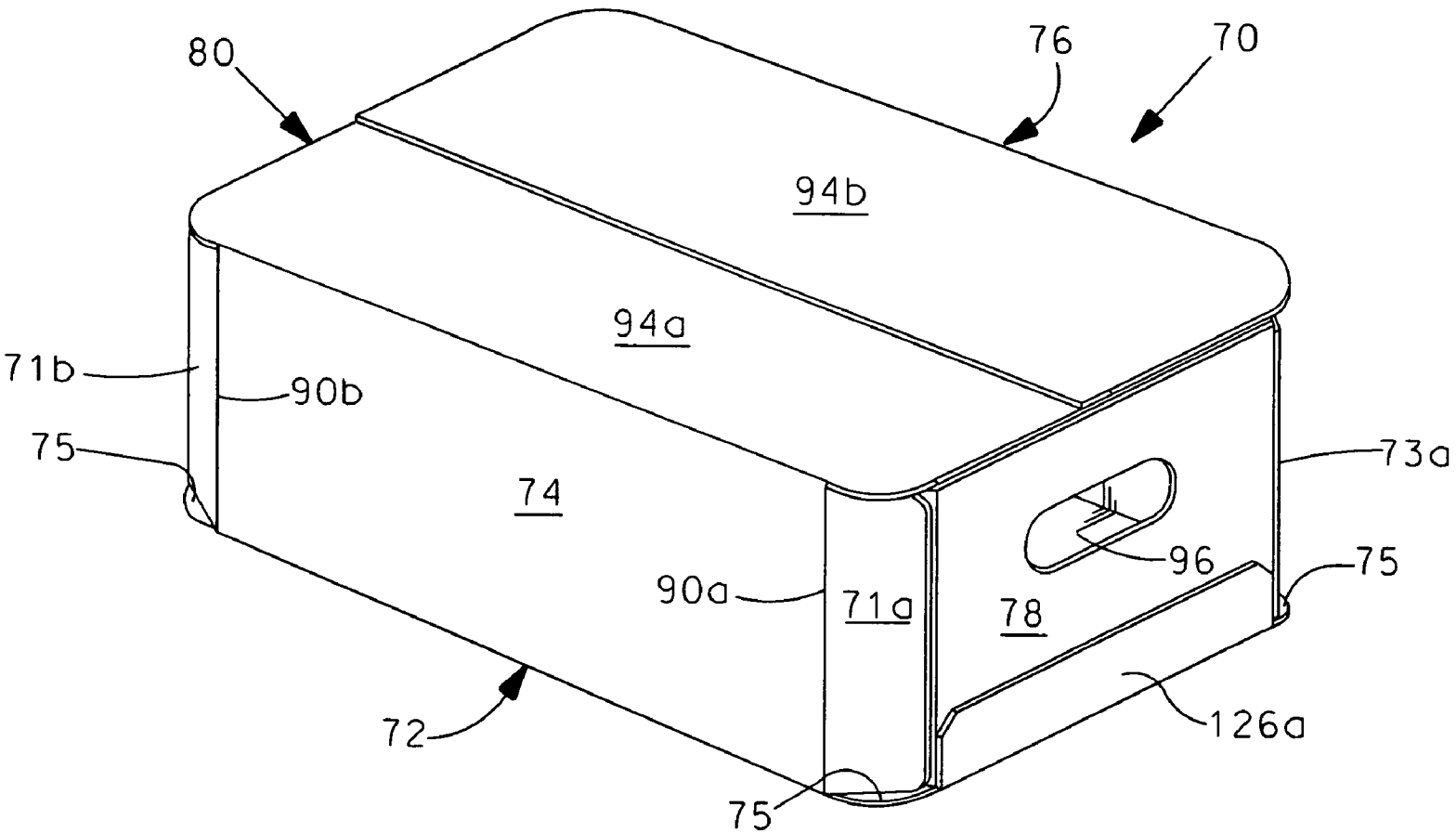
FIG. 5 is a top perspective view of a three pieces multi-sided container in accordance with a second embodiment of the invention.

FIG. 5 is a top perspective view of a multi-sided container 70 in accordance with a second embodiment of the invention. The container 70 comprises a bottom wall 72, opposite parallel side walls 74, 76, opposite parallel end walls 78, 80 and diagonal corner panels 82, 84, 86 and 88 (FIG. 8) connecting the respective side walls 74, 76 and respective end walls 78, 80 at adjacent ends. The diagonal corner walls 82, 84, 86 and 88 extend at an angle generally ranges from about 33 to 38 degrees with respect to the longitudinal axis of the container 70. Each of the side walls 74, 76 includes a respective pair of reinforcement flaps 71*a*, 71*b* and 73*a*, 73*b* that are defined by respective fold lines 90*a*, 90*b*, 92*a*, 92*b*.The pair of reinforcement flaps 71*a*, 71*b* and 73*a*, 73*b* of the opposite width of the respective side walls 74 and 76 is such that they project at their opposite side edges over the entire surface of the diagonal corner walls 82, 84, 86 and 88, terminating their edges at the respective edges of the diagonal corner walls 82, 84, 86 and 88. Two top walls 94*a*, 94*b* are generally defined as top wall that encloses the container 70. The top wall 94*a* is integrally attached to the side wall 74 and the top wall 94*b* is integrally attached to the side wall 76, but one ordinary skill in the art would appreciate that it is within the scope of the present invention to use a single cover integrally attached to one of the side walls 74, 76 or end walls 78, 80 of the container 70. Alternatively, the top walls 94*a*, 94*b* may detachably cover the container 70. Two hand hole openings 96*a*, 96*b* are formed on the respective end walls 78, 80 to facilitate handling of the container 70.

Figure 6:
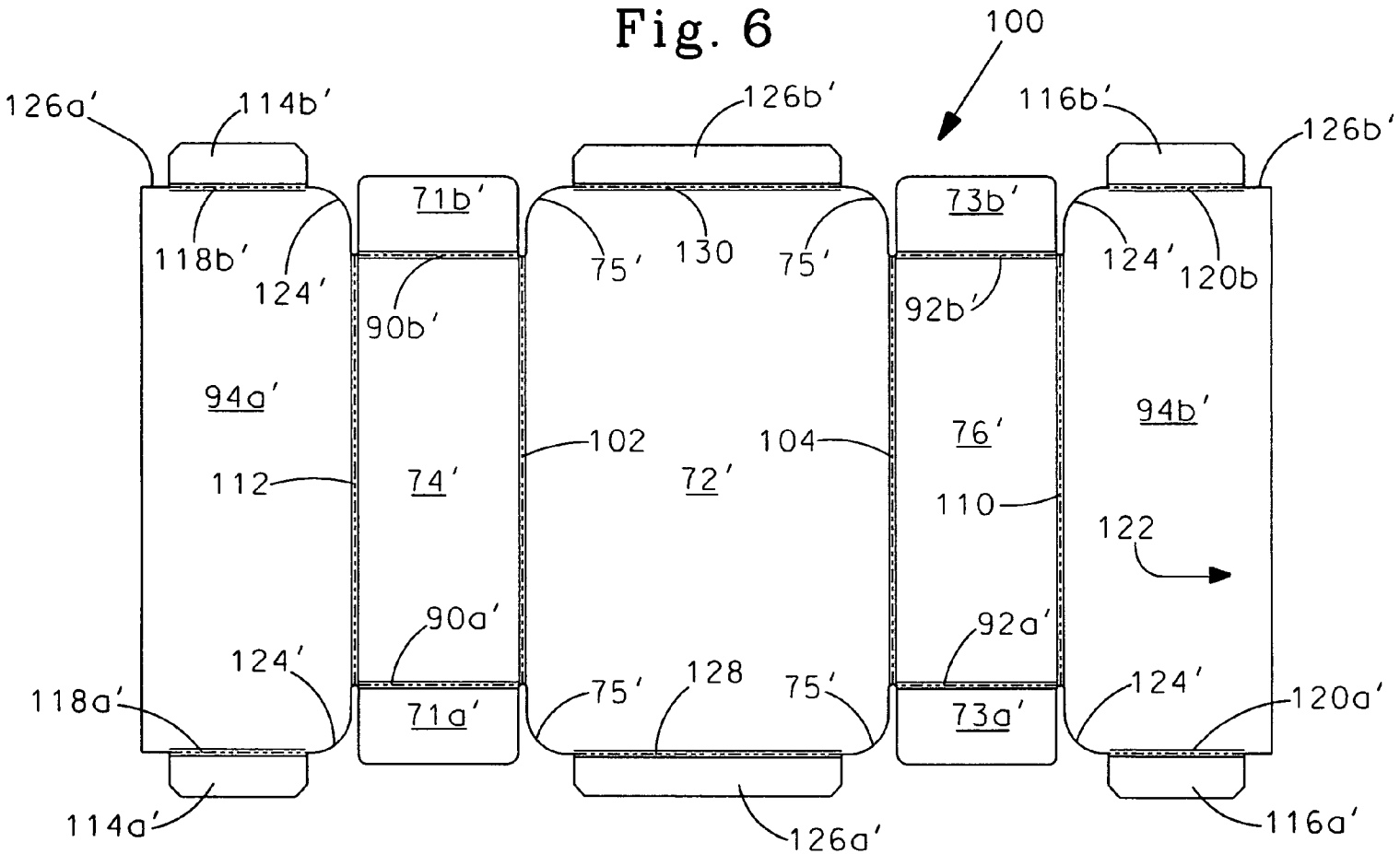
FIG. 6 is a plan view of a wrapper blank that forms the bottom wall, top and side walls of the three-piece multi-sided container depicted in FIG. 1.

FIG. 6 is a plan view of a wrapper blank 100 that forms the bottom wall panel 72, top walls 94*a*, 94*b* and side walls 74*a*, 76*b* of the three-piece container 70 depicted in FIG. 5 in accordance with the second embodiment of the invention. The wrapper blank 100 comprises a centrally located rectangular panel 72' that forms the bottom wall 72. The rectangular panel 72' has an advantage of having four identical rounded corners 75' which enhances the integrity of the container 70 when the wrapper blank 100 is folded. Side wall forming panels 74' and 76' are foldably joined to opposite side edges of the panel 72' by respective fold lines 102, 104. Each of the side wall panels 74', 76' includes two respective identical flaps 71*a*', 71*b*' and 73*a*', 73*b*' defined by respective fold lines 90*a*', 90*b*', and 92*a*', 92*b*'. Top wall panels 94*a*' and 94*b*' are foldably joined to respective longitudinal edges of the sidewall panels 74' and 76', opposite of their folded connection to the panel 72', by fold lines 110, 112. Each of the top wall panels 94*a*', 94*b*' includes two respective identical flaps 114*a*', 114*b*' and 116*a*', 116*b*' defined by respective fold lines 118*a*', 118*b*', and 120*a*', 120*b*'. An Arrow mark 122 indicates the direction of corrugation of the wrapper blank 100. Similarly, each of the top wall panels 94*a*', 94*b*', as noted with respect to the rectangular panel 72', has an advantage of having two identical rounded corners 124' which enhances the integrity of the container 70 when the wrapper blank 100 is folded. In addition, it should be noted that flaps 114*a*', 114*b*' and 116*a*', 116*b*' do not extend the full width of the top wall panels 94*a*', 94*b*', but terminate short of the outer free edge thereof, defining projecting tabs 126*a*' and 126*b*'. A pair of flaps 126*a*', 126*b*' is foldably joined to respective transverse edges of the panel 72' by fold lines 128, 130. The flaps 126*a*', 126*b*' are essentially identical to one another and they are mirror images of one another. The respective flaps 126*a*', 126*b*' are glued to the respective end walls 78, 80 when the wrapper blank 100 is folded to form the bottom wall 72, side walls 74, 76, and top walls 94*a* and 94*b*.

Figure 7:
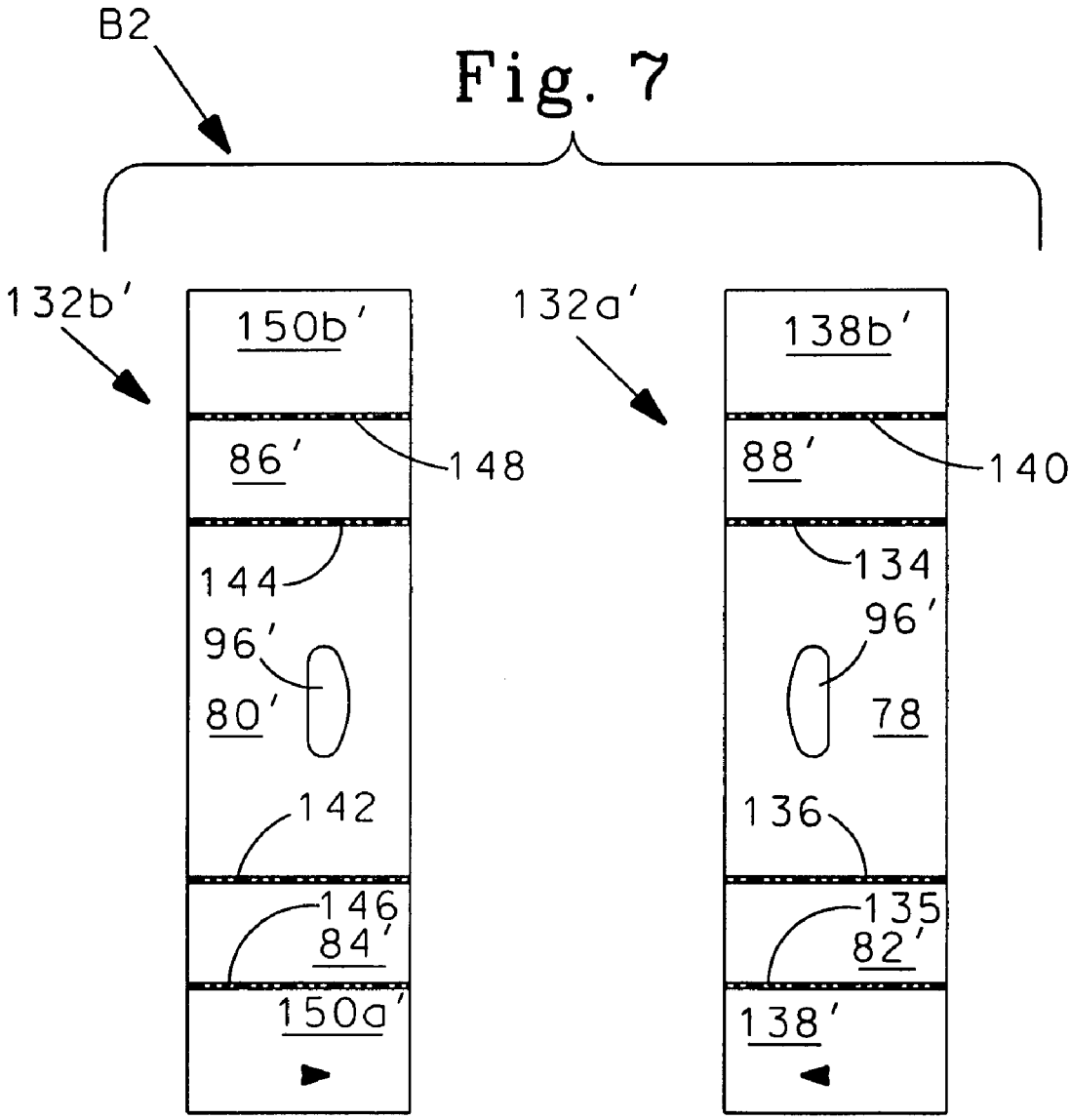
FIG. 7 is a plan view of a pair of blanks B2 that form the end pieces used to construct the three-piece multi-sided container depicted in FIG. 5.

FIG. 7 is a plan view of a pair of blanks B2, blank 132*a*' and blank 132*b*' each form the end walls 78 and 80 used to construct the three-piece multi-sided container 70 depicted in FIG. 5. The pair of end pieces 132*a*' and 132*b*' is attached to respective transverse edges of the panel 72'. The end pieces 132*a*' and 132*b*' are essentially identical to one another and they are mirror images of one another. The end piece 132*a*' includes an end wall panel 78', two relatively narrow reinforcing corner panels 82' and 88' foldably joined to opposite ends of the panel 78' by fold lines 134, 136, and second partial sidewall panels 138*a*', 138*b*' are foldably joined to outer edges of respective narrow reinforcing corner panels 82' and 88' by fold lines 135 and 140. Similarly, The end piece 132*b*' includes an end wall panel 80', two relatively narrow reinforcing corner panels 84' and 86' foldably joined to opposite ends of the panel 80' by fold lines 142, 144, and second partial sidewall panels 150*a*', 150*b*' are foldably joined to outer edges of respective narrow reinforcing corner panels 84' and 86' by fold lines 146 and 148. Openings 96*a*', 96*b*' are formed on the respective end wall panels 78', 80' so that when the end pieces 132*a*', 132*b*' are folded, these openings 96*a*', 96*b*' forms the hand hole openings 96 in the container 70 as described with reference to FIG. 5.

Figure 8:
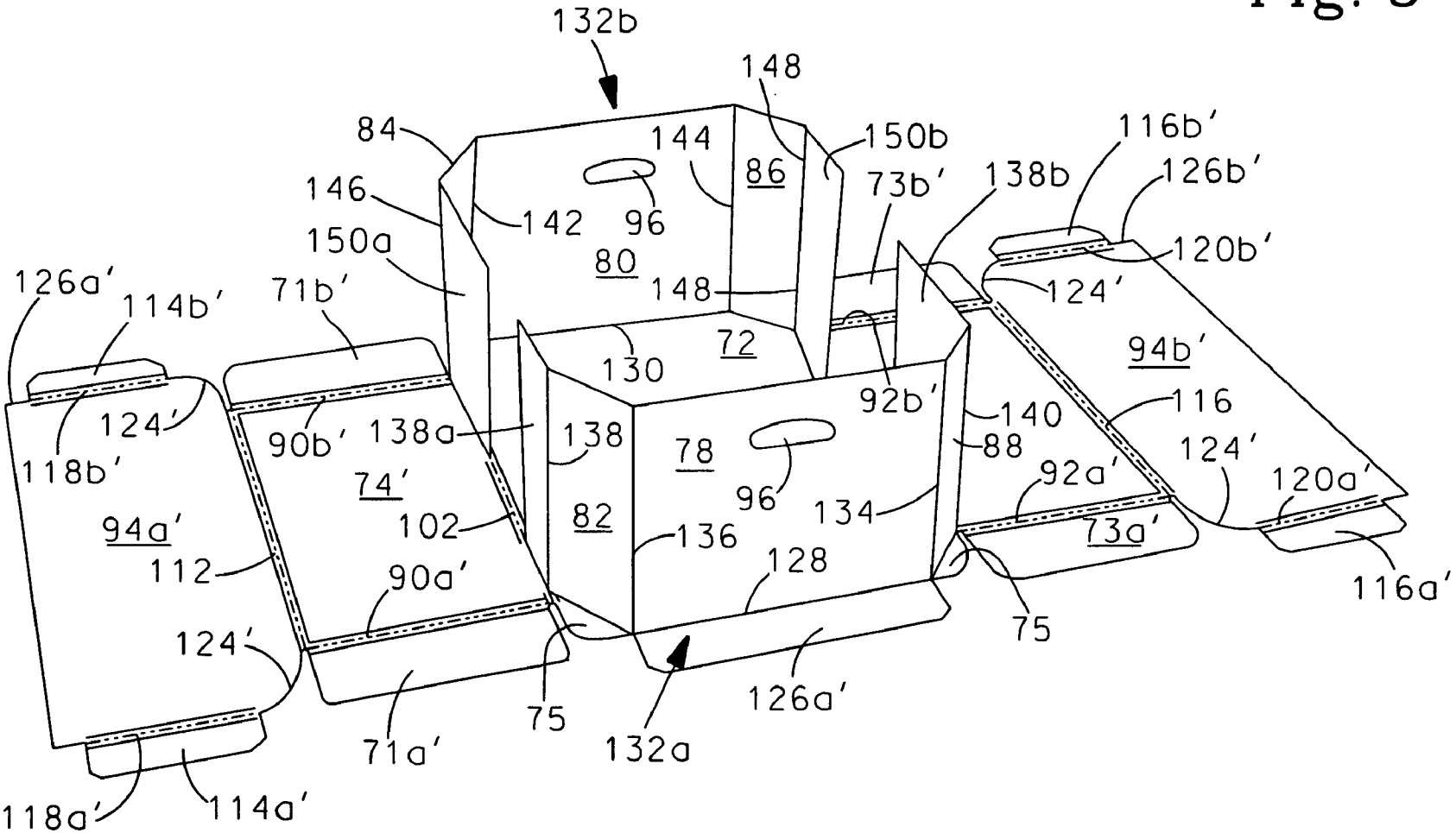
FIG. 8 is a top perspective view of the end pieces located in their operative positions on the wrapper blank shown in FIG. 6, and illustrating the wrapper blank in the folding position around the end pieces.

FIG. 8 is a top perspective view of the end pieces 132*a*, 132*b* located in their operative positions on the wrapper blank 100 shown in FIG. 6 and illustrating the wrapper blank 100 in the folding position around the end walls pieces 132*a*, 132*b*.The end pieces 132*a*, 132*b* are folded along their respective fold lines 134, 136, 142, and 144. The respective relatively narrow reinforcing corner panels 82', 84' and 86', 88' are folded inwardly toward the bottom panel 72' at approximately 45 degrees so that the rounded corners 75 provides a greater base by increasing surface area for the reinforcing corner panels 82', 84' and 86', 88' to transmit pressure applied at those location. Then, partial sidewall panels 138*a*', 138*b*', 150*a*', 150*b*' are folded with respect to fold lines 138, 140, 146, and 148 in a manner such that the bottom edges of the partial sidewall panels 138*a*', 138*b*', 150*a*', 150*b*' are respectively coincided with the fold line 102 and 104.

Figure 9:
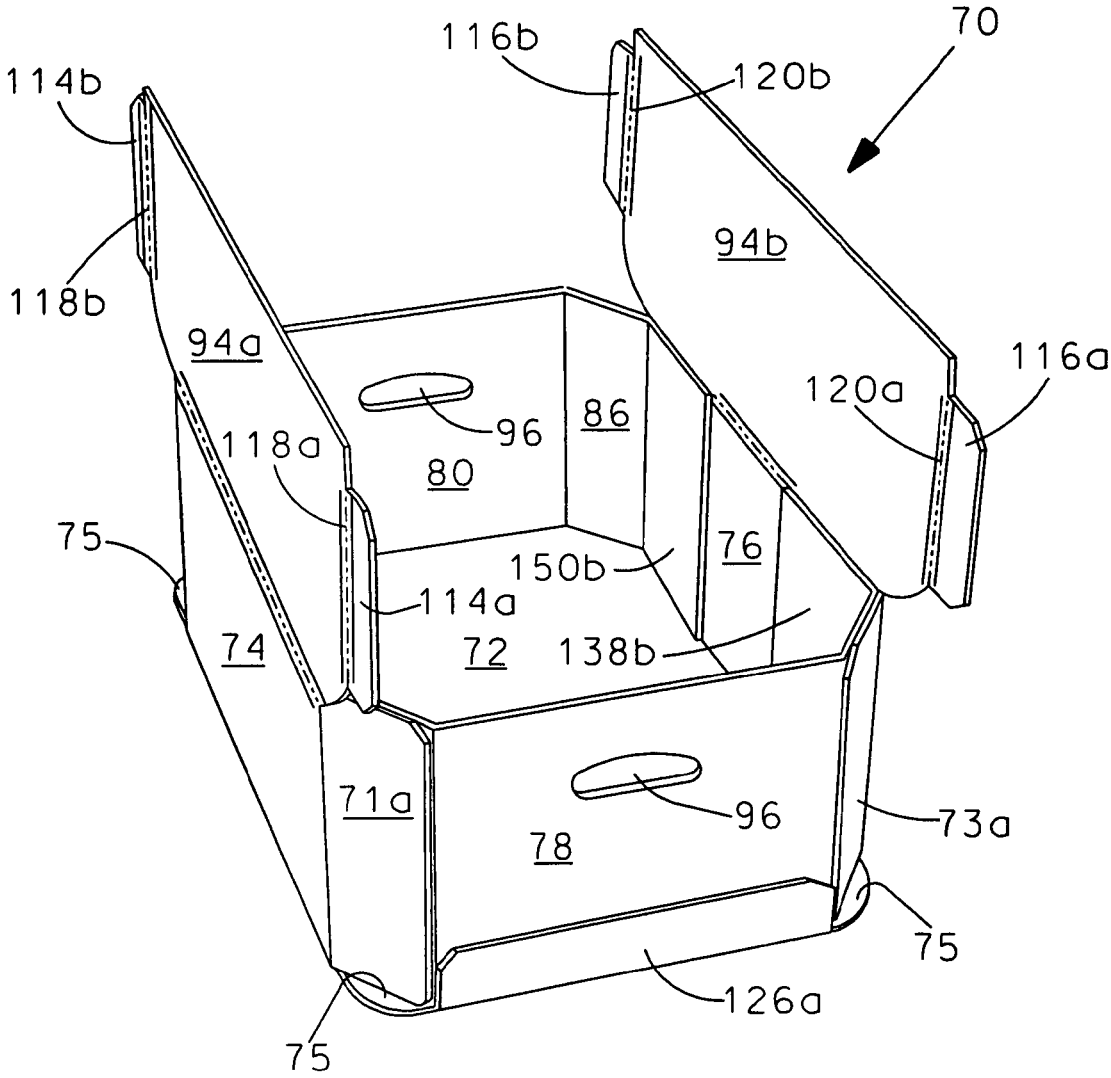
FIG. 9 is a perspective view of the fully constructed three-piece multi-sided container depicted in FIG. 5 showing the wrapper blank folded and glued against the end pieces to form the bottom wall and side walls of the container.

FIG. 9 is a perspective view of the fully constructed three-piece multi-sided container 70 depicted in FIG. 5 showing the wrapper blank 100 folded and glued against the end pieces 132*a*, 132*b* to form the bottom wall 72 and side walls 74, 76 of the container 70. The respective side wall forming panels 74 and 76 are folded at 90 degrees with respect to the panel 72' along the fold lines 102, 104 and configured to be attached with the respective partial sidewall panels 52*a*, 52*b* and 54*a*, 54*b* so that the respective side wall forming panels 14' and 16' and the respective partial sidewall 138*a*, 138*b* and 150*a*, 150*b* are glued to one another. Next, the respective top wall panels 94*a*', 94*b*' are folded along respective fold lines 112, 110 to form top wall 94*a*, 94*b* as depicted in FIG. 4. The respective flaps 114*a*, 114*b*, 116*a*, 116*b* are folded along the respective fold lines 118*a*, 118*b*, 120*a*, 120*b* and tucked inside the container 70. Then the flaps 126*a*, 126*b* are glued to the respective end walls 78, 80.

Figure 10:
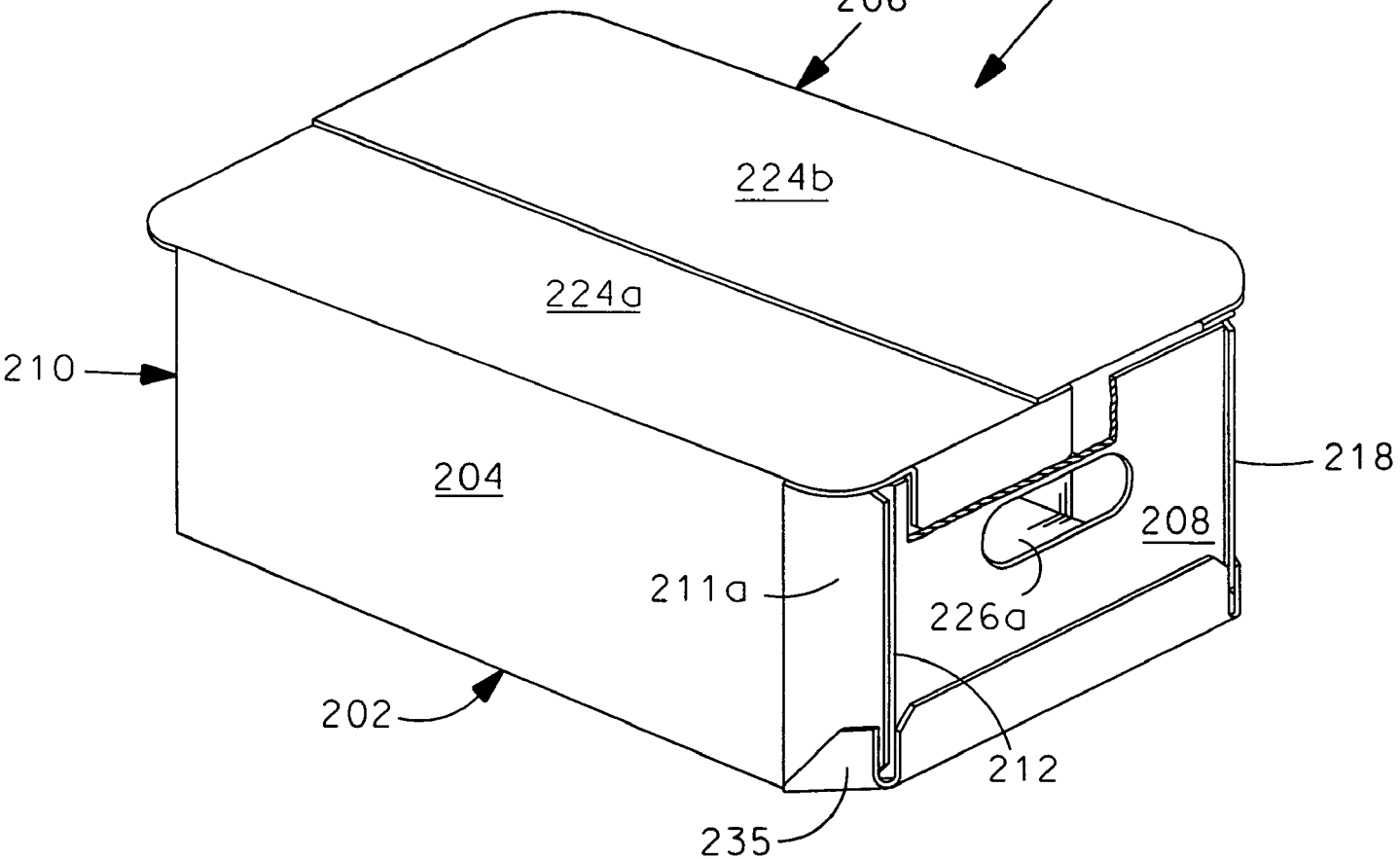
FIG. 10 is a top perspective view of a three piece multi-sided container in accordance with a third embodiment of the invention.

FIG. 10 is a top perspective view of a multi-sided container 200 in accordance with a third embodiment of the invention. The multi-sided container 200 comprises a bottom wall 202, opposite parallel side walls 204, 206, opposite parallel end walls 208, 210 and diagonal corner panels 212, 214, 216 and 218 (FIG. 13) connecting the respective side walls 204, 206 and respective end walls 208, 210 at adjacent ends. The diagonal corner walls 212, 214, 216 and 218 extend at an angle generally 38 degrees with respect to the longitudinal axis of the container 200. Each of the side walls 204, 206 includes a respective pair of reinforcement flaps 211*a*, 211*b* and 213*a*, 213*b* that are defined by respective fold lines 220*a*, 220*b*, 222*a*, 222*b*.The respective pair of reinforcement flaps 211*a*, 211*b* and 213*a*, 213*b* of the opposite width of the respective side walls 204 and 206 is such that they project at their opposite side edges over the entire surface of the diagonal corner walls 212, 214, 216 and 218, terminating their edges at the respective edges of the diagonal corner walls 212, 214, 216 and 218. Two top walls 224*a*, 224*b* are generally defined as the top wall that encloses the container 200. The top wall 224*a* is integrally attached to the side wall 204 and the top wall 224*b* is integrally attached to the side wall 206, but one ordinary skill in the art would appreciate that it is within the scope of the present invention to use a single cover integrally attached to one of the side walls 204, 206 or end walls 208, 210 of the container 200. Alternatively, the top walls 224*a*, 224*b* may detachably cover the container 200. Two hand hole openings 226 are formed on the respective end walls 208, 210 to facilitate handling of the container 200.

Figure 11:
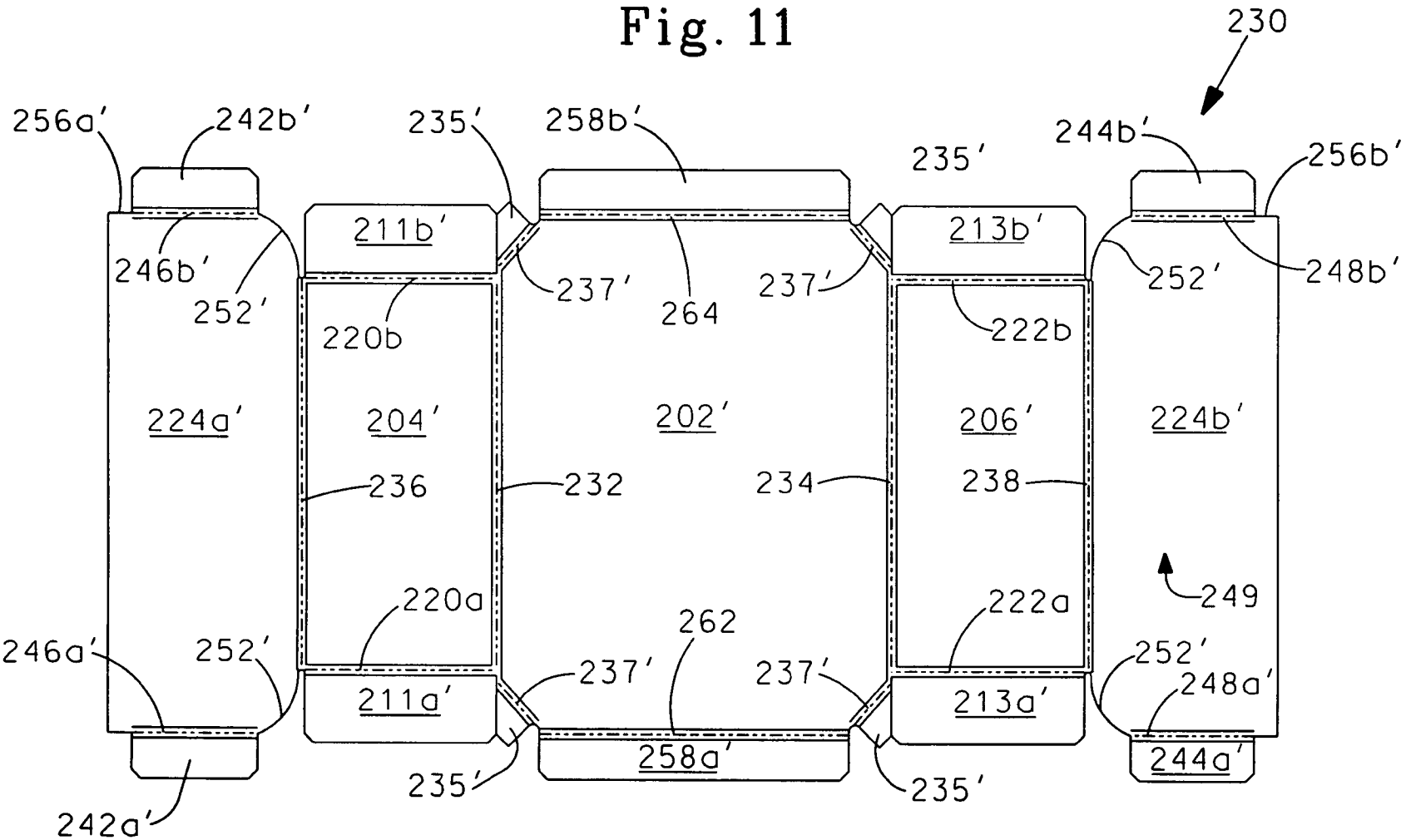
FIG. 11 is a plan view of a wrapper blank that forms the bottom wall, top and side walls of the three-piece multi-sided container depicted in FIG. 10.

FIG. 11 is a plan view of a wrapper blank 230 that forms the bottom wall 202', top walls 224*a*', 224*b*' and side walls 204*a*', 206*b*', of the three-piece container 200 depicted in FIG. 10 in accordance with the third embodiment of the invention. The wrapper blank 230 comprises a centrally located rectangular panel 202' that forms the bottom wall 202. The rectangular panel 202' has an advantage of having four identical tapered corners 235' which enhances the integrity of the container 200 when the wrapper blank 230 is folded. The respective tapered corners 235' fold over respective diagonal walls when the blank 230 is constructed. The side wall forming panels 204' and 206' are foldably joined to opposite side edges of the panel 202' by respective fold lines 232, 234. Each of the side wall panels 204', 206' includes two respective identical reinforcement flaps 211*a*', 211*b*' and 213*a*', 213*b*' defined by respective fold lines 220*a*', 220*b*', and 222*a*', 222*b*'. Top wall panels 224*a*' and 224*b*' are foldably joined to respective longitudinal edges of the sidewall panels 204' and 206', opposite of their folded connection to the panel 202', by fold lines 236, 238. Each of the top wall panels 224*a*', 224*b*' includes two respective identical flaps 242*a*', 242*b*' and 244*a*', 244*b*' defined by respective fold lines 246*a*', 246*b*', and 248*a*', 248*b*'. An Arrow mark 249 indicates the direction of corrugation of the wrapper blank 100. Similarly, each of the top wall panels 224*a*', 224*b*' has an advantage of having two identical rounded corners 252' which enhances the integrity of the container 200 when the wrapper blank 230 is folded. In addition, it should be noted that flaps 242*a*', 242*b*' and 244*a*', 244*b*' do not extend the full width of the top wall panels 224*a*', 224*b*', but terminate short of the outer free edge thereof, defining projecting tabs 256*a*' and 256*b*'. A pair of flaps 258*a*', 258*b*' is foldably joined to respective transverse edges of the panel 202' by fold lines 262, 264. The flaps 258*a*', 258*b*' are essentially identical to one another and they are mirror images of one another. The respective flaps 258*a*', 258*b*' are glued to the respective end walls 208, 210 when the wrapper blank 230 is folded to form the bottom wall 202, side walls 204, 206, and top walls 224*a* and 224*b*.

Figure 12:
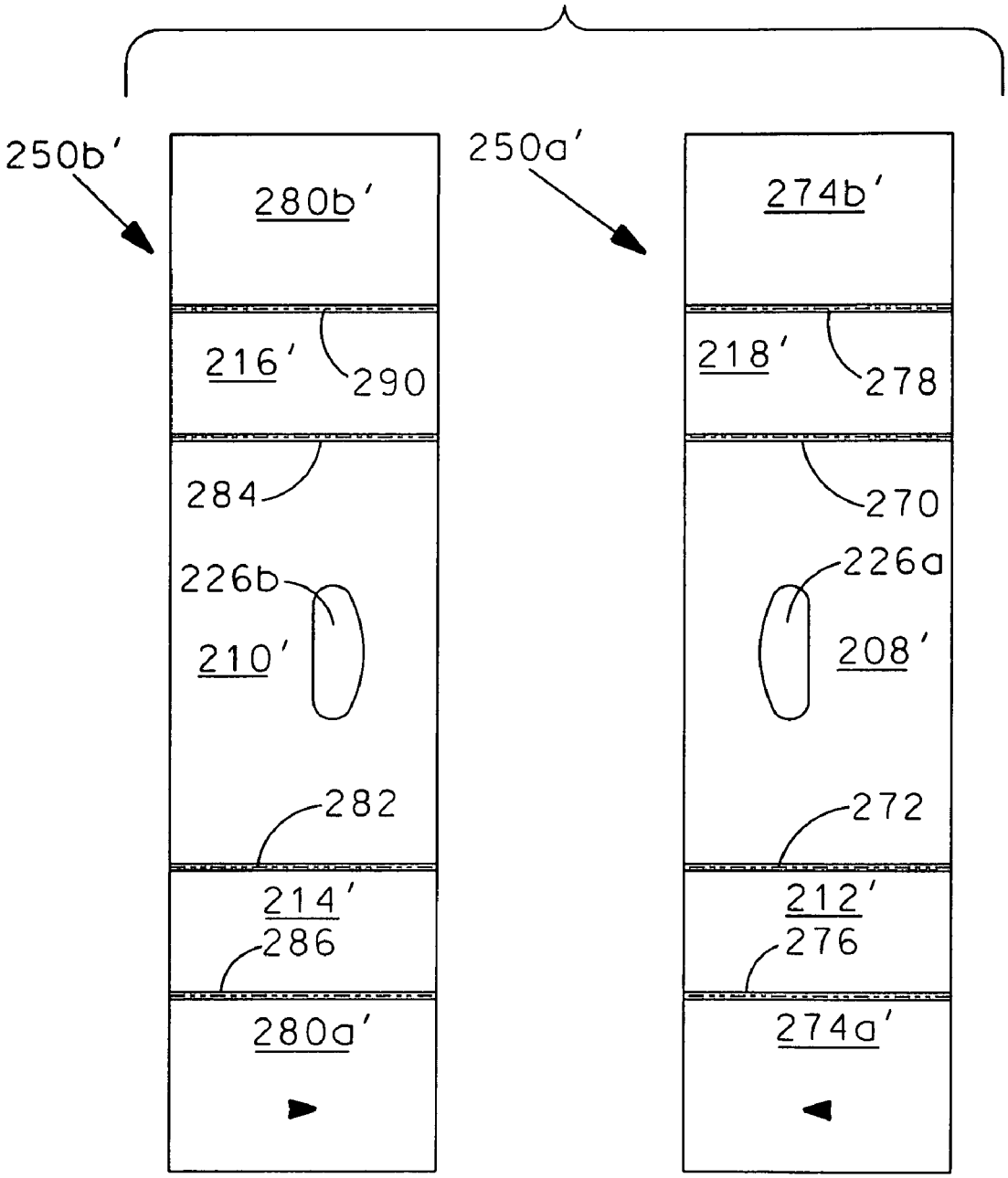
FIG. 12 is a plan view of a pair of blanks that form the end pieces used to construct the three-piece multi-sided container depicted in FIG. 10.

FIG. 12 is a plan view of a pair of end pieces 250*a*', 250*b*' that forms the end walls 208, 210 used to construct the three-piece container 200 as depicted in FIG. 10. The pair of end pieces 250*a*', 250*b*' is attached to respective transverse edges of the panel 202'. The end pieces 250*a*', 250*b*' are essentially identical to one another and they are mirror images of one another. The end piece 250*a*' includes an end wall panel 208', two relatively narrow reinforcing corner panels 212' and 218' foldably joined to opposite ends of the panel 208' by fold lines 270, 272, and second partial sidewall panels 274*a*', 274*b*' are foldably joined to outer edges of respective narrow reinforcing corner panels 212' and 218' by fold lines 276 and 278. Similarly, The end piece 250*b*' includes an end wall panel 210', two relatively narrow reinforcing corner panels 214' and 216' foldably joined to opposite ends of the panel 210' by fold lines 282, 284, and second partial sidewall panels 280*a*', 280*b*' are foldably joined to outer edges of respective narrow reinforcing corner panels 214' and 216' by fold lines 286 and 290. Openings 226*a*', 226*b*' are formed on the respective end wall panels 208', 210' so that when the end pieces 250*a*', 250*b*' are folded, these openings 226*a*', 226*b*' forms the hand hole openings 226*a*, 226*b* in the container 200 as described with reference to FIG. 10.

Figure 13:
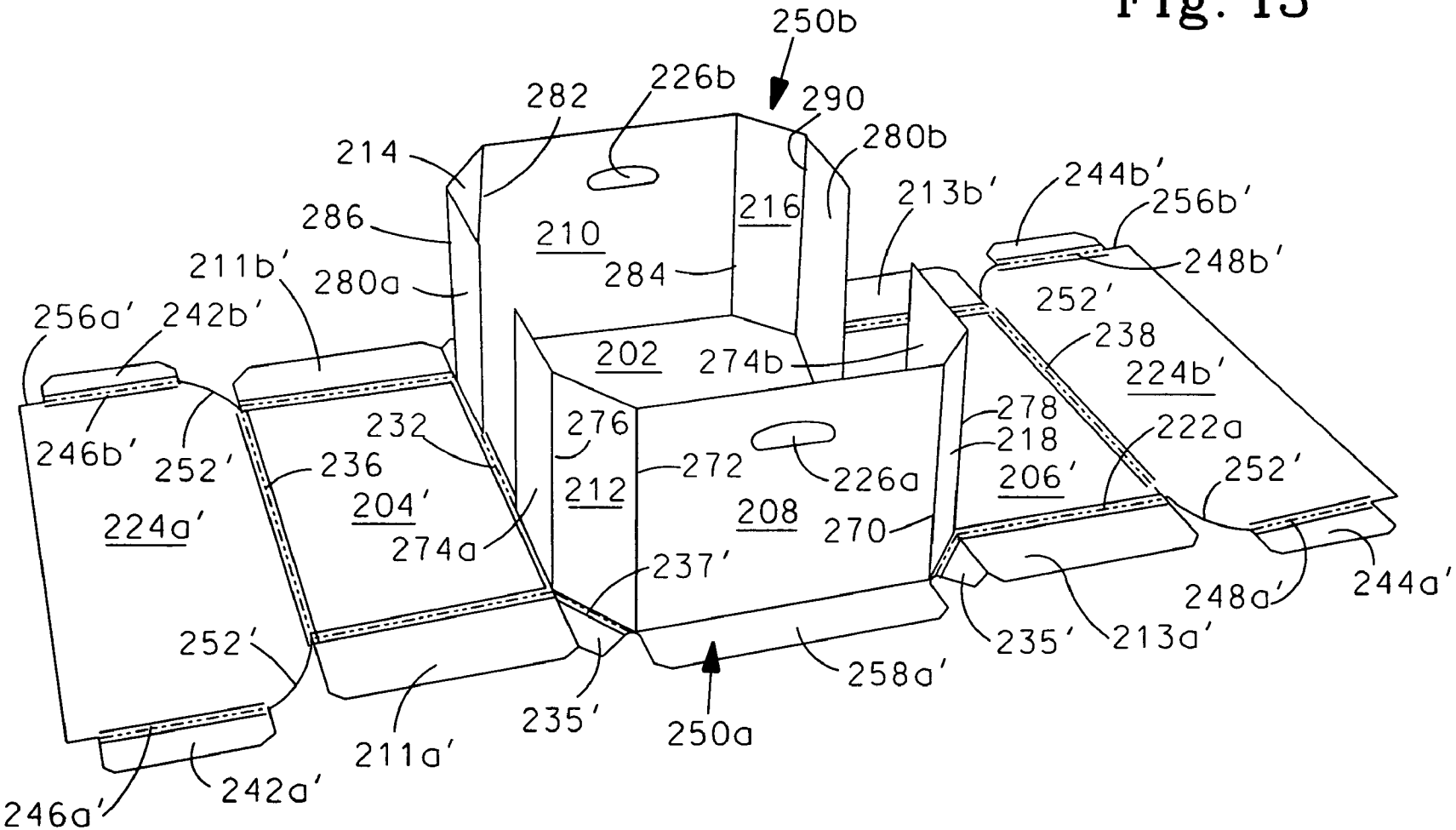
FIG. 13 is a top perspective view of the end walls located in their operative positions on the wrapper blank shown in FIG. 11 and illustrating the wrapper blank in the folding position around the end walls.

FIG. 13 is a top perspective view of the end pieces 250*a*, 250*b* located in their operative positions on the wrapper blank 230 shown in FIG. 11 and illustrating the wrapper blank 230 in the folding position around the end pieces 250*a*, 250*b*.The end pieces 250*a*, 250*b* are folded along their respective fold lines 270, 272, 282, and 284. The respective relatively narrow reinforcing corner panels 212', 214' and 216', 218' are folded inwardly toward the bottom panel 202' at proximately 45° degrees so that the respective corner flaps 235' glued to the respective reinforcing corner panels 212', 214' and 216', 218' to enhance the integrity of the container 200. Then, partial sidewall panels 274*a*', 274*b*', 280*a*', 280*b*' are folded with respect to fold lines 276, 278, 286, and 290 in a manner such that the bottom edges of the partial sidewall panels 274*a*', 274*b*', 280*a*', 280*b*' are respectively coincided with the fold line 232 and 234.

Figure 14:
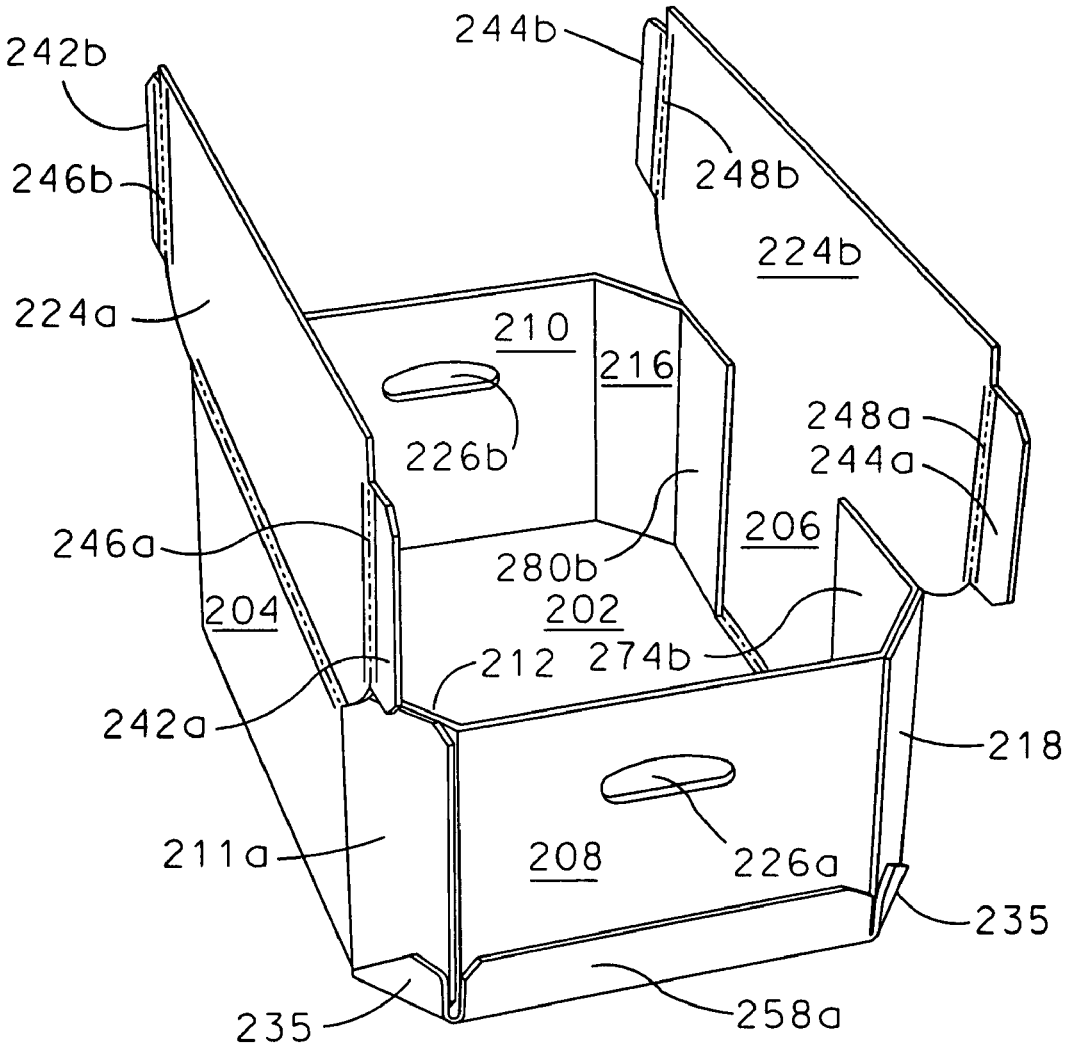
FIG. 14 is a perspective view of the fully constructed three-piece multi-sided container depicted in FIG. 10 showing the wrapper blank folded and glued against the end walls to form the bottom wall and the side walls of the multi-sided container.

FIG. 14 is a perspective view of the fully constructed three-piece multi-sided container 200 depicted in FIG. 10 showing the wrapper blank 230 folded and glued against the end walls 208, 210 and partial side panels 274*a*', 274*b*', 280*a*', 280*b*' to form the bottom wall 202 and the side walls 204, 206 of the container 200. The respective side wall forming panels 204' and 206' are folded at 90 degrees with respect to the panel 202' along the fold lines 232, 234 and configured to be attached with the respective partial sidewall panels 274*a*', 274*b*', 280*a*', 280*b*' so that the respective side wall forming panels 204' and 206' and the respective partial sidewall 274*a*, 274*b*, 280*a*, 280*b* are glued to one another. Next, the respective top wall panels 224*a*', 224*b*' are folded along respective fold lines 236, 238 to form top wall 224*a*, 224*b* as depicted in FIG. 14. The respective flaps 242*a*, 242*b*, 244*a*, 244*b* are folded along the respective fold lines 246*a*, 246*b*, 248*a*, 248*b* and tucked inside the container 200. Then the flaps 258*a*, 258*b* are glued to the respective end walls 208,210.

Figure 15:
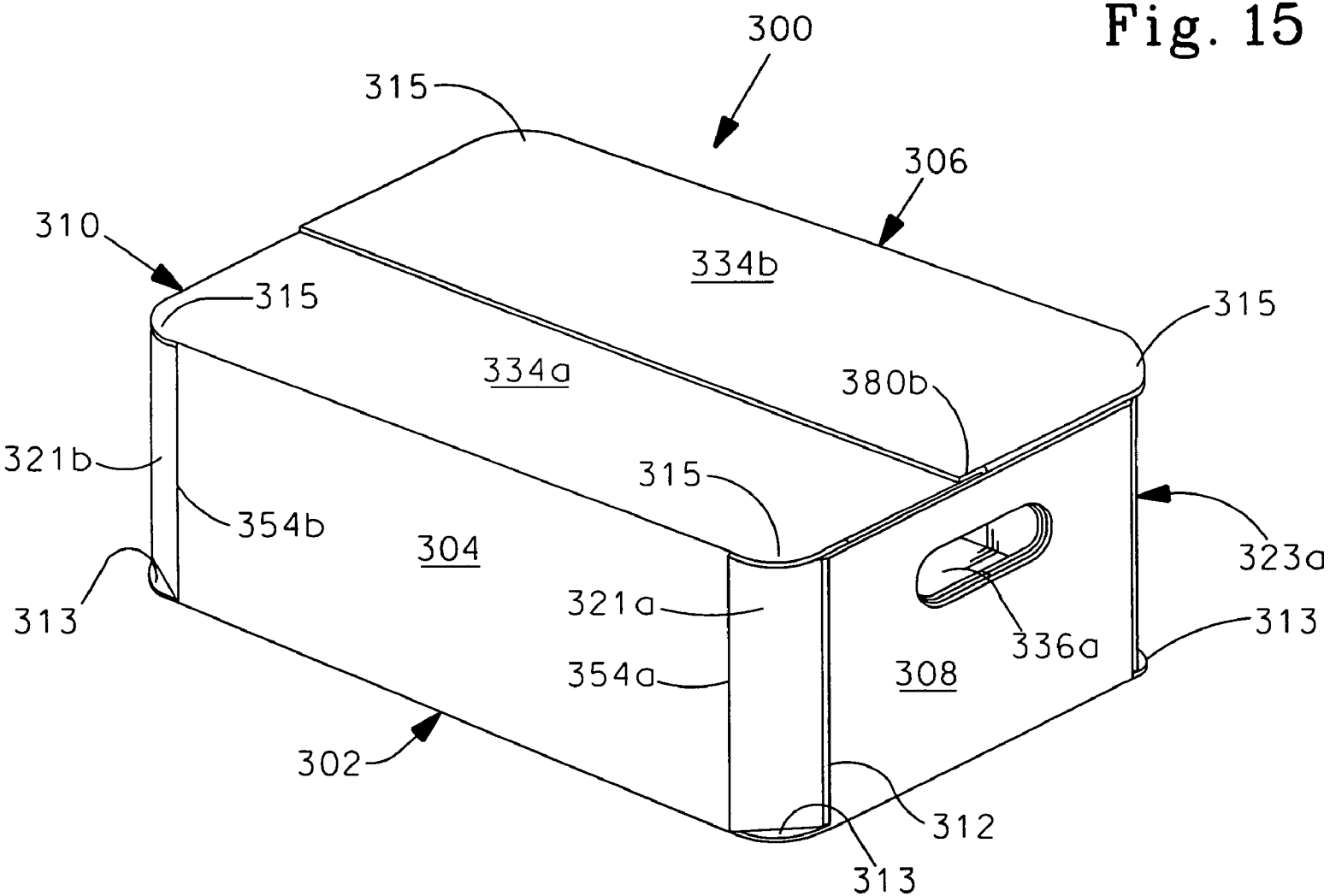
FIG. 15 is a top perspective view of a three-piece multi-sided container in accordance with a fourth embodiment of the invention.

FIG. 15 is a top perspective view of a multi-sided container 300 in accordance with a fourth embodiment of the invention. The multi-sided container 300 comprises a bottom wall 302, opposite parallel side walls 304, 306, opposite parallel end walls 308, 310 and diagonal corner panels 312, 314, 316 and 318 (FIG. 19) connecting the respective side walls 304, 306 and respective end walls 308, 310 at adjacent ends. The diagonal corner walls 312, 314, 316 and 318 extend at an angle generally 38 degrees with respect to the longitudinal axis of the container 300. Each of the side walls 304, 306 includes a respective pair of reinforcement flaps 321*a*, 321*b* and 323*a*, 323*b* that are defined by respective fold lines 354*a*', 354*b*', 356*a*', 356*b*'. The respective pair of reinforcement flaps 321*a*, 321*b* and 323*a*, 323*b* of the opposite width of the respective side walls 304 and 306 is such that they project at their opposite side edges 321*a*, 321*b* over the diagonal corner walls 322, 324, 326 and 328, terminating at their edges proximately on the edge of the respective diagonal corner walls 322, 324, 326 and 328. Two top walls 334*a*, 334*b* are generally defined as top wall that encloses the container 300. The top wall 334*a* is integrally attached to the side wall 314 and the top wall 334*b* is integrally attached to the side wall 316, but one ordinary skill in the art would appreciate that it is within the scope of the present invention to use a single cover or top wall integrally attached to one of the side walls or end walls of the container. Alternatively, the top walls 334*a*, 334*b* may detachably cover the container 300. Two hand hole openings 336*a*, 336*b* are formed on the respective end walls 308, 310 to facilitate handling of the container 300.

Figure 16:
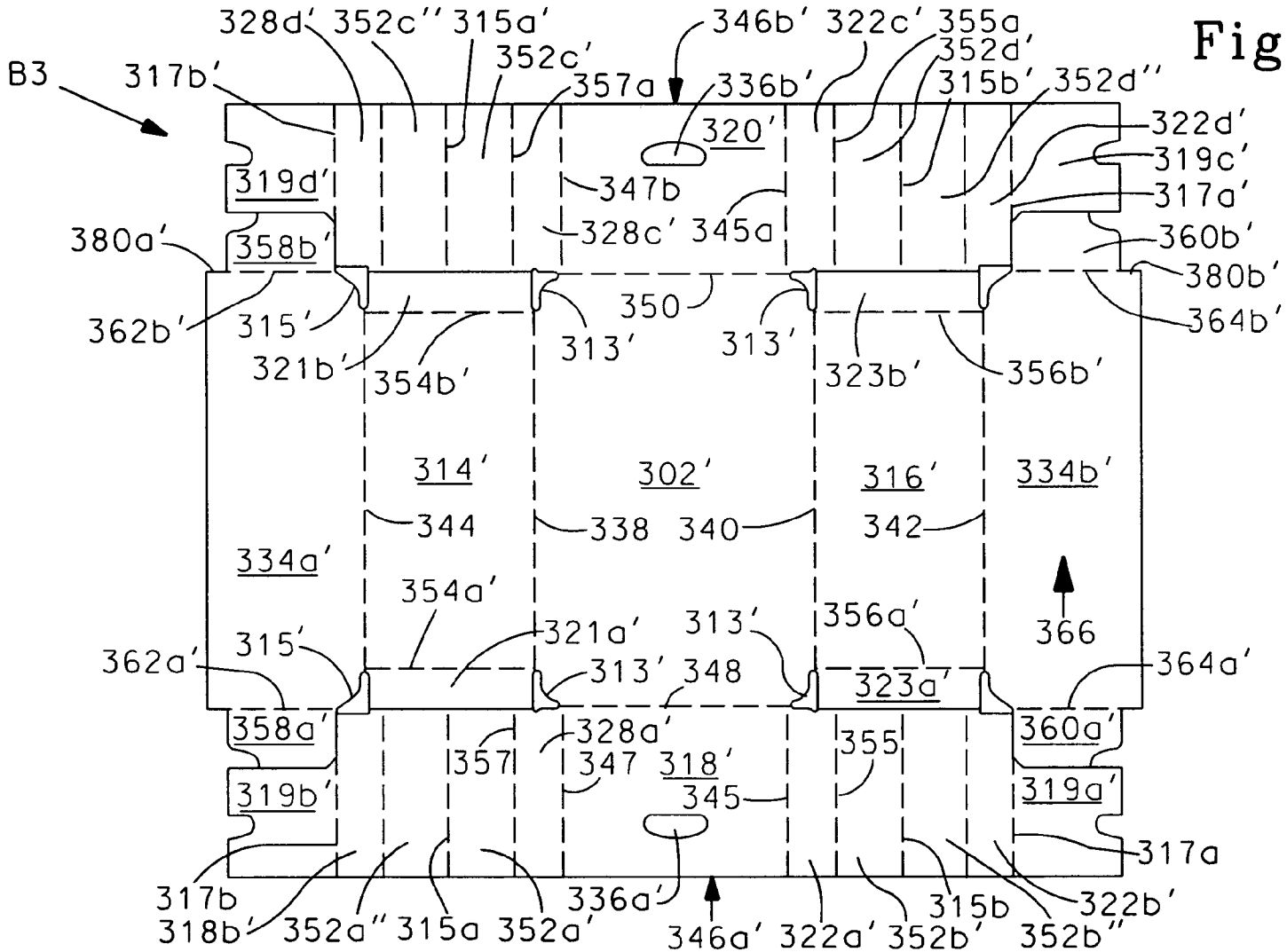
FIG. 16 is a plan view of a unitary blank B3 used to form the three piece multi-sided container shown in FIG. 15 in accordance with a fourth embodiment of the invention.
Figure 19:
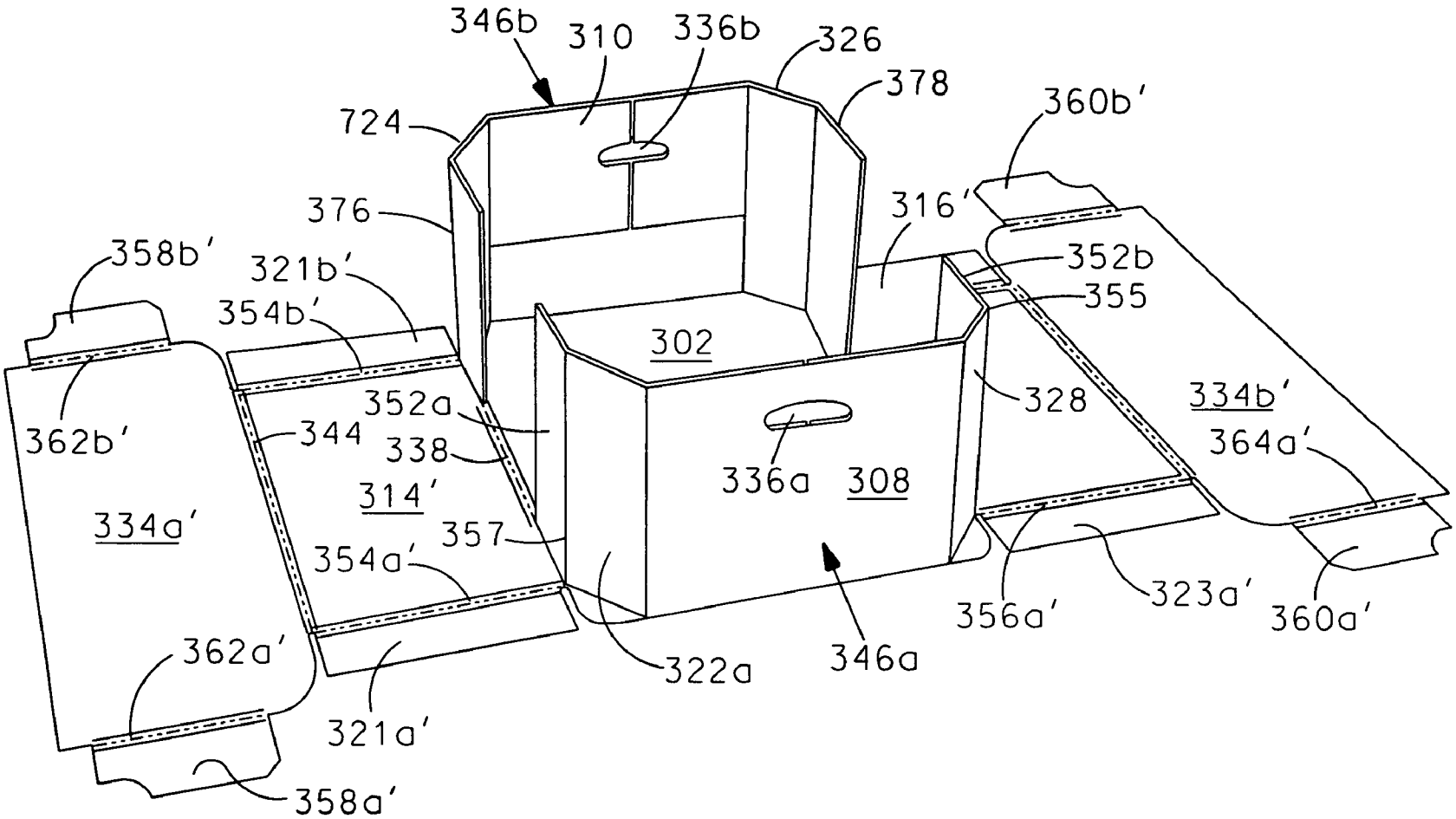
FIG. 19 is similar to FIG. 18, showing the unitary blank B3 in a partially folded position by illustrating a portion of the unitary blank B3 formed into the end walls of the three piece multi-sided container depicted in FIG. 15.

FIG. 16 is a plan view of a unitary blank B3 used to form the container 300 shown in FIG. 15 in accordance with a fourth embodiment of the invention. The blank B3 comprises a centrally located rectangular panel 302' that forms the bottom wall 302 (FIG. 19). The rectangular panel 302' has an advantage of having four identical rounded corners 313' which enhances the integrity of the container 300' when the blank B3 is formed into container 300 (FIG. 15). Side wall forming panels 314' and 316' are foldably joined to opposite side edges of the bottom panel 302' by respective fold lines 338, 340. Each of the side wall panels 314', 316' includes two respective identical reinforcement flaps 321*a*', 321*b*' and 323*a*', 323*b*' defined by respective fold lines 354*a*', 354*b*', and 356*a*', 356*b*'. Top wall panels 334*a*' and 334*b*' are foldably joined to respective longitudinal edges of the sidewall panels 314' and 316', opposite of their folded connection to the bottom panel 302', by fold lines 342, 344. Each of the top wall panels 334*a*', 334*b*' includes two respective identical flaps 358*a*', 358*b*' and 360*a*', 360*b*' defined by respective fold lines 362*a*', 362*b*', and 364*a*', 364*b*'. An Arrow mark 366 indicates the direction of corrugation of the blank B3. Similarly, each of the top wall panels 334*a*', 334*b*', as noted with respect to the rectangular panel 302', has an advantage of having two identical rounded corners 315' which enhances the integrity of the container 300 when the blank B3 is formed into container 300. In addition, it should be noted that flaps 358*a*', 358*b*' and 360*a*', 360*b*' do not extend the full width of the top wall panels 334*a*', 334*b*', but terminate short of the outer free edge thereof, defining projecting tabs 380*a*' and 380*b*'.

A pair of end pieces 346*a*', 346*b*' is foldably joined to respective transverse edges of the panel 302' by fold lines 348, 350. The end pieces 346*a*', 346*b*' are essentially identical to one another and they are mirror images of one another. The end piece 346*a*' includes an end wall panel 318', four relatively narrow reinforcing corner panels 322*a*', 322*b*' and 328*a*', 328*b*' foldably joined to opposite ends of the panel 318' by fold lines 345, 347, and second partial sidewall panels 352*a*', 352*a*", 352*b*', 352*b*" are foldably joined to outer edges of the end wall panel 318' by fold lines 355 and 357. Respective end wall panels 319*a*', 319*b*' are foldably joined to the end wall panel 318' by fold lines 317*a* and 317*b*.Respective end panels 319*a*', 319*b*', respective reinforcing corner panel 322*b*', 328*a*', and reinforcing corner panels 322*b*', 328*b*' are folded along respective fold lines 315*a* and 315*b*.It should be noted that respective reinforcing corner panel 322*b*', 328*b*' fold 180 degrees onto respective reinforcing corner panel 322*a*', 328*a*' which ultimately provide double wall for the reinforcing corner wall 322*a*, 328*b*.Likewise, respective partial sidewall panels 352*a*", 352*b*" fold 180 degrees onto respective partial sidewall panels 352*a*', 352*b*' which ultimately provide double wall for the respective partial sidewall 352*a*, 352*b*.End panels 319*a*', 319*b*' fold onto the end wall panel 318' and thereby provide a stronger end wall 308 when the blank B3 is in the folded position. The substantially doubled end walls reinforce the hand hole openings 336*a*', 336*b*' so that greater weight may be carried on by the container 300 without tearing the hand hole openings 336*a*', 336*b*' during transportation.

The end piece 346*b* includes an end wall panel 320', four relatively narrow reinforcing corner panels 322*c*', 322*d*' and 328*c*', 328*d*' foldably joined to opposite ends of the panel 320' by fold lines 345*a*, 347*b*, and second partial sidewall panels 352*c*', 352*c*", 352*d*', 352*d*" are foldably joined to outer edges of the end wall panel 320' by fold lines 355*a* and 357*a*.Respective end panels 319*c*', 319*d*' are foldably joined to the end wall panel 320' by respective fold lines 317*a*', 317*b*'. Respective end panels 319*c*', 319*d*', respective reinforcing corner panel 322*c*', 322*d*', and reinforcing corner wall 328*c*', 328*d*' are folded along respective fold lines 315*c*' and 315*d*'. It should be noted that respective reinforcing corner panel 322*d*', 328*d*' fold onto respective reinforcing corner panel 322*c*', 322*d*' which provide double wall for the reinforcing corner wall 322, 328. Likewise, respective partial sidewall panels 352*a*", 352*b*" fold onto respective partial sidewall panels 352*a*', 352*b*' which provide double wall for the respective partial sidewall 352*a*, 352*b*.End panels 319*a*', 319*b*' fold onto the end wall panel 320' and thereby provide a stronger end wall 310 when the blank B3 is in the folded position.

Figure 17:
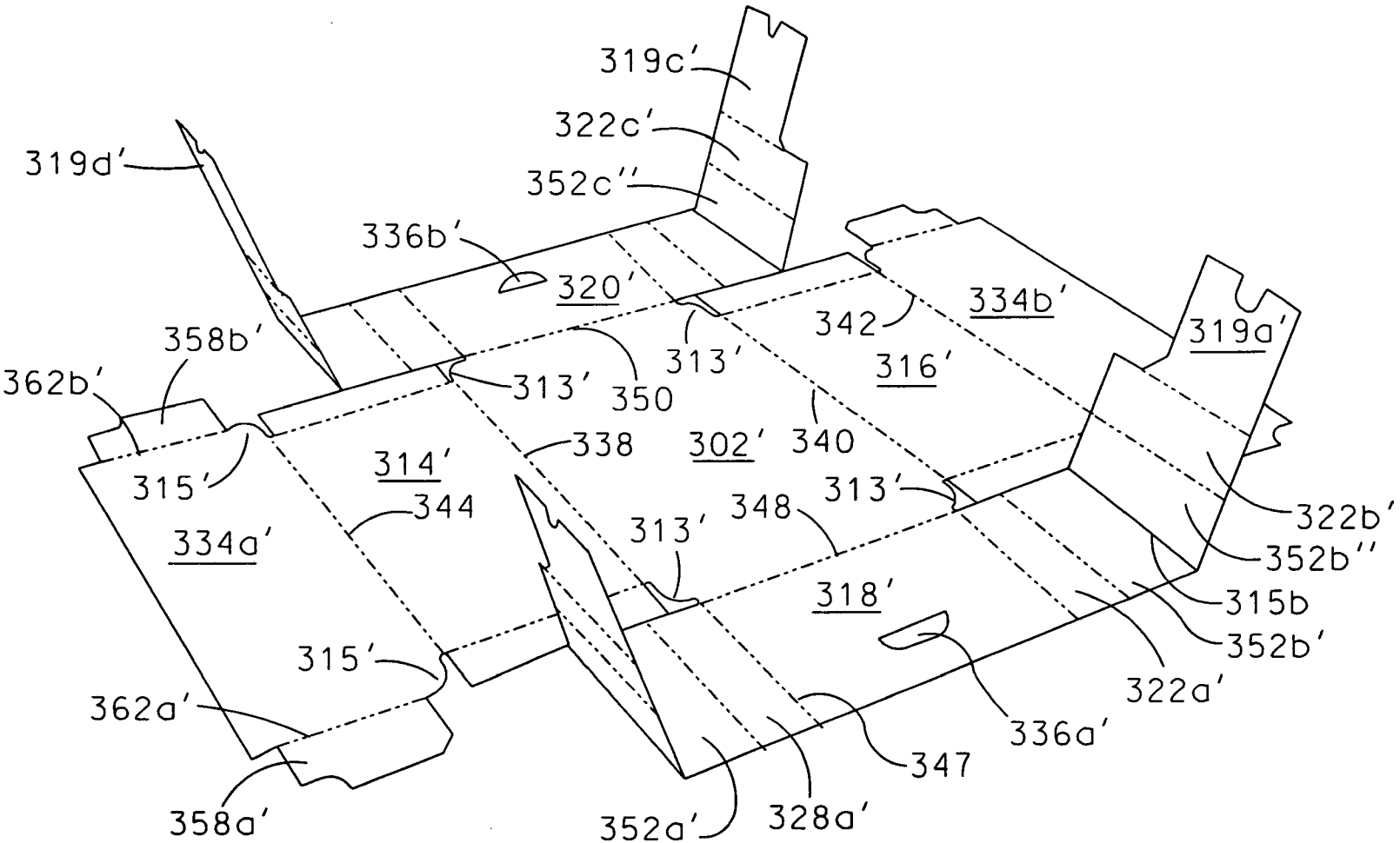
FIG. 17 is similar to FIG. 16 illustrating a portion of end pieces partially folded.
Figure 18:
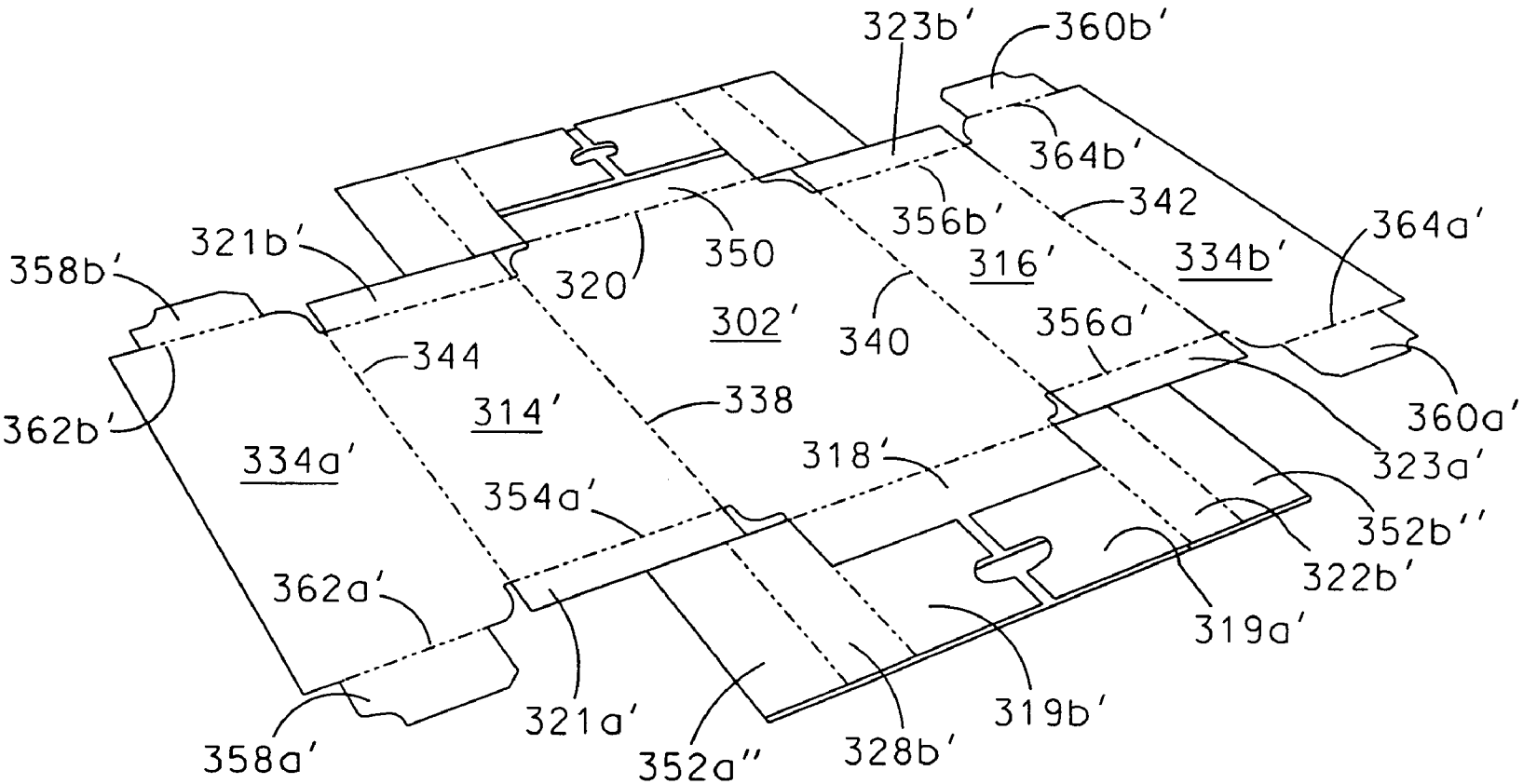
FIG. 18 is similar to FIG. 17 illustrating the end panels are folded onto the end wall panels.

Respective FIGS. 17, 18 are similar to FIG. 16, showing end panels 319*a*', 319*b*', 319*c*', 319*d*', reinforcing corner panels 322*b*', 322*c*', 328*b*', 328*c*' and partial sidewall panels 352*a*", 352*b*", 352*c*", 352*d*" in respective partially folded position and completely folded position with respect to their fold lines so that reinforcing corner panels 322*a*', 328*a*', 322*c*', 328*d*' and the partial sidewall panels 352*a*', 352*b*', 352*c*', 352*d*' are concealed by their respective identical panels as described hereinbefore.

FIG. 19 is similar to FIG. 17, showing the unitary blank B3 in a partially folded position by illustrating a portion of the unitary blank B3 formed into the end walls 308, 310 of the container 300 depicted in FIG. 15. Each of the end pieces 346*a*' and 346*b*' is folded $90^0$ degrees with respect to bottom panel 302' along the fold lines 348 and 350. Then, the respective relatively narrow reinforcing doubled corner panels 322, 324 and 326, 328 are folded inwardly toward the bottom panel 302' at angles from about 33 to about 38 degrees so that each of the rounded corners 313' provides a greater base by increasing surface area for the reinforcing corner panels 322', 324' and 326', 328' to transmit pressure applied at those locations. Then, partial sidewall panels 352*a*', 352*b*', 354*a*', 354*b*' are folded with respect to fold lines 355, 357, 376, and 378 in a manner such that the bottom edges of the partial sidewall panels 352*a*', 352*b*', 354*a*', 354*b*' are respectively coincided with the fold line 338 and 340.

Figure 20:
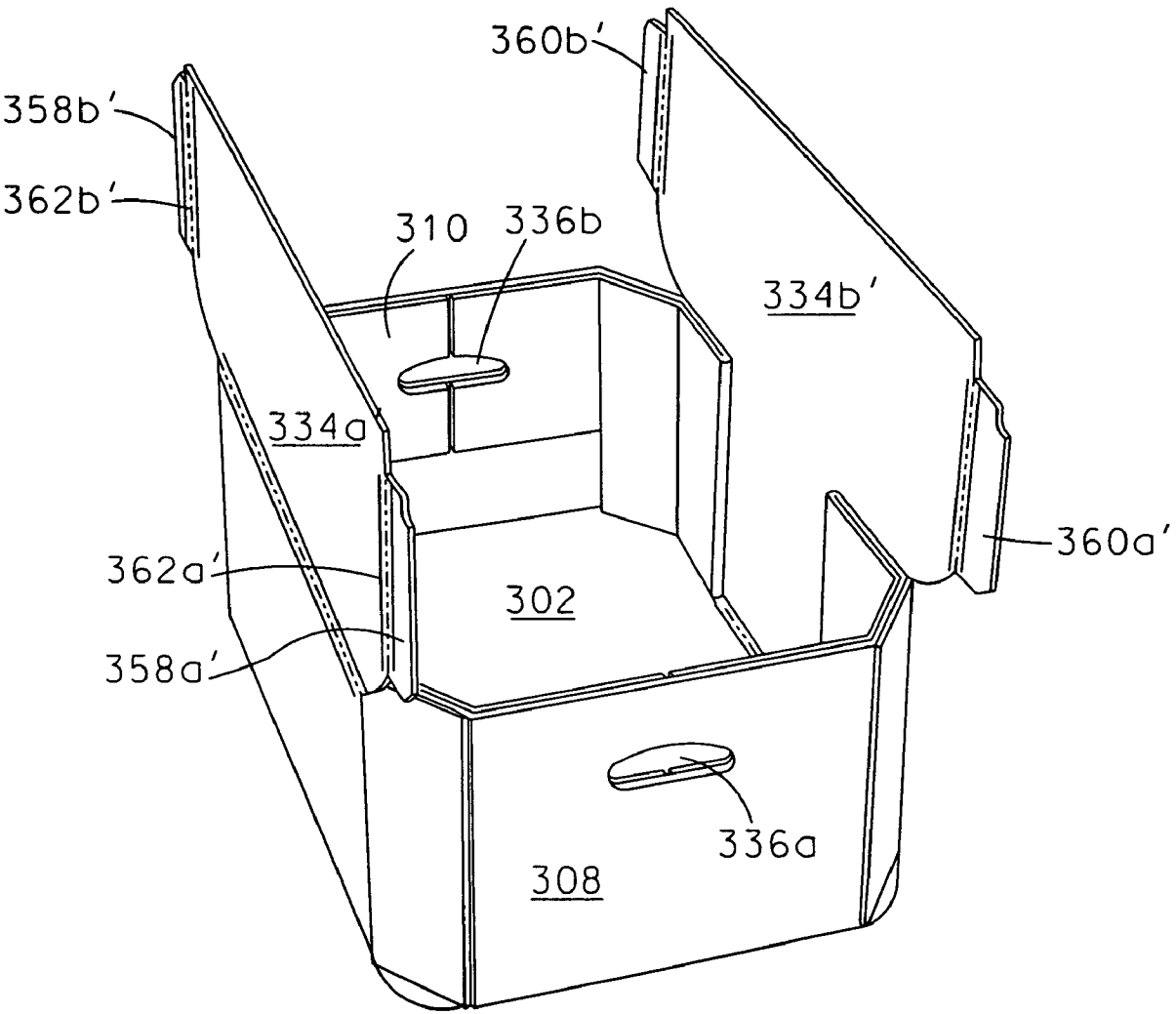
FIG. 20 is a perspective view of the fully constructed three-piece multi-sided container formed from the blank B3 shown in FIG. 16 and illustrating the three-piece container in FIG. 15 in a partially opened position.

FIG. 20 is a perspective view of the fully constructed multi-sided container 10 formed from the blank B3 shown in FIG. 16 and illustrating the container 300 in FIG. 15 in a partially opened position. The respective side wall forming panels 314' and 316' are folded at 90 degrees with respect to the panel 302' along the fold lines 338, 340 and configured to be attached with the respective partial sidewall panels 352*a*, 352*b* and 354*a*, 354*b* so that the respective side wall forming panels 314' and 316' and the respective partial sidewall 352*a*, 352*b* and 354*a*, 354*b* are glued to one another. Next, the respective top wall panels 334*a*', 334*b*' are folded along respective fold lines 342, 344 to form top wall 34*a*, 34*b* as depicted in FIG. 20. The respective flaps 358*a*, 358*b*, 360*a*, 360*b* are folded along the respective fold lines 362*a*, 362*b*', 364*a*', 364*b*' and tucked inside the container 300.

Figure 24:
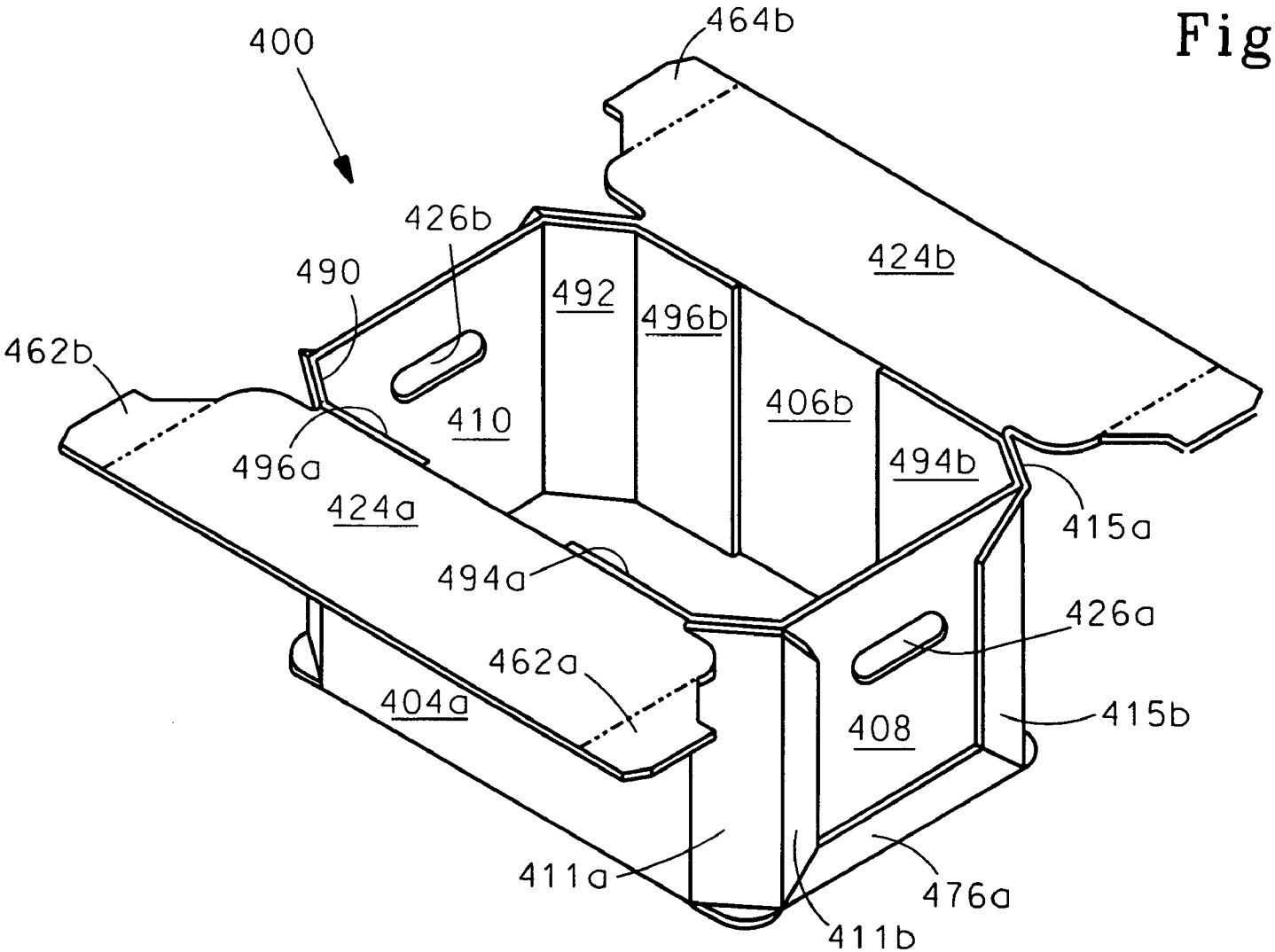
FIG. 24 is a perspective view of the fully constructed three-piece container depicted in FIG. 24 showing the wrapper blank folded and glued against the end pieces to form the bottom wall and side walls of the container.

FIG. 24 is a top perspective view of a container 400 in accordance with a fifth embodiment of the invention. The container 400 comprises a bottom wall 402, opposite parallel side walls 404, 406 opposite parallel end walls 408, 410 and diagonal corner panels 412, 414, 416 and 418 connecting the respective side walls 404, 406 and respective end walls 408, 410 at adjacent ends. The diagonal corner walls 412, 414, 416 and 418 extend at an angle generally ranges from about 33 to 38 degrees with respect to the longitudinal axis of the container 400. Each of the respective diagonal corner walls 412, 414, 416 and 418 is defined by a respective diagonal panel and a reinforcement flap. For example, the diagonal corner wall 412 is defined by a diagonal panel 486' and a reinforcement flap 411*a*' and the diagonal corner wall 414 is defined by diagonal panel 488' and a reinforcement flap 415*a*'. The other two diagonal walls 416 and 418 are the same as diagonal walls 412, 414 except on the opposite side of the container. Each longitudinal end of the respective side walls 404, 406 includes reinforcement flaps 411*a*', 413*a*' and end flaps 411*b*', 413*b*'. For example, each short side of the side wall 404*a*' has respective reinforcement flaps 411*a*', 413*a*' and end flaps 411*b*', 413*b*'. Similarly, short side of the side wall 406*a*' has respective reinforcement flaps 415*a*', 417*a*' and end flaps 415*b*', 417*b*'. The flaps 411*a*', 411*b*' are defined by a fold line 419. The flaps 413*a*, 413*b* are defined by a fold line 421. The flaps 415*a*, 415*b* are defined by a fold line 423. The flaps 417*a*, 417*b* are defined by a fold line 424. The opposite width of the respective side walls 404 and 406 is such that the flaps 411*a*', 415*a*' project beyond the entire surface of the diagonal corner walls 412, 414 terminating their edges at the respective end walls 408, 410. Two top walls 424*a*, 424*b* are generally defined as top wall that encloses the container 400. The top wall 424*a* is integrally attached to the side wall 404 and the top wall 424*b* is integrally attached to the side wall 406, but one ordinary skill in the art would appreciate that it is within the scope of the present invention to use a single cover integrally attached to one of the side walls 404, 406 or end walls 408, 410 of the container 400. Alternatively, the top walls 424*a*, 424*b* may detachably cover the container 400. Two hand hole openings 426*a*, 426*b* are formed on the respective end walls 408, 410 to facilitate handling of the container 400.

Figure 21:
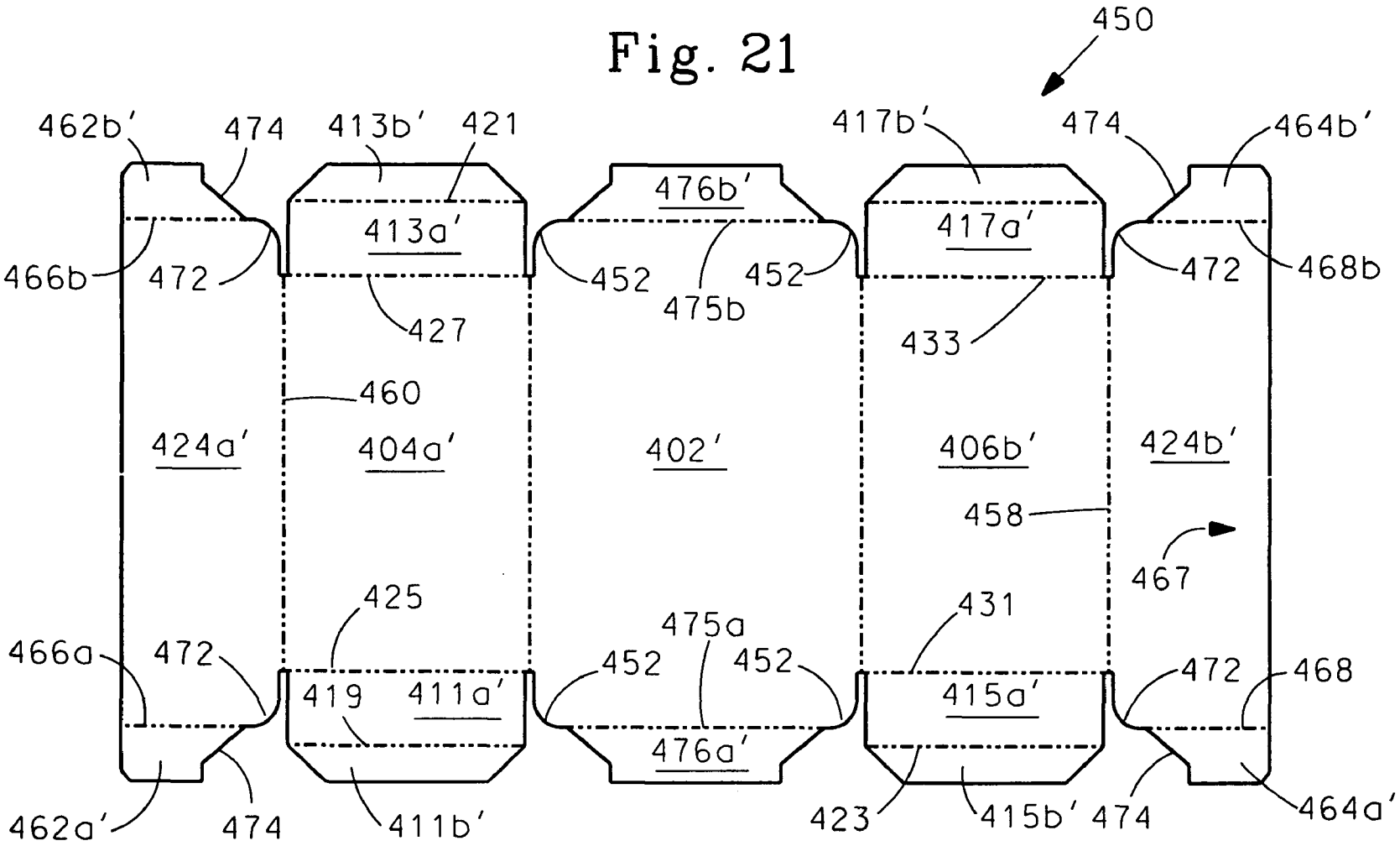
FIG. 21 is a plan view of a wrapper blank that forms the bottom wall, top and side walls of the three-piece container depicted in FIGS. 24 & 25.

FIG. 21 is a plan view of a wrapper blank 450 that forms the bottom wall panel 402, top walls 424*a*, 424*b* and side walls 404*a*, 406*b* of the three-piece container 400 depicted in FIG. 24 in accordance with the fifth embodiment of the invention. The wrapper blank 450 comprises a centrally located rectangular panel 402' that forms the bottom wall 402. The rectangular panel 402' has an advantage of having four identical rounded corners 452 which enhances the integrity of the container 400 when the wrapper blank 450 is folded. Side wall forming panels 404' and 406' are foldably joined to opposite side edges of the panel 402' by respective fold lines 454, 456. Each longitudinal end of the side wall panels 404*a*', 406*b*' includes a respective pair of diagonal panels 411*a*', 413*a*', reinforcement flaps 411*b*', 413*b*' and respective pair of diagonal panels 415*a*', 417*a*', and reinforcement flaps 415*b*', 417*b*'. The diagonal panel 411*a*' and reinforcement flap 411*b*' are defined by respective fold lines 419, 425. The diagonal panel 413*a*' and reinforcement flap 413*b*' are defined by fold lines 421, 427. The diagonal panel 415*a*' and reinforcement flap 415*b*' are defined by fold lines 423, 431. The diagonal panel 417*a*' and reinforcement flap 417*b*' are defined by fold lines 424, 433. Top wall panels 424*a*' and 424*b*' are foldably joined to respective long edges of the sidewall panels 404*a*' and 406*b*', opposite of their folded connection to the panel 402', by fold lines 458, 460. Each of the top wall panels 424*a*', 424*b*' includes two respective identical flaps 462*a*', 462*b*' and 464*a*', 464*b*' defined by respective fold lines 466*a*', 466*b*', and 468*a*', 468*b*'. The two respective identical flaps 462*a*', 462*b*' and 464*a*', 464*b*' are extended from short sides of the top wall panels 424*a*' and 424*b*'. An arrow mark 467 indicates the direction of corrugation of the wrapper blank 100. Similarly, each of the top wall panels 424*a*', 424*b*', as noted with respect to the rectangular panel 402', has an advantage of having two identical rounded corners 472 which enhances the integrity of the container 400 when the wrapper blank 450 is folded. In addition, it should be noted that one side edge 474 of each flaps 462*a*', 462*b*' and 464*a*', 464*b*' is tapered so that when these flaps are folded, the tapered 447 would align the tapered edges of the flaps 411*b*', 413*b*', 415*b*', and 417*b*'. A pair of flaps 476*a*', 476*b*' is foldably joined to respective transverse edges of the panel 402' by fold lines 475*a*', 475*b*'. The flaps 476*a*', 476*b*' are essentially identical to one another and they are mirror images of one another. The respective flaps 476*a*', 476*b*'are glued to the respective end walls 408, 410 when the wrapper blank 450 is folded to form the bottom wall 402, side walls 404, 406, and top walls 424*a* and 424*b*.

Figure 22:
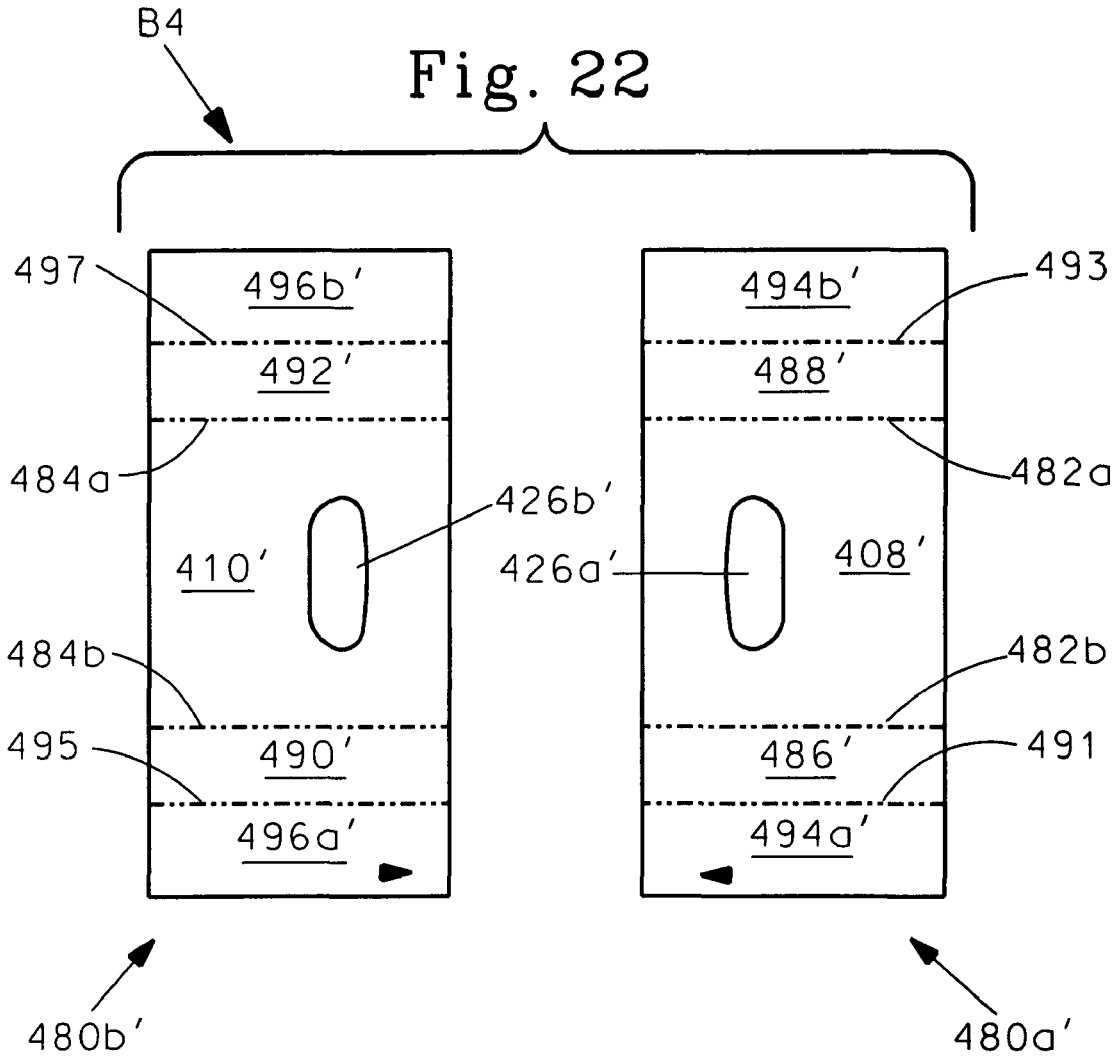
FIG. 22 is a plan view of a pair of blanks B4 that form the end pieces used to construct the three-piece multi-sided container depicted in FIGS. 24 & 25.

FIG. 22 is a plan view of a pair of blank B4 includes blank 480*a*' and blank 480*b*' which each form the end walls 408 and 410 used to construct the three-piece container 400 depicted in FIG. 24. The pair of end pieces 480*a*' and 480*b*' is attached to respective transverse edges of the panel 402'. The end pieces 480*a*' and 480*b*' are essentially identical to one another and they are mirror images of one another. The end piece 480*a*' includes an end wall panel 408', two relatively narrow reinforcing corner panels 486' and 488' foldably joined to opposite ends of the panel 408' by fold lines 482*a*', 482*b*', and second partial sidewall panels 494*a*', 494*b*' are foldably joined to outer edges of respective narrow reinforcing corner panels 486' and 488' by fold lines 491 and 493. Similarly, The end piece 480*b*' includes an end wall panel 410', two relatively narrow reinforcing corner panels 490' and 492' foldably joined to opposite ends of the panel 410' by fold lines 484*a*', 484*b*', and second partial sidewall panels 496*a*', 496*b*' are foldably joined to outer edges of respective narrow reinforcing corner panels 490' and 492' by fold lines 495 and 497. Openings 462*a*', 462*b*' are formed on the respective end wall panels 408', 410' so that when the end pieces 480*a*', 480*b*' are folded, these openings 426*a*', 426*b*' forms the hand hole openings 462*a*, 462*b* in the container 400 as described with reference to FIG. 24.

Figure 23:
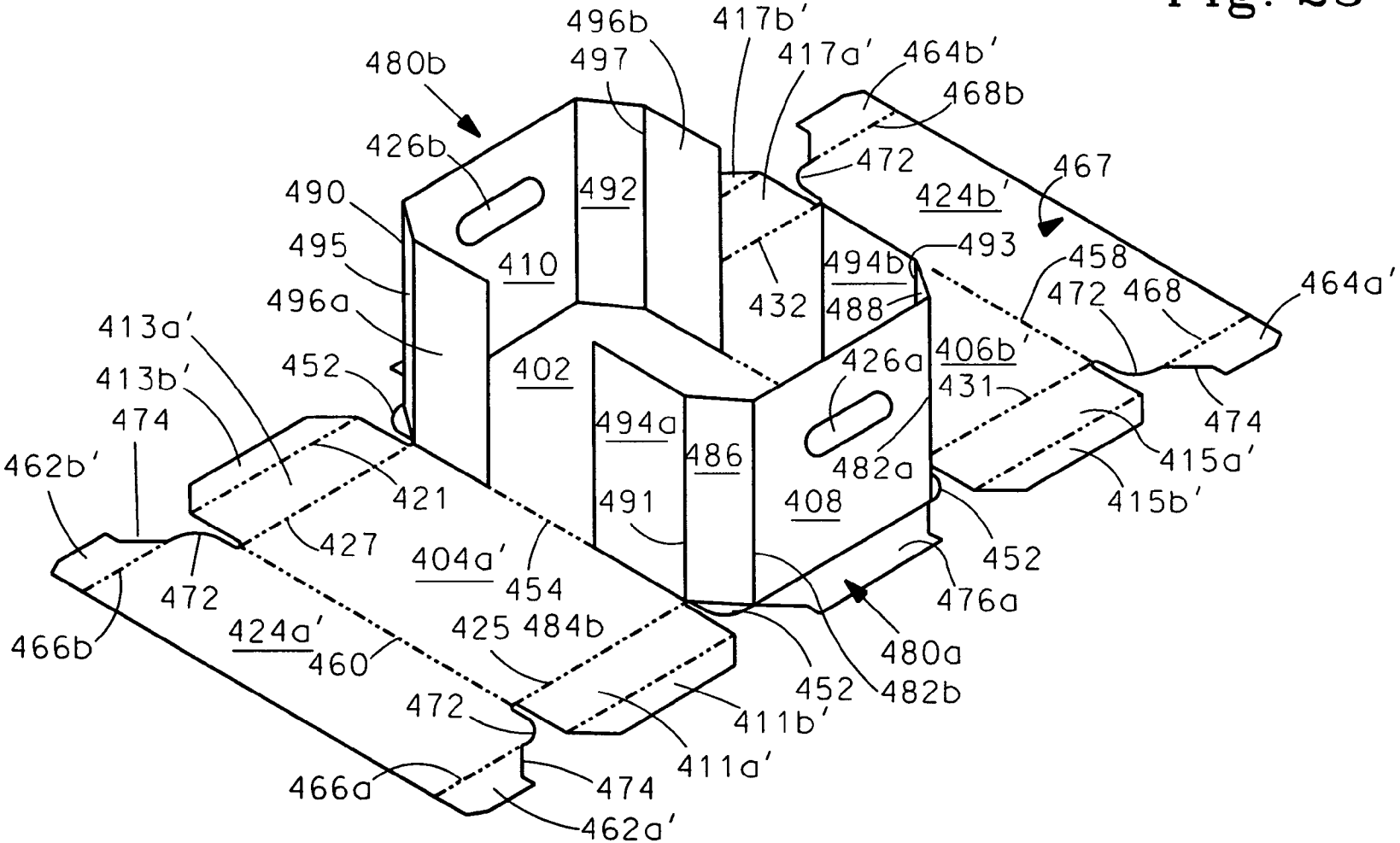
FIG. 23 is a top perspective view of the end pieces located in their operative positions on the wrapper blank shown in FIG. 22, and illustrating the wrapper blank in the folding position around the end pieces.

FIG. 23 is a top perspective view of the end pieces 480*a*, 480*b* located in their operative positions on the wrapper blank 450 shown in FIG. 22 and illustrating the wrapper blank 450 in the folding position around the end walls pieces 480*a*, 480*b*.The end pieces 480*a*, 480*b* are folded along their respective fold lines 482*a*, 482*b* and 484*a*, 484*b*.The respective relatively narrow reinforcing corner panels 486, 488 and 490, 492 are folded inwardly toward the bottom panel 402 at approximately 45 degrees so that the rounded corners 452 provides a greater base by increasing surface area for the reinforcing corner panels 486, 488 and 490, 492 to transmit pressure applied at those location. Then, partial sidewall panels 494*a*, 494*b*, 496*a*, 496*b* are folded with respect to fold lines 491, 493, 495, and 497 in a manner such that the bottom edges of the partial sidewall panels 494*a*, 494*b*, 496*a*, 496*b* are respectively coincided with the fold line 454 and 456.

Figure 25:
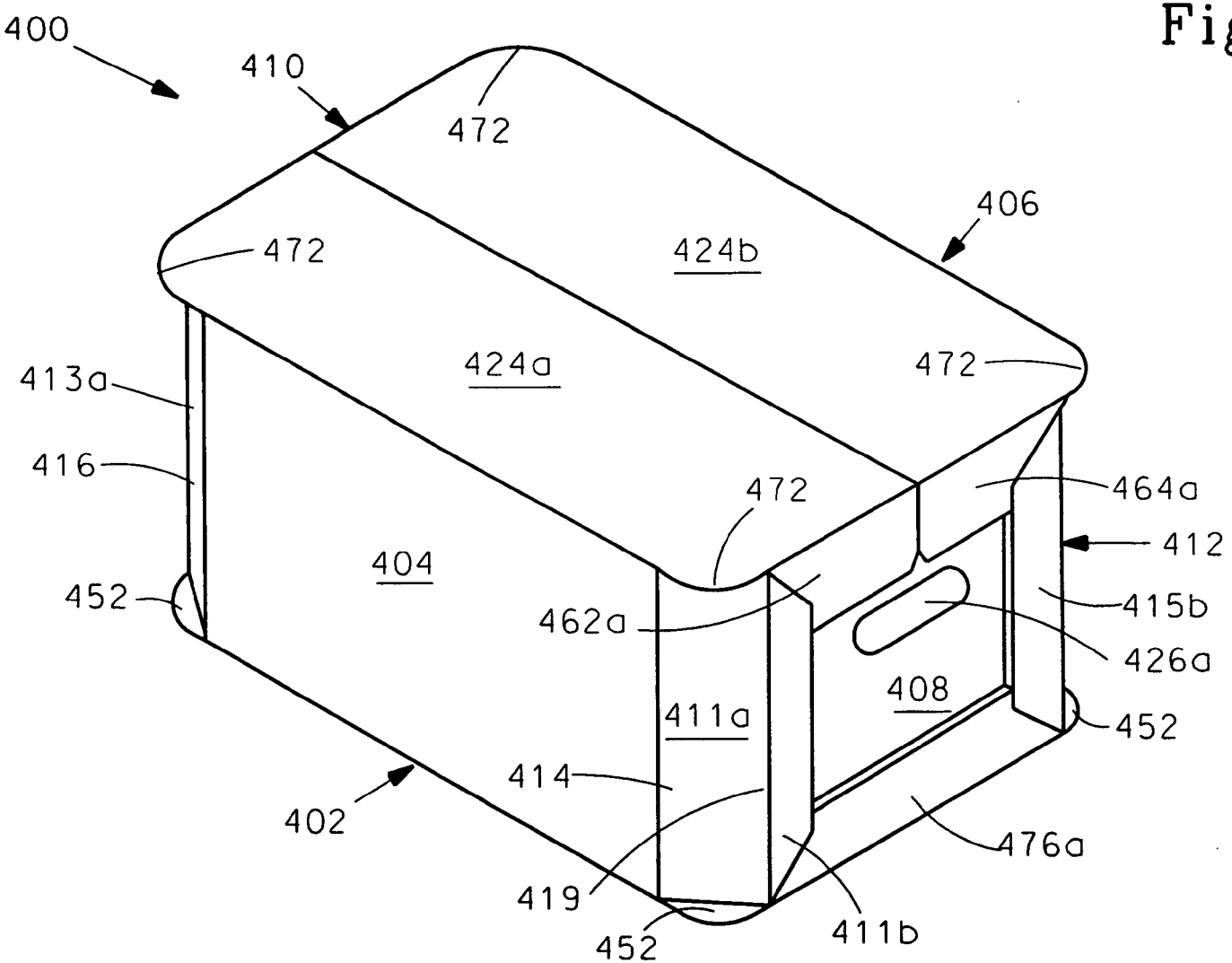
FIG. 25 is a top perspective view of a three pieces multi-sided container in accordance with a fifth embodiment of the invention.

FIG. 25 is a perspective view of the fully constructed three-piece container 400 depicted in FIG. 24 showing the wrapper blank 450 folded and glued against the end pieces 480*a*, 480*b* to form the bottom wall 402 and side walls 404, 406 of the container 400. The respective side wall forming panels 404*a*' and 406*b*' are folded at 90 degrees with respect to the panel 402' along the fold lines 454, 456 and configured to be attached with the respective partial sidewall panels 494*a*, 494*b* and 496*a*, 496*b* so that the respective side wall forming panels 404*a*' and 406*b*' and the respective partial sidewall 494*a*, 494*b* and 496*a*, 496*b* are glued to one another. Next, the respective top wall panels 424*a*', 424*b*' are folded along respective fold lines 458, 460 to form top wall 424*a*, 424*b* as depicted in FIG. 21. The respective flaps 462*a*', 462*b*', 464*a*', 464*b*' are folded along the respective fold lines 466*a*, 466*b*, 468*a*, 468*b* and tucked inside the container 400. Then the flaps 476*a*', 476*b*' are glued to the respective end walls 408, 410.

Figure 27A:
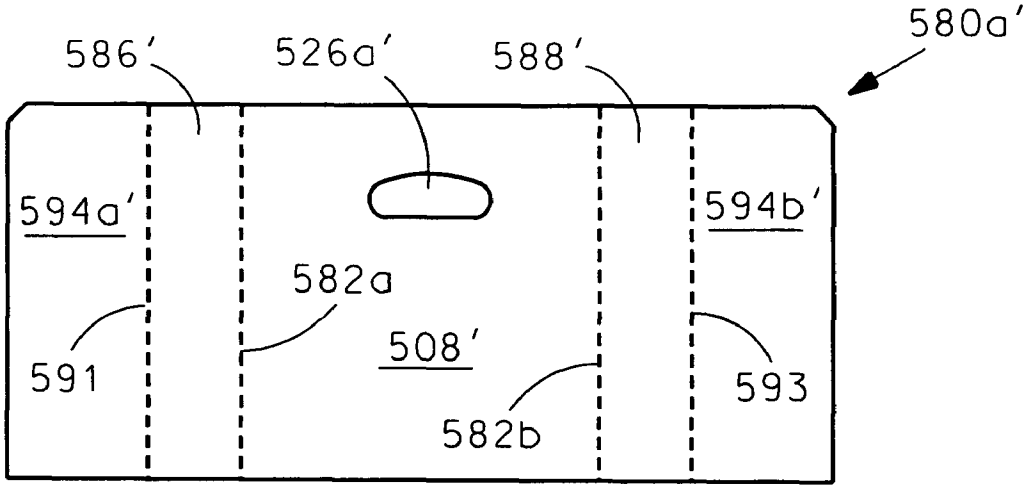
FIGS. 27A-B is a plan view of one of a pair of blanks that form the tray bliss end pieces used to construct the three-piece container depicted in FIG. 25.
Figure 27B:
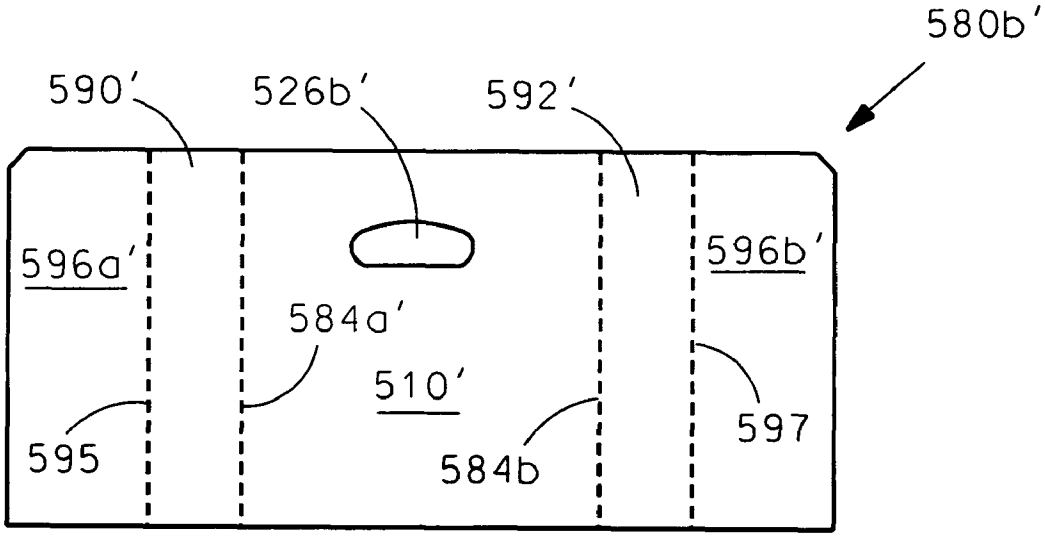
Figure 28:
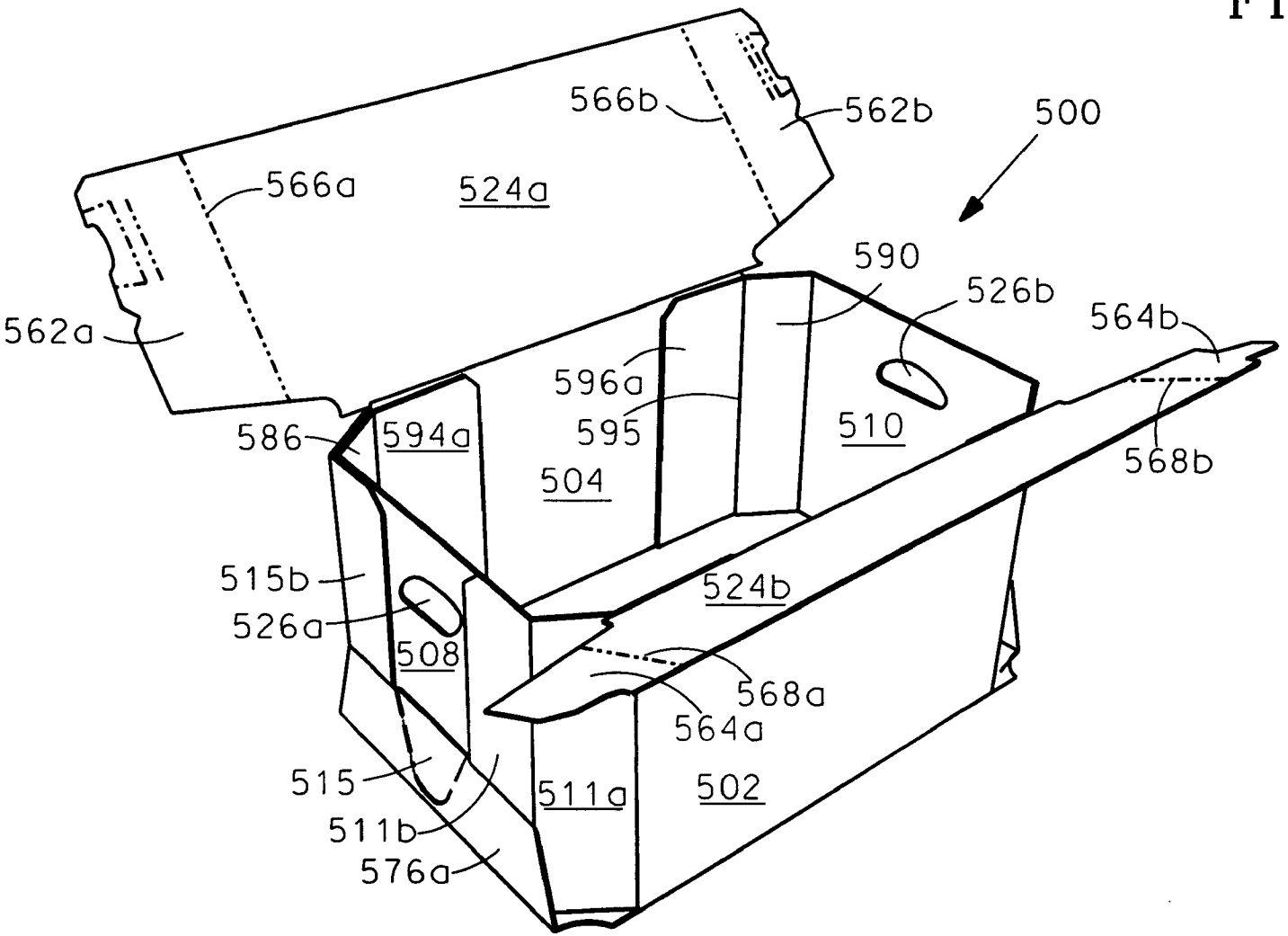
FIG. 28 is a top perspective view of a three pieces multi-sided container in accordance with a six embodiment of the invention in an opened position.
Figure 29:
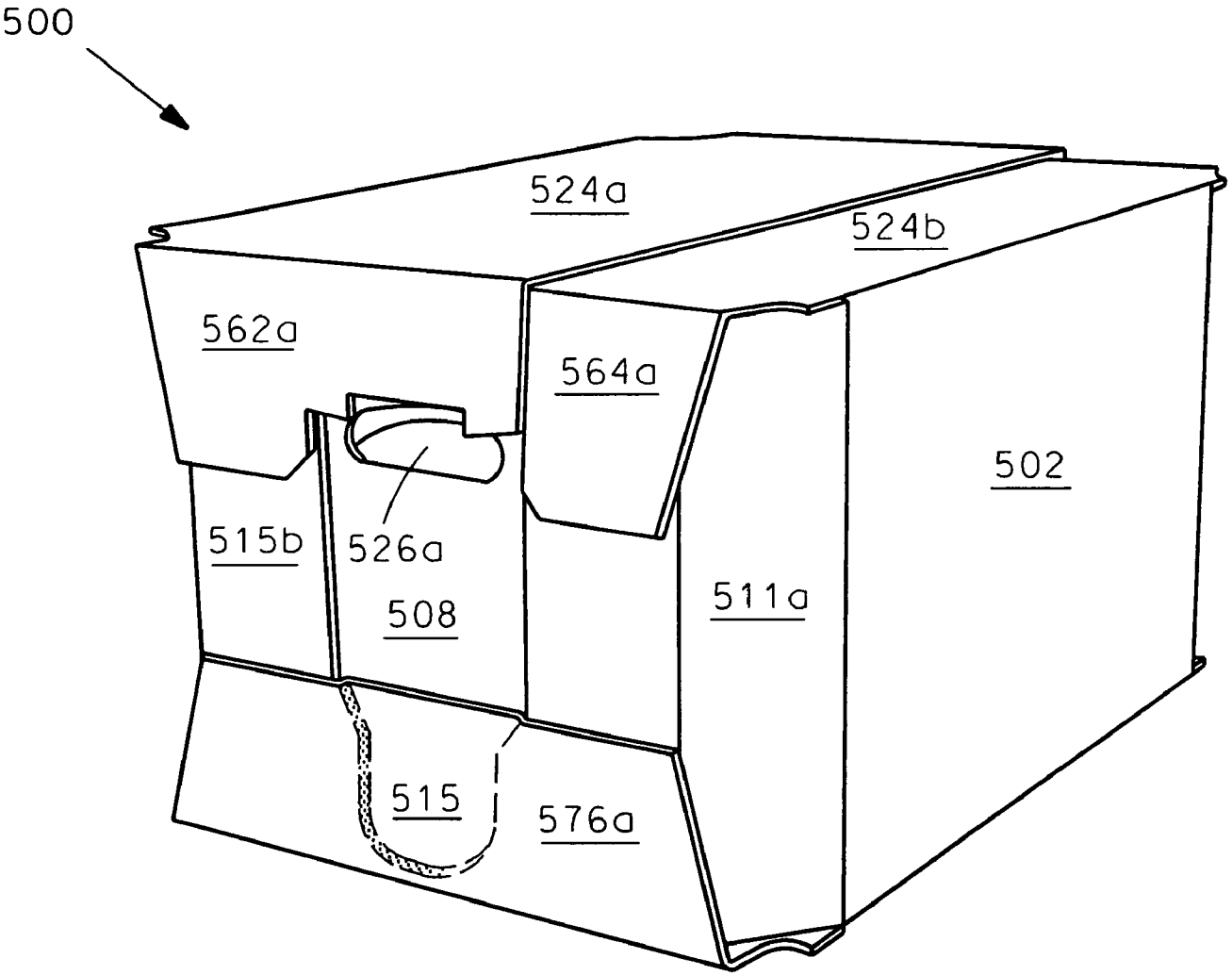
FIG. 29 is the same as FIG. 28, illustrating the three pieces multi-sided container in a closed position.

FIG. 28 is a top perspective view of a three piece container 500 in accordance with a sixth embodiment of the invention in an opened position showing the wrapper blank 550 folded and glued against the end pieces 580*a*, 580*b* to form the bottom wall 502 and side walls 504, 506 of the container 500. The respective side wall forming panels 504*a*' and 506*b*' are folded at 90 degrees with respect to the panel 502' along the fold lines 554, 556 and configured to be attached with the respective partial sidewall panels 594*a*, 594*b* and 596*a*, 596*b* so that the respective side wall forming panels 504*a*' and 506*b*' and the respective partial sidewall 594*a*, 594*b* and 596*a*, 596*b* are glued to one another. Next, the respective top wall panels 524*a*', 524*b*' are folded along respective fold lines 558, 560 to form top wall 524*a*, 524*b* as depicted in FIG. 27. The respective flaps 562*a*', 562*b*', 564*a*', 564*b*' are folded along the respective fold lines 566*a*, 566*b*, 568*a*, 568*b* and fold out the container 500. Then the flaps 576*a*', 576*b*' are glued to the respective end walls 508, 510. It should be noted that Tray/Bliss wrapper 550 "outside bottom end sealing flap 576" is split into 3 sections, but with a crushed and scored area 515 instead of with slits or slots. This yields a full width, relatively smooth and straight label surface. The mid section of the Tray/Bliss wrapper 550 "outside bottom end sealing flap" is bordered by a crushed zone that allows the center portion 515 to be pushed inward to secure to the Tray/Bliss end Panel 576. FIG. 29 is the same as FIG. 28, illustrating the three pieces container 500 in a closed position.

Figure 26:
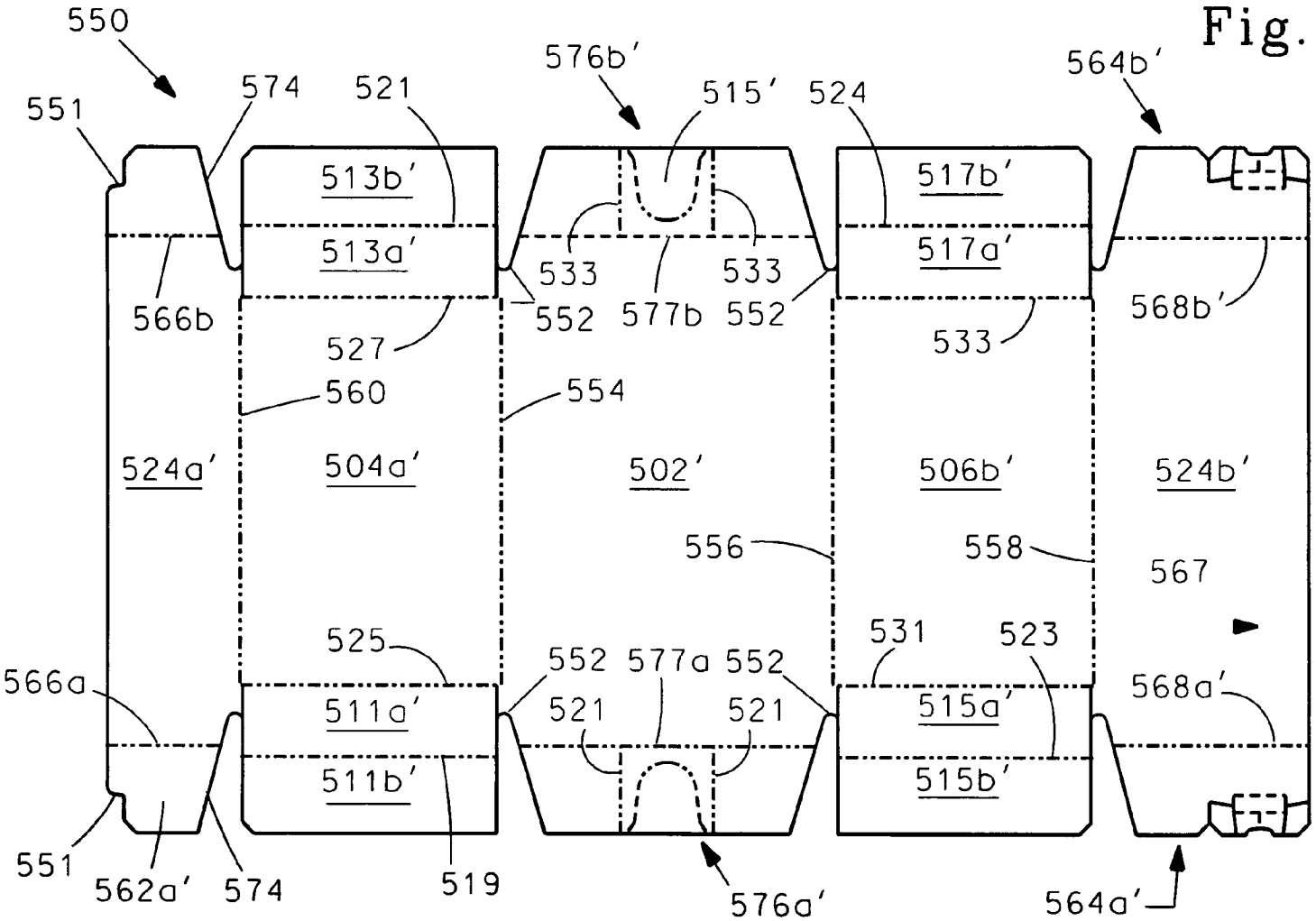
FIG. 26 is a plan view of an eight corners 37 degrees angles tray bliss arc/perf wrapper blank having hand holes lock that forms the bottom wall, top and side walls of a three pieces container similar to the three pieces container depicted in FIG. 29 in accordance with a seventh embodiment of the invention.

FIG. 26 is a plan view of an eight corners 37 degrees angles tray bliss arc/perf wrapper blank 550 having hand holes lock 551 that forms the bottom wall 502', top and side walls 524*a*', 504*a*' & 506*b*' of a the three piece container 500 depicted in FIG. 27 in accordance with a six embodiment of the invention. The wrapper blank 550 comprises a centrally located rectangular panel 502' that forms the bottom wall 502. The rectangular panel 502' has an advantage of having four identical rounded corners 552 which enhances the integrity of the container 500 when the wrapper blank 550 is folded. Side wall forming panels 504' and 506' are foldably joined to opposite side edges of the panel 502' by respective fold lines 554, 556. Each longitudinal end of the side wall panels 504*a*', 506*b*' includes a respective pair of reinforcement flaps 511*a*', 511*b*', 513*a*', 513*b*' and 515*a*', 515*b*', 517*a*' 517*b*'. The reinforcement flap 511*a*', 511*b*' are defined by fold lines 519, 525. The reinforcement flaps 513*a*', 513*b*' are defined by fold lines 521, 527. The reinforcement flaps 515*a*', 515*b*' are defined by fold lines 523, 531. The reinforcement flaps 517*a*', 517*b*' are defined by fold lines 524, 533. Top wall panels 524*a*' and 524*b*' are foldably joined to respective longitudinal edges of the sidewall panels 504*a*' and 506*b*', opposite of their folded connection to the panel 502', by fold lines 558, 560. Each of the top wall panels 524*a*', 524*b*' includes two respective identical flaps 562*a*', 562*b*' and 564*a*', 564*b*' defined by respective fold lines 566*a*', 566*b*', and 568*a*', 568*b*'. An Arrow mark 567 indicates the direction of corrugation of the wrapper blank 550. Similarly, each of the top wall panels 524*a*', 524*b*', as noted with respect to the rectangular panel 502', has an advantage of having two identical rounded corners 572 which enhances the integrity of the container 500 when the wrapper blank 550 is folded. In addition, it should be noted that one side edge 574 of each flaps 562*a*', 562*b*' and 564*a*', 564*b*' is tapered so that when these flaps are folded, the tapered 547 would align the tapered edges of the flaps 511*b*', 513*b*', 515*b*', and 517*b*'. A pair of flaps 576*a*', 576*b*' is foldably joined to respective transverse edges of the panel 502' by fold lines 577*a*', 577*b*'. The flaps 576*a*', 576*b*' are essentially identical to one another and they are mirror images of one another. Each of the flaps 576*a*', 576*b*' is split into three sections by fold lines 521, 531 with a crushed and scored area 515. This yield a full width, relatively smooth and straight label surface. The mid section of the Tray/Bliss wrapper 550 "outside bottom end sealing flap" is bordered by a crushed zone that allows the center portion 515 to be pushed inward to secure to the Tray/Bliss end Panel 576. The respective flaps 576*a*', 576*b*'are glued to the respective end walls 508, 510 when the wrapper blank 550 is folded to form the bottom wall 502, side walls 504, 506, and top walls 524*a* and 524*b*.It should be noted that it is preferred that the corners angle of tray bliss be 33 or 37 degrees, however, other angles such as 30, 31, 32, 34, 35, 36, 38, 39, 40, 41, 42, 43, 44 degrees are within the scope of the invention.

FIGS. 27A-B is a plan view of one of a pair of blanks 580 that form the tray bliss end pieces used to construct the three-piece container depicted in FIG. 25. One of the pair of end pieces 580*a*' and 580*b*' is attached to respective transverse edges of the panel 502'. The end pieces 580*a*' and 580*b*' are essentially identical to one another and they are mirror images of one another. The end piece 580*a*' includes an end wall panel 508', two relatively narrow reinforcing corner panels 586' and 588' foldably joined to opposite ends of the panel 508' by fold lines 582*a*', 582*b*', and second partial sidewall panels 594*a*', 594*b*' are foldably joined to outer edges of respective narrow reinforcing corner panels 586' and 588' by fold lines 591 and 593. Similarly, The end piece 580*b*' includes an end wall panel 510', two relatively narrow reinforcing corner panels 590' and 592' foldably joined to opposite ends of the panel 510' by fold lines 584*a*', 584*b*', and second partial sidewall panels 596*a*', 596*b*' are foldably joined to outer edges of respective narrow reinforcing corner panels 590' and 592' by fold lines 595 and 597. Openings 562*a*', 562*b*' are formed on the respective end wall panels 508', 510' so that when the end pieces 580*a*', 580*b*' are folded, these openings 562*a*', 562*b*' forms the hand hole openings 562*a*, 562*b* in the container 500 as described with reference to FIG. 27.

Figure 30:
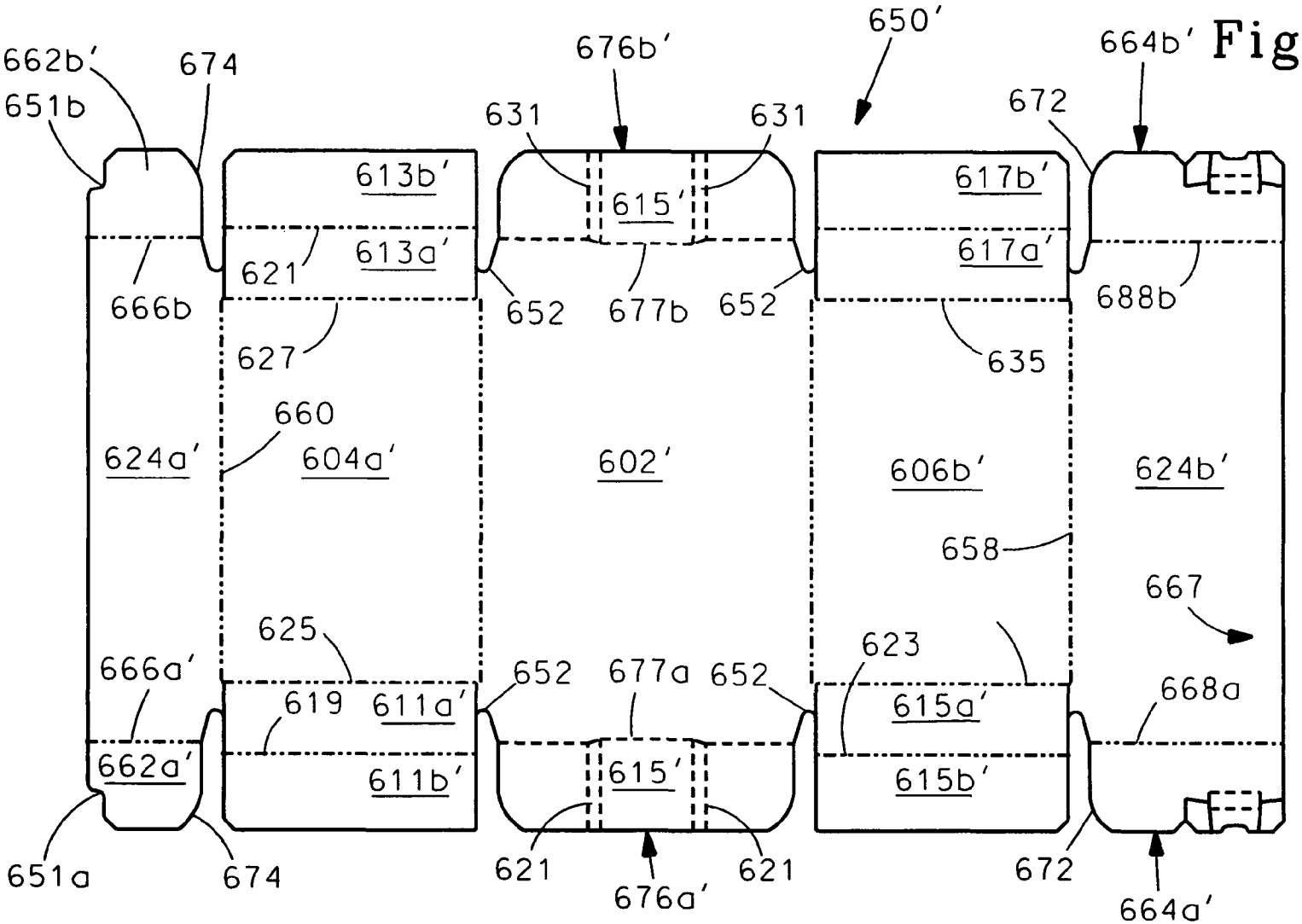
FIG. 30 is a plan view of a eight corners 33 degrees angles tray bliss wrapper blank having hand holes lock that forms the bottom wall, top and side walls of a three pieces multi-sided container similar to the three pieces container depicted in FIG. 31 in accordance with an eighth embodiment of the invention.
Figure 31:
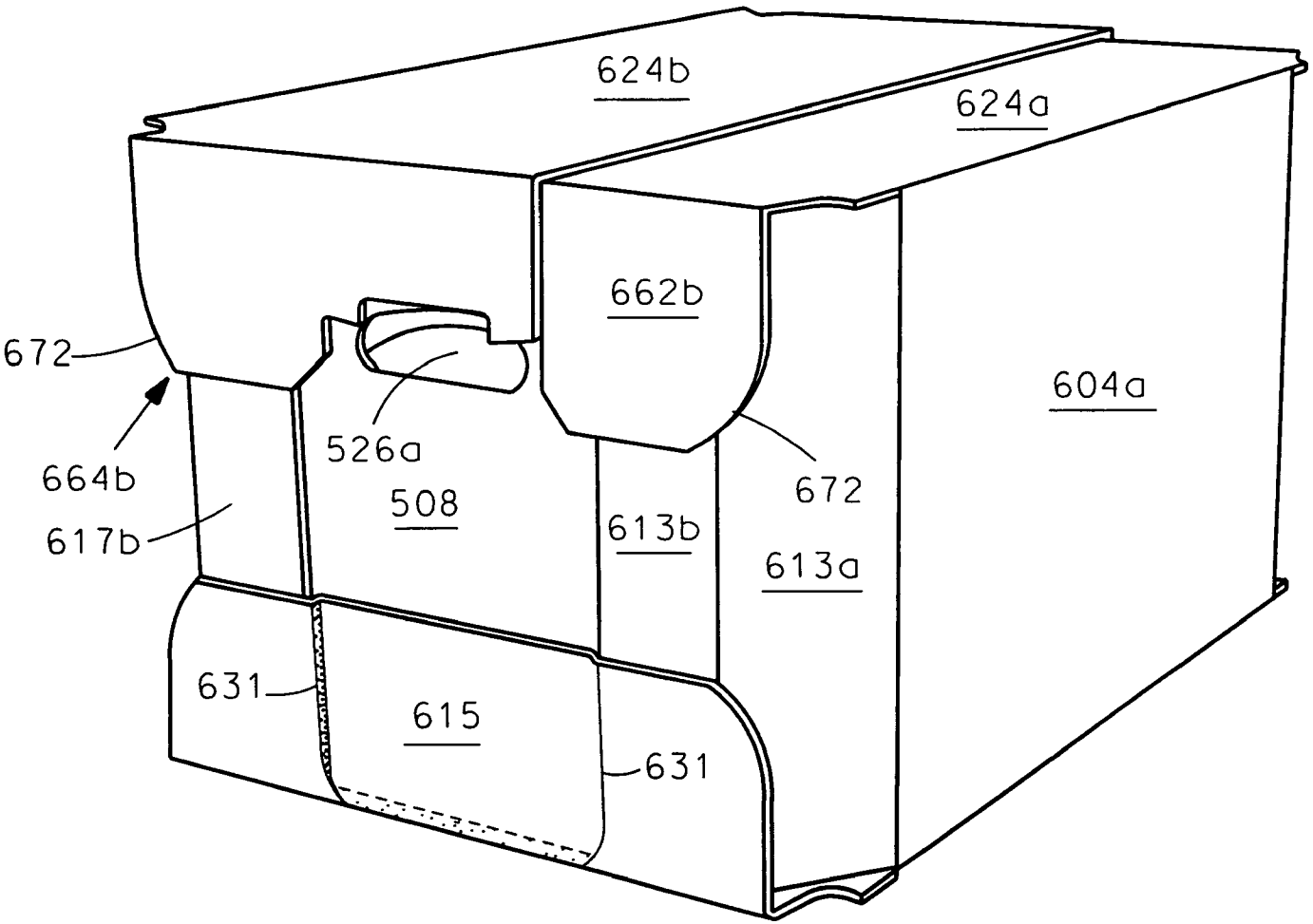
FIG. 31 is a perspective view of the fully constructed three-piece multi-sided container of the tray bliss wrapper blank of FIG. 30, illustrating the three pieces multi-sided container in a closed position.

FIG. 30 is a plan view of a eight corners 33 degrees angles tray bliss wrapper blank 650 having hand hole locks 651 that forms the bottom wall 602', respective top and side walls 624*a*', 624*b*' and 604*a*', 606*b*' of a three piece container similar to the three pieces container depicted in FIG. 31 in accordance with a seventh embodiment of the invention. The wrapper blank 650 comprises a centrally located rectangular panel 602' that forms the bottom wall 602. The rectangular panel 602' has an advantage of having four identical rounded corners 652 which enhances the integrity of the container 600 when the wrapper blank 650 is folded. Side wall forming panels 604' and 606' are foldably joined to opposite side edges of the panel 602' by respective fold lines 654, 656. Each longitudinal end of the side wall panels 604*a*', 606*b*' includes a respective pair of reinforcement flaps 611*a*', 611*b*', 613*a*', 613*b*' and 615*a*', 615*b*', 617*a*' 617*b*'. The reinforcement flap panels 611*a*', 611*b*' are defined by fold lines 619, 625. The reinforcement flaps 613*a*', 613*b*' are defined by fold lines 621, 627. The reinforcement flaps 615*a*', 615*b*' are defined by fold lines 623, 631. The reinforcement flaps 617*a*', 617*b*' are defined by fold lines 624, 633. Top wall panels 624*a*' and 624*b*' are foldably joined to respective longitudinal edges of the sidewall panels 604*a*' and 606*b*', opposite of their folded connection to the panel 602', by fold lines 658, 660. Each of the top wall panels 624*a*', 624*b*' includes two respective identical flaps 662*a*', 662*b*' and 664*a*', 664*b*' defined by respective fold lines 666*a*', 666*b*', and 668*a*', 668*b*'. An Arrow mark 667 indicates the direction of corrugation of the wrapper blank 650. Similarly, each of the top wall panels 624*a*', 624*b*', as noted with respect to the rectangular panel 602', has an advantage of having two identical rounded corners 672 which enhances the integrity of the container 600 when the wrapper blank 650 is folded. In addition, it should be noted that one side edge 674 of each flaps 662*a*', 662*b*' and 664*a*', 664*b*' is tapered so that when these flaps are folded, the tapered 674 would align the tapered edges of the flaps 611*b*', 613*b*', 615*b*', and 617*b*'. A pair of flaps 677*a*', 677*b*' is foldably joined to respective transverse edges of the panel 602' by fold lines 676*a*', 676*b*'. The flaps 676*a*', 676*b*' are essentially identical to one another and they are mirror images of one another. Each of the flaps 676*a*', 676*b*' is split into three sections by fold lines 621, 631 with two crushed and scored area 615. The mid section of the wrap "outside bottom end sealing flap" has an inwardly offset bottom score line. This inward offset pushes the mid section in to be adhered to the Tray/Bliss end. This yields a full width, relatively smooth and straight label surface. The mid section of the Tray/Bliss wrapper 650 "outside bottom end sealing flap" is bordered by a crushed zone that allows the center portion 615 to be pushed inward to secure to the Tray/Bliss end Panel 676. Because the Tray/Bliss wrap "outside bottom end sealing flap" mid section bottom score line is offset inward, and the mid sections sides are still connected to the outer portions of the panel the wrap bottom mid section may bulge downward creating an unstable bottom stacking surface on a lightly loaded package. The respective flaps 676*a*', 676*b*'are glued to the respective end walls 608, 610 when the wrapper blank 650 is folded to form the bottom wall 602, side walls 604, 606, and top walls 624*a* and 624*b*.FIG. 31 is a perspective view of the fully constructed three-piece multi-sided container of the tray bliss wrapper blank of FIG. 30, illustrating the three pieces multi-sided container in a closed position.

Figure 32:
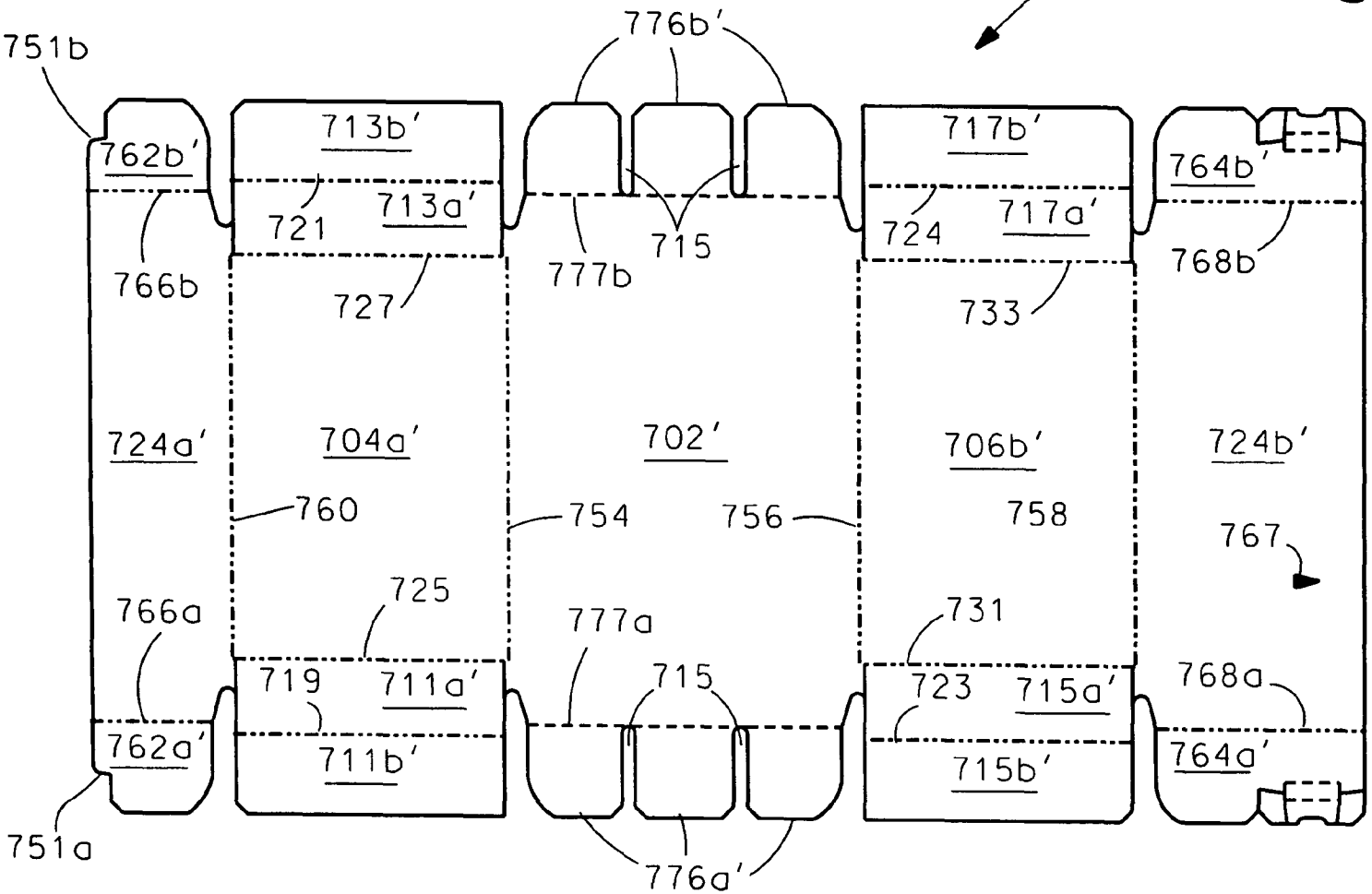
FIG. 32 is a plan view of a eight corners tray bliss wrapper blank having hand holes lock that forms the bottom wall, top and side walls of a three pieces container similar to three pieces container depicted in FIG. 33 in accordance with a ninth embodiment of the invention.
Figure 33:
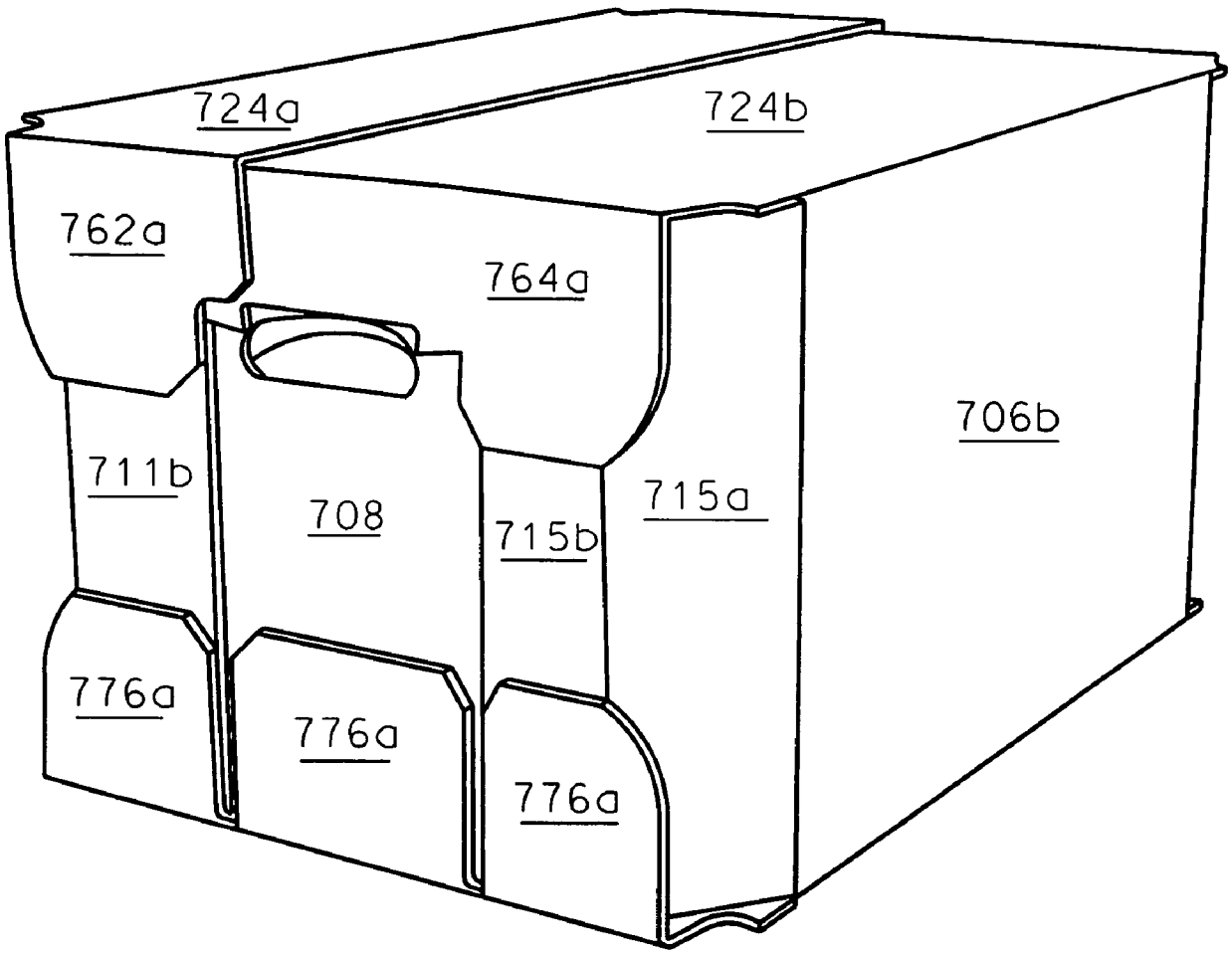
FIG. 33 is a perspective view of the fully constructed three-piece multi-sided container of the tray bliss wrapper blank of FIG. 32, illustrating the three pieces multi-sided container in a closed position.

FIG. 32 is a plan view of a eight corners tray bliss wrapper blank 750 having hand holes lock 751 that forms the bottom wall 702, respective top and side walls 724*a*, 724*b*, 704, 706 of a three pieces container (not shown) similar to three pieces container 500 depicted in FIG. 27 in accordance with a eighth embodiment of the invention. The wrapper blank 750 comprises a centrally located rectangular panel 702' that forms the bottom wall 702. The rectangular panel 702' has an advantage of having four identical rounded corners 752 which enhances the integrity of the container 700 (not shown) when the wrapper blank 750' is folded. Side wall forming panels 704' and 706' are foldably joined to opposite side edges of the panel 702' by respective fold lines 754, 756. Each longitudinal end of the side wall panels 704*a*', 706*b*' includes a respective pair of reinforcement flaps 711*a*', 711*b*', 713*a*', 713*b*' and 715*a*', 715*b*', 717*a*', 717*b*'. The reinforcement flap panels 711*a*', 711*b*' are defined by fold lines 719, 725. The reinforcement flaps 713*a*', 713*b*' are defined by fold lines 721, 727. The reinforcement flaps 715*a*', 715*b*' are defined by fold lines 723, 731. The reinforcement flaps 717*a*', 717*b*' are defined by fold lines 724, 733. Top wall panels 724*a*' and 724*b*' are foldably joined to respective longitudinal edges of the sidewall panels 704*a*' and 706*b*', opposite of their folded connection to the panel 702', by fold lines 758, 760. Each of the top wall panels 724*a*', 724*b*' includes two respective identical flaps 762*a*', 762*b*' and 764*a*', 764*b*' defined by respective fold lines 766*a*', 766*b*', and 768*a*', 768*b*'. An Arrow mark 767 indicates the direction of corrugation of the wrapper blank 750. Similarly, each of the top wall panels 724*a*', 724*b*', as noted with respect to the rectangular panel 702', has an advantage of having two identical rounded corners 772 which enhances the integrity of the container 700 when the wrapper blank 650 is folded. In addition, it should be noted that one side edge 774 of each flaps 762*a*', 762*b*' and 764*a*', 764*b*' is tapered so that when these flaps are folded, the tapered 747 would align the tapered edges of the flaps 711*b*', 713*b*', 715*b*', and 717*b*'. A pair of flaps 777*a*', 777*b*' is foldably joined to respective transverse edges of the panel 702' by fold lines 776*a*', 776*b*'. The flaps 776*a*', 776*b*' are essentially identical to one another and they are mirror images of one another. Each of the flaps 776*a*', 776*b*' is split into three sections by slot or slit 715. The sections towards the sides of the container are secured to the Wrap's "vertical end walls". The separate mid section is inset with an offset score so that the flap can secure directly to mid section of the Tray/Bliss end. The respective flaps 776*a*', 776*b*'are glued to the respective end walls 708, 710 when the wrapper blank 750 is folded to form the bottom wall 702, side walls 704, 706, and top walls 724*a* and 724*b*.FIG. 33 is a perspective view of the fully constructed three-piece multi-sided container of the tray bliss wrapper blank of FIG. 32, illustrating the three pieces multi-sided container in a closed position.

Figure 34:
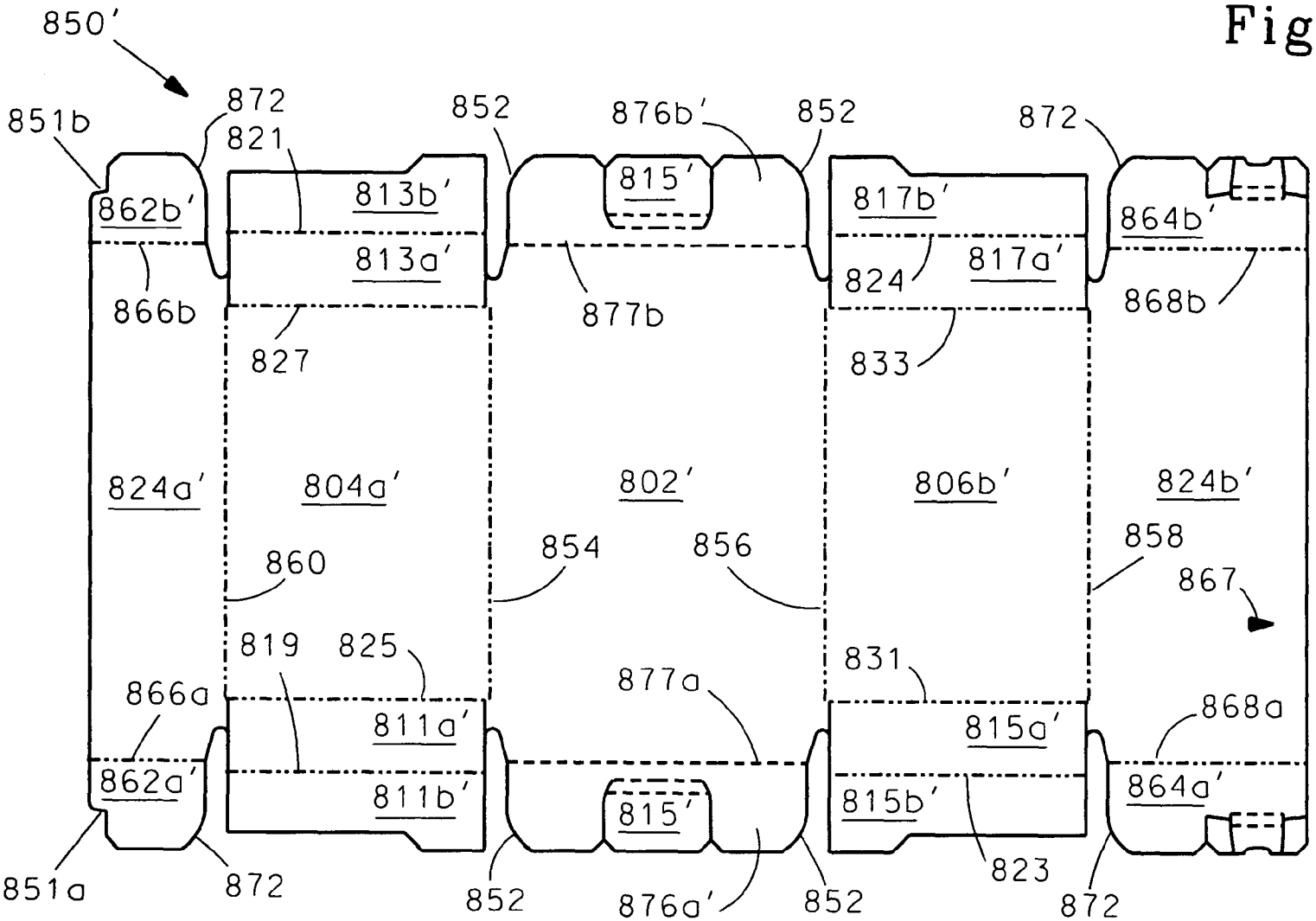
FIG. 34 is a plan view of a eight corners 33 degrees angles tray bliss slit wrapper blank having hand holes lock that forms the bottom wall, top and side walls of a three pieces container similar to the three pieces container depicted in FIG. 35 in accordance with a tenth embodiment of the invention.
Figure 35:
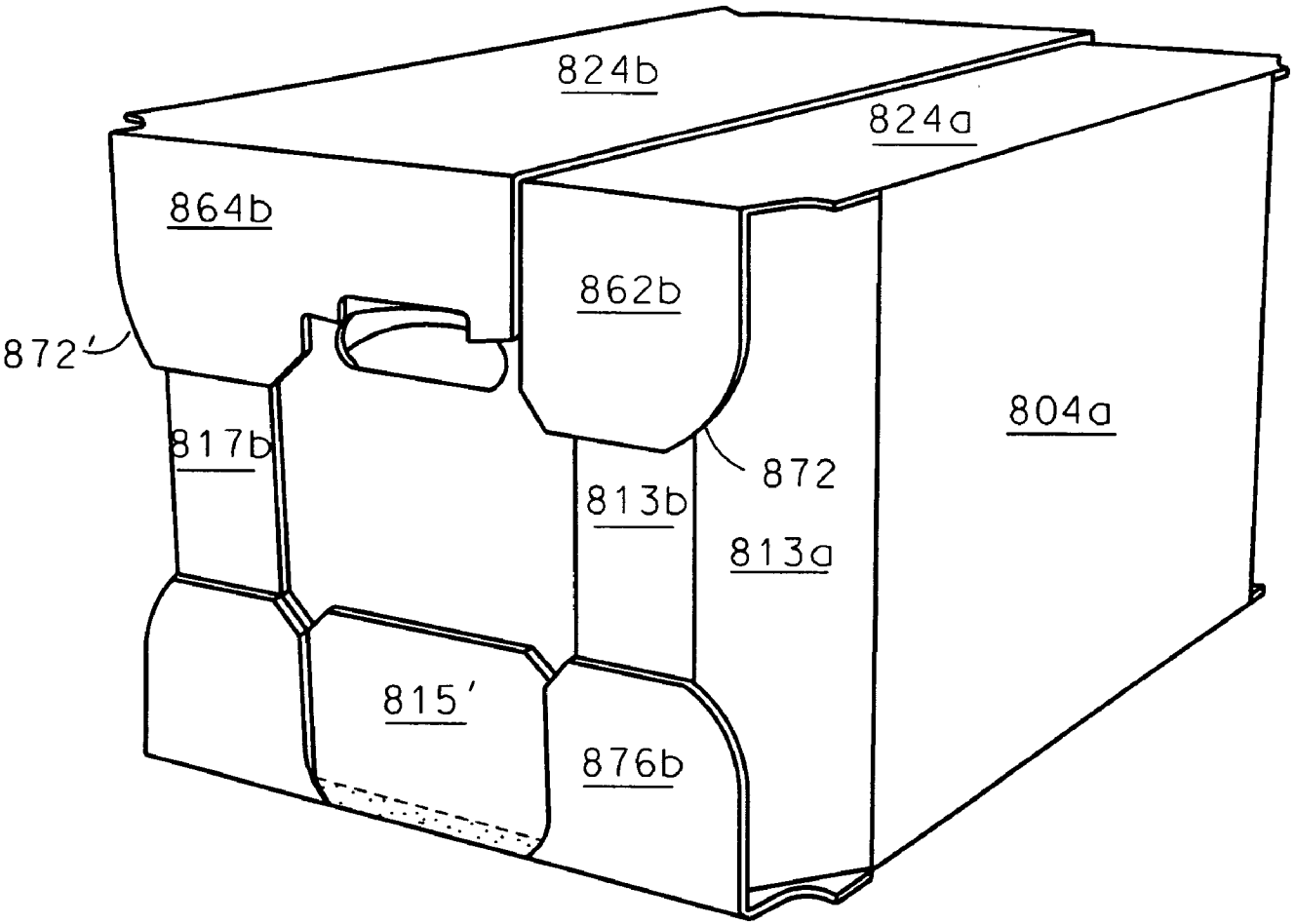
FIG. 35 is a perspective view of the fully constructed three-piece multi-sided container of the tray bliss wrapper blank of FIG. 34, illustrating the three pieces multi-sided container in a closed position.

FIG. 34 is a plan view of a eight corners 33 degrees angles tray bliss slit wrapper blank 850' having hand holes lock 851 that forms the bottom wall 802, respective top and side walls 824, 804, 806 of a three pieces container (not shown) similar to the three pieces container 500 depicted in FIG. 27 in accordance with a ninth embodiment of the invention. The wrapper blank 850 comprises a centrally located rectangular panel 802' that forms the bottom wall 802. The rectangular panel 802' has an advantage of having four identical rounded corners 852 which enhances the integrity of the container 800 (not shown) when the wrapper blank 850 is folded. Side wall forming panels 804' and 806' are foldably joined to opposite side edges of the panel 802' by respective fold lines 854, 856. Each longitudinal end of the side wall panels 804*a*', 806*b*' includes a respective pair of reinforcement flaps 811*a*', 811*b*', 813*a*', 813*b*' and 815*a*', 815*b*', 817*a*', 817*b*'. The reinforcement flap panels 811*a*', 811*b*' are defined by fold lines 819, 825. The reinforcement flaps 813*a*', 813*b*' are defined by fold lines 821, 827. The reinforcement flaps 815*a*', 815*b*' are defined by fold lines 823, 831. The reinforcement flaps 817*a*', 817*b*' are defined by fold lines 824, 833. Top wall panels 824*a*' and 824*b*' are foldably joined to respective longitudinal edges of the sidewall panels 804*a*' and 806*b*', opposite of their folded connection to the panel 802', by fold lines 858, 860. Each of the top wall panels 824*a*', 824*b*' includes two respective identical flaps 862*a*', 862*b*' and 864*a*', 864*b*' defined by respective fold lines 866*a*', 866*b*', and 868*a*', 868*b*'. An Arrow mark 867 indicates the direction of corrugation of the wrapper blank 850. Similarly, each of the top wall panels 824*a*', 824*b*', as noted with respect to the rectangular panel 802', has an advantage of having two identical rounded corners 872 which enhances the integrity of the container 800 (not shown) when the wrapper blank 850 is folded. In addition, it should be noted that one side edge 874 of each flap 862*a*', 862*b*' and 864*a*', 864*b*' is tapered so that when these flaps are folded, the tapered 847 would align the tapered edges of the flaps 811*b*', 813*b*', 815*b*', and 817*b*'. A pair of flaps 876*a*', 876*b*' is foldably joined to respective transverse edges of the panel 802' by fold lines 876*a*', 876*b*'. The flaps 876*a*', 876*b*' are essentially identical to one another and they are mirror images of one another. Each of the flaps 876*a*', 876*b*' is split into three sections but not fully as shown by section 815. The "outside bottom end sealing flap" bottom connection score line remains unbroken which will improve the package's rough handling durability. The inset panel of the "outside bottom end sealing flap" uses double scores to push the panel inward towards the Tray/Bliss end. The double scores form a "Boxed Bream" along the bottom end of the package. This may improve package end stiffness. The uneven surface of the 3 part wrap "outside bottom end sealing flap" limits its use as a label application area. The Tray/Bliss wrap "vertical end walls" have been cut back to allow an end panel label to be placed between them and above the mid section of the "outside bottom end sealing flap". The location of the label area between the "top closure flaps" and the "outside bottom end sealing flap" links the height of the label area to the difference between the total package height and the width of the 2 flaps. Shallow depth packages may not have any label space available. FIG. 35 is a perspective view of the fully constructed three-piece multi-sided container of the tray bliss wrapper blank of FIG. 34, illustrating the three pieces multi-sided container in a closed position.

Figure 36:
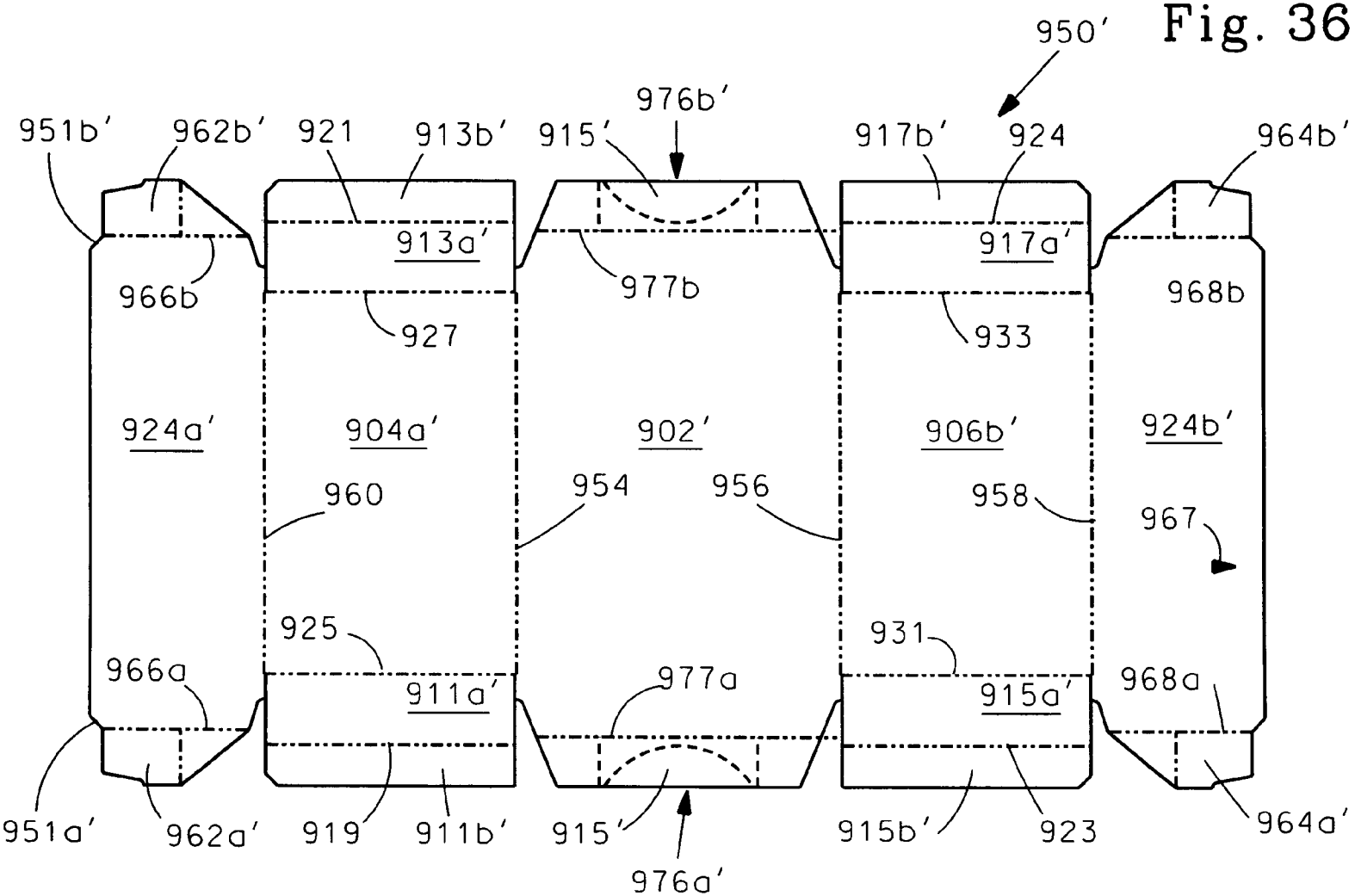
FIG. 36 is a plan view of a eight corners 37 degrees angles tray bliss arc/perf wrapper blank having hand holes lock that forms the bottom wall and side walls of a three pieces container in accordance with an eleventh embodiment of the invention.

FIG. 36 is a plan view of a eight corners 37 degrees angles tray bliss arc/perf wrapper blank 550" having hand holes lock that forms the bottom wall and side walls of a three pieces container in accordance with an tenth embodiment of the invention. The wrapper blank 550" is similar to the wrapper blank 550 as described hereinabove in detail and will not be described again to avoid redundancy.

Figure 37:
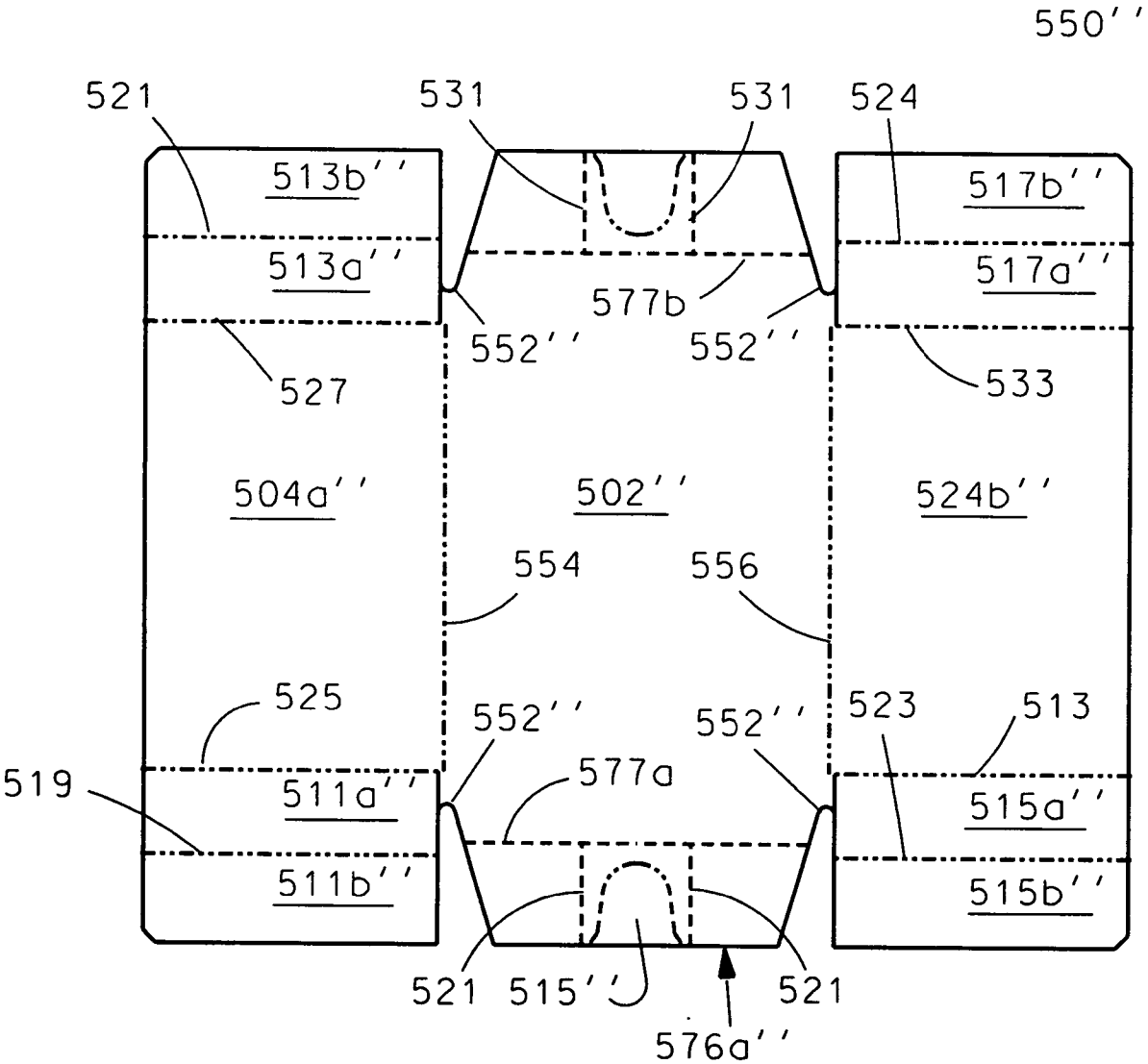
FIG. 37 is a plan view of a eight corners 37 degrees angles tray bliss arc/perf wrapper-side seal blank having hand holes lock that forms the bottom wall, top and side walls of a three pieces container similar to the three pieces container depicted in FIG. 35 in accordance with a twelfth embodiment of the invention.

FIG. 37 is a plan view of a eight corners 37 degrees angles tray bliss arc/perf wrapper-side seal blank 950 having hand holes lock 951 that forms the bottom wall 902, top and side walls 924, 904, 906 of a three pieces container similar to the three pieces container depicted in FIG. 27 in accordance with a eleventh embodiment of the invention. The wrapper blank 950 is similar to the wrapper blank 550 as described hereinabove in detail and will not be described again to avoid redundancy.

A multi-sided container manufactured as above can be made with automated equipment, and when made and glued up as described, all seams and joints are sealed against the environment.

It should be noted that the angles of the reinforcing diagonal corner panel for all embodiments are from about 33 to about 38 degrees which helps to stiffen the structure of the container 10 or 70 or 200 or 300 to resist both outward and inward flexing of both the end walls and sidewalls of the container. Generally, a force against the end wall inwardly, tends to cause a somewhat equal reaction outwards on the sidewall of the container. Conversely, if the product inside the container pushes outwardly against the end wall, it tends to cause a somewhat equal reaction on the sidewalls and thereby force them to flex inwardly. This aspect is important for a couple of reasons: first, If the end wall flexes inward, it will cause the side walls to flex outward, as well as affecting positive sealing during the final closure of the side flaps. These flaps need to have a somewhat perpendicular and rigid surface to seal against as the machinery accomplishes the sealing which relies on a positive resistance from the end wall. Also, if the sidewall flexes outwardly, the intended distance between the top flaps edges will be affected causing less of an overlap, or more of a gap depending on the final sealing intention. Second, if the end wall flexes outwards, it will force the sidewalls to flex inward which will cause the top flaps to overlap more than they are intended to or have less of a gap depending on the final sealing intention. Additionally, the sealing of the side flaps will be difficult due to the end wall extending outward past a 90 degree position. Therefore, by modifying the diagonal corner panel angle ranges from about 33 to about 38 degrees, it tends to make the end walls and side walls react independently of one another when forces are applied thereto. In addition, because these reactions are now separated from each other, the flexing of the end panel is limited to the normal range that one would see in a traditional square cornered box making the final sealing of the side flaps easier.

In general, a conventional four sided internal flange bliss package generates good stacking performance with a fairly efficient use of materials. The bliss wrap provides the top, bottom and sides for containment with relatively light weight materials. The heavier weight, flanged end panels are laminated to the side walls and secured to the wrap bottom and side edges to complete the package containment and generate significant package stacking compression strength from four 2 ply corners.

The corner post bliss is a modest improvement over the conventional 4 sided bliss. The corner post bliss has end panels with extra vertical scores to create diagonal corners between the end and side walls. The wrap has extended glue flanges that stretch over the corner void and secure to the main panel of the end creating a corner post. The exterior of the package remains rectangular. The inside is 8 sided. The finished package generates more compression strength with 12 single ply corners. The wrap blank size is larger than the four sided bliss wrap.

The two ply wrapped corner eight sided bliss utilizes modified diagonal corners on both the end and wrap. When the package is assembled the outer wrap and ends are laminated into a continuous 2 ply corner that wraps from the package side on to its ends. Some advantages of the present modification, not limited to, are 1) 8 laminated corners provide additional stacking strength and overall package stiffness 2) the wrap blank size is the same as a 4 sided bliss (lower cost than the corner post wrap) and 3) the wrap flanges extend across a larger portion of the end panel which increases end panel stiffness.

The eight Sided Tray/Bliss package combines three sheets of corrugated material very efficiently into the container (i.e., all the embodiments described hereinabove) that has significantly improved package stacking strength compared to a "typical" bliss package of similar size. The eight Sided Tray/Bliss also have significantly better end to end rigidity than a similar sized eight sided tray. The general characteristic of multi-sided container is:

1. The wrap & end pieces can be made from different materials. Typically the wrap is lighter weight with a focus on containment. Typically the end pieces are heavier materials focused toward stacking strength.
2. The container configuration is compatible with many industrial packaging applications, but is focused toward the food industry, especially the fresh meat and poultry industries. Fresh meat and poultry packaging requires an area on the end of the container for product labeling. This labeling is often in the form of a pressure sensitive label.
3. The package has eight two ply corners for stacking strength. The two ply corners also dramatically stiffen the end to end rigidity of the container. A typical eight sided tray generally has quite a bit of "flex" end to end and side to side.
4. The package can be made with integral top flaps or as an open top container with a separate cover.
5. If top flaps are used, the flaps can be glued with a side sealing format, or, they can be secured with a hand hole lock flap. It should be noted that the good end to end rigidity is critical to a glued side seal operation.

6. The "bottom outside end sealing flap" can be large enough to provide an end panel label area.
7. The bottom panel is a full width & length smooth panel. No flaps to come open and dump contents.
8. The Tray/Bliss End "vertical side walls" are adhered to the "wrap side walls" to greatly stiffen and strengthen the "wrap side walls".

While the invention has been described with reference to preferred embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A multi-sided container comprising a bottom wall, a top wall, opposite side walls, opposite end walls, a longitudinal axis and a plurality of diagonal corner walls, the top wall being defined by two top wall panels each of which is foldably joined to the respective opposite side walls and wherein each of the top wall panels has two rounded corners, at least one of the plurality of diagonal corner walls defined by at least one diagonal corner panel and at least one reinforcement flap overlapping coextensively on one another, the at least one reinforcement flap includes an end flap foldably joined thereto and attached to one of the opposite end walls and wherein a portion of the bottom wall projects under and beyond a bottom edge of the at least one diagonal corner wall and wherein each of rounded corners of the respective top wall panels project over and beyond a top edge of the at least one diagonal corner wall.

2. The multi-sided container of claim 1 wherein the at least one reinforcement flap includes four substantially similar reinforcement flaps and wherein each of the reinforcement flap extends from longitudinal ends of the respective opposite side walls.

3. The multi-sided container of claim 2 the respective substantially similar reinforcement flaps comprising respective four end flaps wherein each of the end flaps extends from a longitudinal side of the each respective reinforcement flap.

4. The multi-sided container of claim 3 wherein each of the end flaps project beyond an entire surface of the respective at least one diagonal corner walls terminating their edges at the respective end walls.

5. The multi-sided container of claim 1 wherein the opposite side walls and opposite end walls are attached to one another via end flaps.

6. The multi-sided container of claim 1 wherein the bottom wall, the side walls, and top wall are integrally attached to one another to define a wrapper and the respective end wall panels, respective diagonal corner panels, and respective partial side wall panels are integrally attached to one another to define respective end pieces.

7. The multi-sided container of claim 6 wherein the wrapper and the respective end pieces are integrally attached to one another.

8. The multi-sided container of claim 1 wherein each of the top wall panels includes a pair of second flaps each of which is foldably joined to a respective transverse edges of the top wall panels.

9. The multi-sided container of claim 8 wherein each of the second flaps are folded over and attached to the respective opposite end walls.

10. A multi-sided container comprising:

a wrapper formed by a bottom wall having at least two side walls and a pair of first flaps extend integrally from opposite transverse edges of the bottom wall wherein the each of the two side walls extends integrally from opposite longitudinal edges of the bottom wall, each of the side walls includes two reinforcement flaps and two end flaps extends from respective opposite transverse edges thereof, a top wall being defined by two top wall panels each of which is foldably joined to the respective opposite side walls and wherein each of the top wall panels has two rounded corners;

a pair of end pieces each of which formed by incorporating one end wall panel, one diagonal corner panel, and one partial side wall panel to define respective end walls and respective diagonal corner walls and wherein the pair of end pieces and the wrapper being attached to one another by the respective end flaps to construct the multi-sided container and wherein the respective diagonal corner walls and the respective reinforcement flaps overlapping coextensively on one another and wherein a portion of the bottom wall projects under and beyond a bottom edge of the respective pair of end pieces and wherein each of rounded corners of the respective top wall panels project over and beyond a top edge of the respective diagonal corner walls.

11. The multi-sided container of claim 10 wherein each of the pair of the first flaps is glued to the respective end wall.

12. The multi-sided container of claim 10 wherein each of the end flaps project beyond an entire surface of the respective diagonal corner walls terminating their edges at the respective end walls.

* * * * *